US007507511B2

(12) United States Patent
Tamoto et al.

(10) Patent No.: US 7,507,511 B2
(45) Date of Patent: Mar. 24, 2009

(54) ELECTROPHOTOGRAPHIC PHOTORECEPTOR, AND IMAGE FORMING APPARATUS AND PROCESS CARTRIDGE THEREFOR USING THE ELECTROPHOTOGRAPHIC PHOTORECEPTOR

(75) Inventors: Nozomu Tamoto, Numazu (JP); Tatsuya Niimi, Numazu (JP); Maiko Koeda, Numazu (JP); Tetsuro Suzuki, Fuji (JP); Takehiko Kinoshita, Mishima (JP); Suzuka Nozoe, Odawara (JP); Katsuichi Ohta, Mishima (JP)

(73) Assignee: Ricoh Company Ltd., Tokyo (JP)

( * ) Notice: Subject to any disclaimer, the term of this patent is extended or adjusted under 35 U.S.C. 154(b) by 466 days.

(21) Appl. No.: 11/332,545

(22) Filed: Jan. 17, 2006

(65) Prior Publication Data

US 2006/0177749 A1 Aug. 10, 2006

(30) Foreign Application Priority Data

Jan. 14, 2005 (JP) ..... 2005-007664

(51) Int. Cl.
*G03G 15/04* (2006.01)

(52) U.S. Cl. ..... 430/60; 430/64; 430/65; 399/159

(58) Field of Classification Search ..... 430/60, 430/64, 65; 399/159
See application file for complete search history.

(56) References Cited

U.S. PATENT DOCUMENTS

| | | | | |
|---|---|---|---|---|
| 4,400,455 | A | 8/1983 | Hashimoto et al. | |
| 4,863,822 | A | 9/1989 | Fukagai et al. | |
| 5,492,784 | A | 2/1996 | Yoshikawa et al. | |
| 5,578,405 | A | 11/1996 | Ikegami et al. | |
| 5,763,127 | A * | 6/1998 | Goshima et al. | 430/62 |
| 5,871,876 | A | 2/1999 | Ikuno et al. | |
| 6,026,262 | A | 2/2000 | Kinoshita et al. | |
| 6,030,733 | A | 2/2000 | Kami et al. | |
| 6,066,428 | A | 5/2000 | Katayama et al. | |
| 6,136,483 | A | 10/2000 | Suzuki et al. | |
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,355,390 | B1 * | 3/2002 | Yamanami et al. | 430/60 |
| 6,558,863 | B2 | 5/2003 | Rokutanzono et al. | |

(Continued)

FOREIGN PATENT DOCUMENTS

JP 47-6341 4/1972

(Continued)

OTHER PUBLICATIONS

U.S. Appl. No. 11/165,279, filed Jun. 24, 2005, Ohshima, et al.

(Continued)

*Primary Examiner*—Mark A Chapman
(74) *Attorney, Agent, or Firm*—Oblon, Spivak, McClelland, Maier & Neustadt, P.C.

(57) ABSTRACT

An electrophotographic photoreceptor, including:

an electroconductive substrate;

a first undercoat layer including no metal oxide, located overlying the electroconductive substrate;

a second undercoat layer including a metal oxide and a binder resin, located overlying the first undercoat layer; and a photosensitive layer located overlying the second undercoat layer, wherein the metal oxide included in the second undercoat layer has a specific resistivity not less than $10^7$ Ω·cm and a block isocyanate compound.

27 Claims, 6 Drawing Sheets

U.S. PATENT DOCUMENTS

| | | | | |
|---|---|---|---|---|
| 6,861,188 | B2 | 3/2005 | Ikegami et al. | |
| 6,899,983 | B2 | 5/2005 | Tamoto et al. | |
| 6,936,388 | B2 | 8/2005 | Suzuki et al. | |
| 7,351,507 | B2 * | 4/2008 | Nozoe et al. | 430/65 |
| 2004/0033428 | A1 | 2/2004 | Niimi | |
| 2004/0053149 | A1 | 3/2004 | Toda et al. | |
| 2004/0053152 | A1 | 3/2004 | Nagai et al. | |
| 2004/0126687 | A1 | 7/2004 | Ikegami et al. | |
| 2004/0234875 | A1 | 11/2004 | Toda et al. | |
| 2004/0248024 | A1 | 12/2004 | Suzuki et al. | |
| 2004/0253527 | A1 | 12/2004 | Suzuki et al. | |
| 2005/0008957 | A1 | 1/2005 | Ikegami et al. | |
| 2005/0069797 | A1 | 3/2005 | Niimi et al. | |
| 2005/0112484 | A1 | 5/2005 | Nozoe et al. | |
| 2005/0141919 | A1 | 6/2005 | Kitajima et al. | |
| 2005/0158641 | A1 | 7/2005 | Yanagawa et al. | |
| 2005/0158644 | A1 | 7/2005 | Kondo et al. | |
| 2005/0175911 | A1 | 8/2005 | Tamoto et al. | |
| 2005/0181291 | A1 | 8/2005 | Kami et al. | |
| 2005/0196193 | A1 | 9/2005 | Tamoto et al. | |
| 2005/0221210 | A1 | 10/2005 | Suzuki et al. | |
| 2005/0266325 | A1 | 12/2005 | Yanagawa et al. | |
| 2005/0266328 | A1 | 12/2005 | Yanagawa et al. | |

FOREIGN PATENT DOCUMENTS

| | | |
|---|---|---|
| JP | 51-65942 | 6/1976 |
| JP | 52-010138 | 1/1977 |
| JP | 52-082238 | 9/1977 |
| JP | 55-113045 | 9/1980 |
| JP | 56-048637 | 5/1981 |
| JP | 58-058556 | 4/1983 |
| JP | 58-093062 | 6/1983 |
| JP | 58-095351 | 6/1983 |
| JP | 58-105155 | 6/1983 |
| JP | 59-017557 | 1/1984 |
| JP | 59-093453 | 5/1984 |
| JP | 60-032054 | 2/1985 |
| JP | 60-066258 | 4/1985 |
| JP | 60-111255 | 6/1985 |
| JP | 61-163346 | 7/1986 |
| JP | 64-1728 | 1/1989 |
| JP | 64-068762 | 3/1989 |
| JP | 64-068763 | 3/1989 |
| JP | 64-073352 | 3/1989 |
| JP | 64-073353 | 3/1989 |
| JP | 01-118848 | 5/1989 |
| JP | 01-118849 | 5/1989 |
| JP | 01-177556 | 7/1989 |
| JP | 03-033857 | 2/1991 |
| JP | 04-170552 | 6/1992 |
| JP | 04-281461 | 10/1992 |
| JP | 05-011483 | 1/1993 |
| JP | 05-080572 | 4/1993 |
| JP | 05-216249 | 8/1993 |
| JP | 06-019174 | 1/1994 |
| JP | 06-208238 | 7/1994 |
| JP | 06-222600 | 8/1994 |
| JP | 08-184979 | 7/1996 |
| JP | 08-262779 | 10/1996 |
| JP | 09-265202 | 1/1997 |
| JP | 09-043886 | 2/1997 |
| JP | 09-190005 | 7/1997 |
| JP | 09-288367 | 11/1997 |
| JP | 2000-066425 | 3/2000 |
| JP | 3086965 | 7/2000 |
| JP | 2002-107984 | 4/2002 |
| JP | 2004-177552 | 6/2004 |

OTHER PUBLICATIONS

U.S. Appl. No. 11/166,853, filed Jun. 27, 2005, Ohshima, et al.
U.S. Appl. No. 11/926,748, filed Oct. 29, 2007, Yanagawa, et al.
U.S. Appl. No. 12/000,239, filed Dec. 11, 2007, Fujiwara, et al.
U.S. Appl. No. 11/611,179, filed Dec. 15, 2006, Niimi, et al.
U.S. Appl. No. 11/563,710, filed Nov. 28, 2006, Inaba, et al.
U.S. Appl. No. 11/616,523, filed Dec. 27, 2006, Fujiwara, et al.
U.S. Appl. No. 12/020,713, filed Jan. 28, 2008, Matsumoto, et al.
U.S. Appl. No. 11/625,873, filed Jan. 23, 2007, Niimi.
U.S. Appl. No. 12/035,016, filed Feb. 21, 2008, Iwamoto, et al.
U.S. Appl. No. 12/047,011, filed Mar. 12, 2008, Kami, et al.
U.S. Appl. No. 11/684,520, filed Mar. 9, 2007, Toshine, et al.
U.S. Appl. No. 11/685,441, filed Mar. 13, 2007, Yanagawa, et al.
U.S. Appl. No. 11/692,682, filed Mar. 28, 2007, Mori, et al.
U.S. Appl. No. 11/749,292, filed May 16, 2007, Inaba, et al.
U.S. Appl. No. 11/500,352, filed Aug. 8, 2006, Toshine, et al.
U.S. Appl. No. 11/850,394, filed Sep. 5, 2007, Toshine, et al.
U.S. Appl. No. 11/855,510, filed Sep. 14, 2007, Kami, et al.
U.S. Appl. No. 11/852,708, filed Sep. 10, 2007, Tada, et al.
U.S. Appl. No. 11/853,490, filed Sep. 11, 2007, Miyamoto, et al.
U.S. Appl. No. 11/855,553, filed Sep. 14, 2007, Inaba, et al.

* cited by examiner

ELECTROPHOTOGRAPHIC PHOTORECEPTOR, AND IMAGE FORMING APPARATUS AND PROCESS CARTRIDGE THEREFOR USING THE ELECTROPHOTOGRAPHIC PHOTORECEPTOR

BACKGROUND OF THE INVENTION

1. Field of the Invention

The present invention relates to an electrophotographic photoreceptor, and to an image forming apparatus and a process cartridge therefor using the electrophotographic photoreceptor.

2. Discussion of the Background

Recently, information processing systems using electrophotographic methods have noticeably been developed. Particularly, laser printers and digital copiers converting information to digital signals and optically recording the information have remarkably been improved in their printing qualities and reliabilities. These laser printers and digital copiers rapidly prevailing are required to print at higher speed and downsize as well as to produce higher quality images. Further, demands for full-color laser printers and full-color digital copiers capable of printing full-color images are rapidly increasing. At least four toner images having different colors each other need to be overlapped to form a full-color image, and therefore the full-color laser printers and full-color digital copiers are more seriously required to print at higher speed and downsize.

In order to make the apparatus print at higher speed and downsize, electrophotographic photoreceptors used therein need to have higher sensitivities and smaller diameters. Particularly, since a tandem apparatus effectively used for producing full-color images at high speed includes at least four photoreceptors, the photoreceptors are highly required to have small diameters. However, a photoreceptor having a smaller diameter naturally has less durability and needs to be replaced earlier. Therefore, the photoreceptor needs to have higher durability as well.

In order to make the photoreceptor have higher durability, images produced thereby need to have stable quality, and particularly, production of images having background fouling needs to be prevented. The background fouling is an image defect of innumerable microscopic spots developed on the blank area. It is conceivable that the background fouling is caused by the following phenomenon. When a photoreceptor is charged, a charge having the reverse polarity, which is induced at the electroconductive substrate, locally leaks and is injected into the photosensitive layer and further to the surface of the photoreceptor, and which becomes easily developable.

Although the background fouling is not actualized when the photoreceptor is new, the photoreceptor fatigue (poorly-charged photoreceptor) due to repeated use or the increase of the electric field intensity due to abrasion of the photosensitive layer actualize the background fouling which is one of large factors determining a life of the photoreceptor.

In order to prevent the background fouling, it is essential to prevent a charge from being injected into the photosensitive layer from the electroconductive substrate. As conventional technologies therefor, an undercoat layer or an intermediate layer is formed therebetween is disclosed.

For example, Japanese Laid-Open Patent Publication No. 47-6341 discloses an intermediate layer formed of a cellulose resin; Japanese Laid-Open Patent Publication No. 60-66258 discloses an intermediate layer formed of a nylon resin; Japanese Laid-Open Patent Publication No. 52-10138 discloses an intermediate layer formed of a maleic acid resin; and Japanese Laid-Open Patent Publication No. 58-105155 discloses an intermediate layer formed of a polyvinylalcohol resin.

However, these intermediate layers including a resin alone has high electric resistivities, and therefore the residual potential increases, resulting in occasional deterioration of image density and image gradation in negative and positive images.

In order to control the electric resistivity of an intermediate layer, methods of dispersing an electroconductive additive are disclosed.

For example, Japanese Laid-Open Patent Publication No. 51-65942 discloses an intermediate layer wherein a carbon-containing or a chalcogen-containing material is dispersed in a hardening resin; Japanese Laid-Open Patent Publication No. 52-82238 discloses a heat-polymerized intermediate layer formed by using an isocyanate hardener including a quaternary ammonium salt; Japanese Laid-Open Patent Publication No. 55-113045 discloses a resin intermediate layer including a resistivity regulator; and Japanese Laid-Open Patent Publication No. 58-93062 discloses a resin intermediate layer including an organic metallic compound. However, these resin intermediate layers alone occasionally have problems of producing moire images due to light interference in recent image forming apparatus using coherent light such as a laser beam.

In order to prevent the moire images from being produced as well as to control the electric resistivity of an intermediate layer, photoreceptors having an intermediate layer including a filler are disclosed.

For example, Japanese Laid-Open Patent Publication No. 58-58556 discloses a resin intermediate layer wherein aluminum oxide or tin oxide is dispersed; Japanese Laid-Open Patent Publication No. 60-111255 discloses an intermediate layer wherein an electroconductive particulate material is dispersed; Japanese Laid-Open Patent Publication No. 59-17557 discloses an intermediate layer wherein magnetite is dispersed; Japanese Laid-Open Patent Publication No. 60-32054 discloses a resin intermediate layer wherein titanium oxide and tin oxide are dispersed; and Japanese Laid-Open Patent Publications Nos. 64-68762, 64-68763, 64-73352, 64-73353, 1-118848 and 1-118849 disclose resin intermediate layers wherein powders of borides such as calcium, magnesium and aluminum; nitrides; fluorides; and oxides are dispersed.

The more the filler, the better to reduce the residual potential. The less the filler, the better to reduce the background fouling. Therefore, it is very difficult to reduce both of the residual potential and background fouling.

In order to solve this problem, a multilayered intermediate layer is disclosed. The multilayered intermediate layer is broadly classified to two types. One includes a resin layer wherein a filler is dispersed on an electroconductive substrate and a resin layer not including a filler on the resin layer wherein a filler is dispersed (FIG. 1A), and the other includes a resin layer not including a filler on an electroconductive substrate and a resin layer wherein a filler is dispersed on the resin layer not including a filler (FIG. 1B).

The former multilayered intermediate layer includes an electroconductive resin layer wherein a low-resistivity filler on an electroconductive substrate to hide defects thereof, and the above-mentioned resin layer is formed on the electroconductive resin layer. These are disclosed in, e.g., Japanese Laid-Open Patent Publications Nos. 58-95351, 59-93453, 4-170552, 6-208238, 6-222600, 8-184979, 9-43886, 9-190005 and 9-288367.

On the other hand, the latter multilayered intermediate layer includes the resin layer on an electroconductive substrate, and a resin layer wherein a low-resistivity or an electron-conductive filler is dispersed on the resin layer. These are disclosed in, e.g., Japanese Laid-Open Patent Publications Nos. 5-80572 and 6-19174.

However, the prevention of the background fouling and residual potential of the multilayered intermediate layer is occasionally more dependent on an environment.

Methods of including a polyamide resin in an undercoat layer and N-alkoxy(methoxy)methylated nylon in an undercoat layer or an intermediate layer are disclosed. For example, Japanese Laid-Open Patent Publication No. 9-265202 discloses a method of including an alkoxy methylated copolymer nylon resin having an alkoxy methylation of from 5 to 30% in an undercoat layer; Japanese Laid-Open Patent Publication No. 2002-107984 discloses a method of including an inorganic pigment and a crosslinked N-alkoxy methylated polyamide resin as a binder resin in an intermediate layer; Japanese Patent No. 2718044 discloses a method of including a N-alkoxy methylated polyamide resin, wherein each of Na, Ca and P atoms which are impurities has an elemental concentration not greater than 10 ppm in an undercoat layer; Japanese Patent No. 3086965 discloses a method of including a N-alkoxy methylated polyamide copolymer mainly constituted of a λ-amino-n-lauric acid in an intermediate layer; and Japanese Patent No. 3226110 discloses a method of including a polyamide resin including a unit having a structure in an intermediate layer. However, it is ineffective to prevent moire images from being produced even when a filler is dispersed in the undercoat layer or intermediate layer, and even a filler-dispersed layer occasionally increases the residual potential.

Various heat-hardening resins have been used as a binder resin in an intermediate layer, and some of the resins use a large amount of air contaminant formaldehyde which is one of causative agents of the sick house syndrome. They need a formaldehyde recycle system to prevent the formaldehyde from being discharged to the atmosphere. Therefore, it is essential to select a resin not discharging the formaldehyde, and a block isocyanate compound is effectively used in terms of this point.

For example, Japanese Laid-Open Patent Publication No. 61-163346 discloses a method of forming an intermediate layer including a urethane resin formed of a block isocyanate compound and an electroconductive powder, and optionally a second resin layer not including an electroconductive powder thereon. However, only the optional resin layer prevents a charge from being injected into the photosensitive layer from the electroconductive substrate, and therefore it cannot be said that this fully prevents the background fouling. In addition, Japanese Laid-Open Patent Publication No. 2004-177552 discloses a method of including an isocyanate compound together with a high-purity metal oxide and an oil-free alkyd resin. It cannot be said that this fully prevents the background fouling, either. Further, Japanese Laid-Open Patent Publication No. 3-33857 discloses a method of including a titanylphthalocyanine pigment having a specific crystal form in a photosensitive layer and a block isocyanate compound in an intermediate layer. However, this does not fully achieve the high durability, either.

Only the higher abrasion resistance of a photoreceptor is not sufficient enough to decrease the charge injection from an electroconductive substrate because the charge injection is increased by the charge deterioration of a photoreceptor due to the fatigue thereof, although decreasing an influence of the electric field intensity as time passes. Therefore, in order to prevent the background fouling due to repeated use of a photoreceptor and realize the higher durability thereof, the charge injection from an electroconductive substrate needs to be prevented and the abrasion of a photoreceptor due to repeated use needs to be decreased.

Conventional technologies to improve the abrasion resistance of a photoreceptor include, e.g., (i) Japanese Laid-Open Patent Publication No. 56-48637 wherein a hardening binder is used in a crosslinked charge transport layer, (ii) Japanese Laid-Open Patent Publication No. 64-1728 wherein a charge transport polymer material is used, and (iii) Japanese Laid-Open Patent Publication No. 4-281461 wherein an inorganic filler is dispersed in a crosslinked charge transport layer, etc.

However, (i) tends to increase residual potential and deteriorate image density because of poor compatibility of the hardening binder with a charge transport material, and impurities such as a polymerization initiator and an unreacted residue.

(ii) does not fully satisfy the durability required for an organic photoreceptor. In addition, a high-purity charge transport polymer material is difficult to obtain because it is difficult to polymerize and refine the materials. Further, a coating liquid including the charge transport polymer material occasionally has a high viscosity, resulting in a problem of preparing a photoreceptor.

(iii) also tends to increase residual potential and deteriorate image density due to a charge trap present on the surface of the inorganic filler.

In order to improve the abrasion and damage resistance of (i), Japanese Patent No. 3262488 discloses a photoreceptor including a hardened acrylate monomer. However, a three-dimensional network is not fully developed and the crosslinking density is low in the photoreceptor because a monomer is reacted therein including a polymer binder, resulting in insufficient abrasion resistance thereof.

As an abrasion resistance technology of a photosensitive layer in place of these technologies, Japanese Patent No. 3194392 discloses a method of forming a charge transport layer using a coating liquid formed from a monomer having a carbon-carbon double bond, a charge transport material having a carbon-carbon double bond and a binder resin. The binder resin includes a binder resin having a carbon-carbon double bond and a reactivity with the charge transport material, and a binder resin having neither a carbon-carbon double bond nor a reactivity with the charge transport material.

However, a three-dimensional network is not fully developed, either and the crosslinking density is low in the photoreceptor, resulting in insufficient abrasion resistance thereof.

Japanese Laid-Open Patent Publication No. 2000-66425 discloses a photosensitive layer including a hardened positive hole transport compound having two or more chain polymerizing functional groups in the same molecule.

However, the photosensitive layer tends to have a surface crack or peel-off.

Because of these reasons, a need exists for a highly-durable photoreceptor producing images without background fouling.

SUMMARY OF THE INVENTION

Accordingly, one object of the present invention is to provide a highly durable and stable electrophotographic photoreceptor preventing production of images having background fouling and increase of residual potential.

Another object of the present invention is to provide an image forming apparatus using the electrophotographic photoreceptor.

A further object of the present invention is to provide a process cartridge using the electrophotographic photoreceptor.

These objects and other objects of the present invention, either individually or collectively, have been satisfied by the discovery of an electrophotographic photoreceptor, comprising an electroconductive substrate; a first undercoat layer including no metal oxide, located overlying the electroconductive substrate; a second undercoat layer including a metal oxide and a binder resin, located overlying the first undercoat layer; and a photosensitive layer located overlying the second undercoat layer, wherein the second undercoat layer comprises a metal oxide having a specific resistivity not less than $10^7$ Ω·cm and a block isocyanate compound.

In addition, the photosensitive layer preferably comprises a charge generation layer; and a charge transport layer located overlying the charge generation layer.

Further, the metal oxide is preferably titanium oxide.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a highly durable and stable electrophotographic photoreceptor stably producing high-quality images for long periods.

Figure 1A:
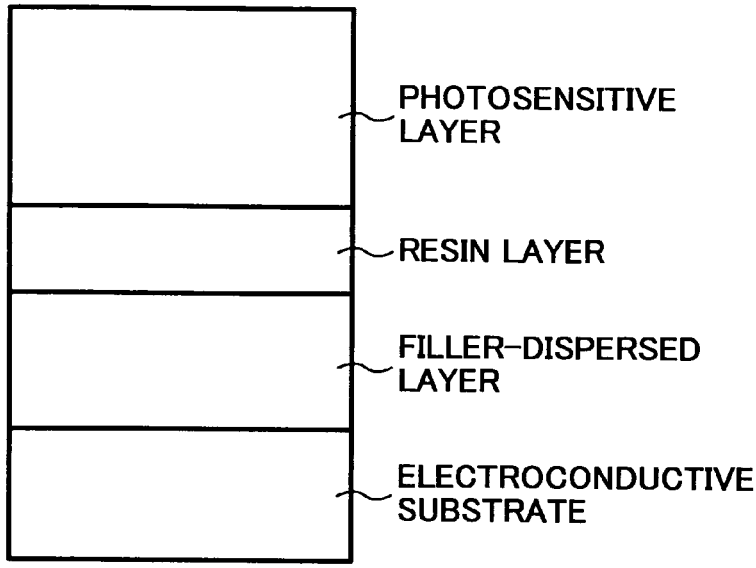
FIGS. 1A and 1B are cross-sectional views of embodiments of coated layers of the electrophotographic photoreceptor of the present invention.
Figure 1B:
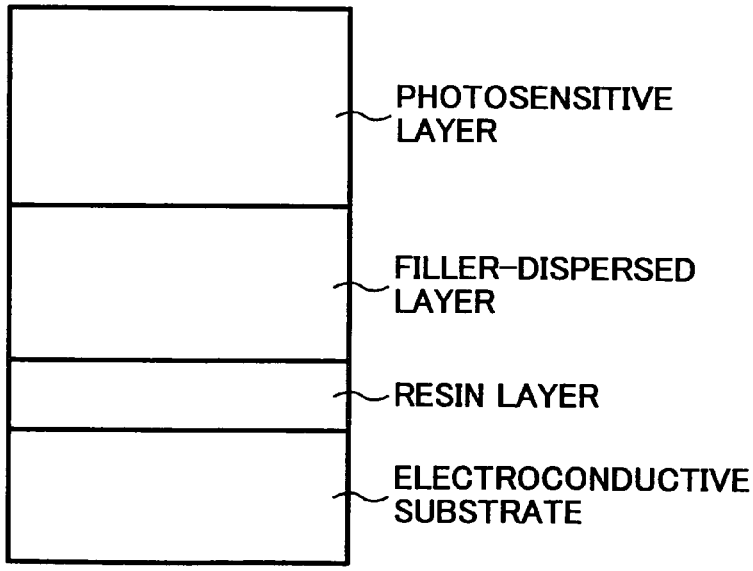
Figure 2A:
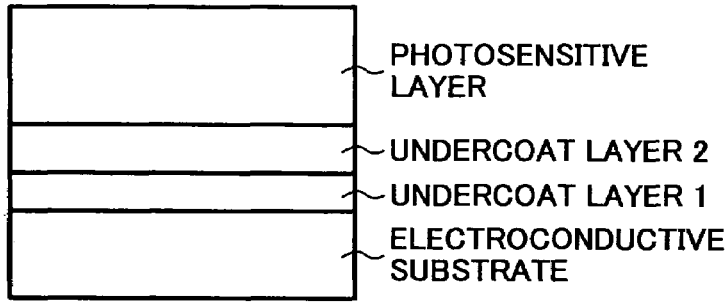
FIGS. 2A and 2B are cross-sectional views of other embodiments of coated layers of the electrophotographic photoreceptor of the present invention.

FIG. 2A is a cross-sectional view of an embodiment of coated layers of the electrophotographic photoreceptor of the present invention, wherein an undercoat layer including no metal oxide, an undercoat layer including a metal oxide and a photosensitive layer are layered in this order on an electroconductive substrate.

Figure 2B:
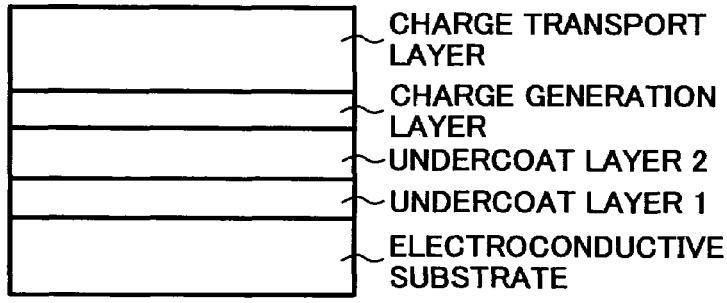

FIG. 2B is a cross-sectional view of an embodiment of coated layers of the electrophotographic photoreceptor of the present invention, wherein an undercoat layer including no metal oxide, an undercoat layer including a metal oxide, a charge generation layer mainly including a charge generation material and a charge transport layer mainly including a charge transport material are layered in this order on an electroconductive substrate.

Figure 2C:
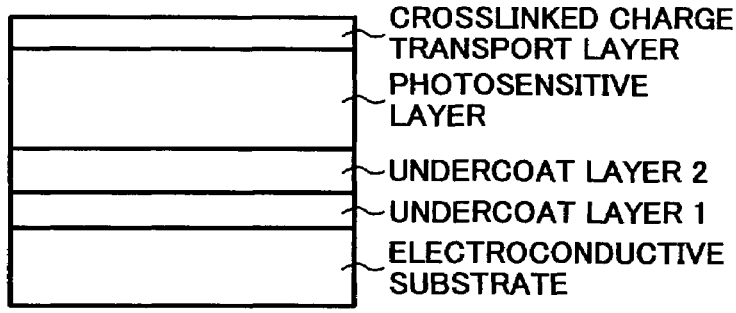

FIG. 2C is a cross-sectional view of an embodiment of coated layers of the electrophotographic photoreceptor of the present invention, wherein an undercoat layer including no metal oxide, an undercoat layer including a metal oxide, a photosensitive layer and a crosslinked charge transport layer wherein a radical polymerizing monomer having no transporting structure and three or more functional groups and a monofunctional radical polymerizing compound having a charge transport structure are hardened are layered in this order on an electroconductive substrate.

Figure 2D:
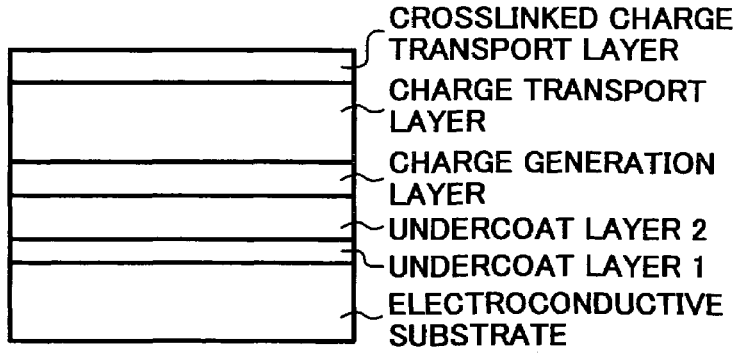

FIG. 2D is a cross-sectional view of an embodiment of coated layers of the electrophotographic photoreceptor of the present invention, wherein an undercoat layer including no metal oxide, an undercoat layer including a metal oxide, a charge generation layer mainly including a charge generation material, a charge transport layer mainly including a charge transport material and a crosslinked charge transport layer wherein a radical polymerizing monomer having no transporting structure and three or more functional groups and a monofunctional radical polymerizing compound having a charge transport structure are hardened are layered in this order on an electroconductive substrate.

Suitable materials for use as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum or a metal oxide such as tin oxides, indium oxides is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate.

Specific examples of such an electroconductive powder include carbon black, acetylene black, powders of metals such as aluminum, nickel, iron, Nichrome, copper, zinc, silver, and metal oxides such as electroconductive tin oxides, ITO. Specific examples of the binder resin include known thermoplastic resins, thermosetting resins and photocrosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins. Such an electroconductive layer can be formed by coating a coating liquid in which an electroconductive powder and a binder resin are dispersed in a solvent such as tetrahydrofuran, dichloromethane, methyl ethyl ketone, toluene, etc., and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be preferably used as the substrate.

Next, the undercoat layer will be explained. The undercoat layer of the present invention includes a layer including no metal oxide and a layer including a metal oxide. The undercoat layer is formed for various purposes such as preventing injection of a charge having a reverse polarity into the photosensitive layer, preventing moire, hiding a defect of the substrate and increasing adhesiveness of the photosensitive layer thereto. When the undercoat layer is an ordinary single layer, the residual potential tends to increase when the charge injection from the electroconductive substrate is prevented, and the background fouling deteriorates when the residual potential is decreased. The plural functionally-separated undercoat layers noticeably improves the prevention of the background fouling without largely affecting the residual potential.

First, the undercoat layer including no metal oxide mainly for preventing the charge injection from the electroconductive substrate will be explained. Specific examples of the layer preventing the charge injection include an anodic oxide coating such as an aluminum layer, an inorganic insulative layer such as Sio, a glassy network layer of a metal oxide disclosed in Japanese Laid-Open Patent Publication No. 3-191361, a polyphosphazen layer disclosed in Japanese Laid-Open Patent Publication No. 3-141363, a layer including an aminosilane reaction product disclosed in Japanese Laid-Open Patent Publication No. 3-101737, a layer including an insulative or hardening binder resin, etc. Further, when the undercoat layer including a metal oxide, the photosensitive layer or the other layers are formed thereon by wet coating methods, the undercoat layer needs to be insoluble in a coating solvent and formed of a material or a composition uninvadable therewith.

In the present invention, a resin for use in the undercoat layer including no metal oxide includes known resins, and particularly an insulative binder resin preferably having a specific resistivity not less than $10^{13}$ Ω·cm is preferably used to prevent the charge injection. Specific examples of the binder resin include thermoplastic resins such as polyamide, polyester and vinylchloride-vinylacetate copolymers; and heat-hardening resins such as a resin wherein a compound including plural active hydrogen atoms such as hydrogen atoms of —OH groups, —$NH_2$ groups and —NH groups, a compound including plural isocyanate groups and/or a compound including plural epoxy groups are polymerized with heat.

Specific examples of the compound including plural active hydrogen atoms include polyvinylbutyral, a phenoxy resin, a phenol resin, polyamide, polyester, polyethylene glycol, polypropylene glycol, polybutylene glycol, acrylic resins including an active hydrogen atom such as a hydroxyethylmethacrylate group, etc. Specific examples of the compound including plural isocyanate groups include tolylenediisocyanate, hexamethylenediisocyanate, diphenylmethanediisocyanate, their prepolymers, etc. Specific examples of the compound including plural epoxy groups include bisphenol A-type epoxy resins, etc. In addition, heat-hardened resins formed by polymerizing oil-free alkyd resins and amino resins or butylated melamine resins, etc. with heat; and light-hardened resins formed by combining resins having an unsaturated bond such as a polyurethane resin having an unsaturated bond and an unsaturated polyester resin, and photopolymerization initiators such as thioxanthone compounds and methylbenzyl formate.

Among these resins, polyamide resins are preferably used, and among them, N-methoxymethylated nylon is most preferably used. The polyamide resin effectively prevents the charge injection and less affects the residual potential. The polyamide resin is soluble in alcohol and insoluble in ketone solvents, and has good coatability to form a uniform thin coating. The undercoat layer needs to be thin and uniform, and the coatability is important for stability of the image quality.

However, the typical alcohol-soluble polyamide resins largely depend on humidity. They have high resistance in an environment of low humidity, resulting in increase of the residual potential, low resistance in that of high humidity, resulting in deterioration of the chargeability. The N-methoxymethylated nylon much less depends on the environment, and is most preferably used because of constant stability of the image quality even when an image forming apparatus is used in a different environment. Further, the residual potential is not so dependent on the thickness of the undercoat layer including the N-methoxymethylated nylon, and which prevents the background fouling.

The substitutional rate of an alkoxymethyl group in the N-methoxymethylated nylon is not particularly limited, but preferably not less than 15 mol %. When less than 15 mol %, the dependency thereof on humidity increases, becomes cloudy when solved in alcohol and the quality of a coating liquid including the N-methoxymethylated nylon slightly deteriorates.

In the present invention, the N-methoxymethylated nylon can be used alone, and various hardeners and acidic catalysts can optionally be added. Specific examples of the hardeners include crosslinkers such as a known melamine resin and general materials such as a block isocyanate resin. Specific examples of the acidic catalysts include general catalysts such as a tartaric acid. However, since the acidic catalyst occasionally deteriorates the insulation of the undercoat layer and prevention of the background fouling, the acidic catalyst needs to be included in quite a small amount. The acidic catalyst is preferably included in an amount not greater than 5%, and more preferably not greater than 2% by weight based on total weight of the resin. Other binder resins can optionally be mixed therewith. Specific examples thereof include a polyamide resin soluble in alcohol, and which increases stability of a coating liquid.

In addition, an electroconductive polymer material, an accepting resin or low-molecular-weight compound according to the charged polarity and other various additives can also be added to reduce the residual potential. However, these need to be added in a minimum quantity because of occasionally solving out when an upper layer is layered thereon by a dip coating method.

Typical organic solvents dissolving the resin can be used for a coating solvent, and alcohol solvents such as methanol, ethanol, propanol and butanol or their mixtures can be used for the polyamide resins soluble therein.

The coating solvent is coated by known methods such as a dip coating method, a spray coating method, a ring coat method, a bead coat method and a nozzle coat method. After coated, the coating solvent is heated and dried to form the undercoat layer, and is optionally heated or irradiated to harden.

The undercoat layer preferably has a thickness of from 0.1 to 2.0 μm, and more preferably from 0.3 to 1.0 μm. When thicker than 2.0 μm, the residual potential and the dependency on the environment tend to increase. When thinner than 0.1 μm, the background fouling is less prevented.

Next, the undercoat layer including a metal oxide will be explained. The undercoat layer including a metal oxide mainly prevents the moire, the charge injection from an electroconductive substrate, increase of the residual potential due to fatigue, and increases adhesiveness to the photosensitive layer.

The moire is one of defective images on which an interference pattern is formed due to light interference in the photosensitive layer when writing with coherent light like a laser beam. The undercoat layer needs to include a material having a large refractive index because of scattering an incoming laser beam to prevent the moire. In order to prevent the moire, the undercoat layer most effectively has a composition wherein a metal oxide is dispersed in a binder resin. Specific examples of the metal oxide include white pigments such as titanium oxide, calcium fluoride, zinc oxide, calcium oxide, silicon oxide, magnesium oxide, aluminum oxide and tin oxide. Electroconductive metal oxides effectively reduce the residual potential, but apparently deteriorate prevention of the background fouling. In the present invention, the electroconductive metal oxides are not preferably used, and the metal oxides need to have a specific resistivity not less than $10^7$ Ω·cm. Particularly, titanium oxide is most preferably used in terms of reducing the residual potential and preventing the background fouling. Some of the titanium oxide are electroconductivity or surface-treated, and in the present invention, the titanium oxide needs to have a specific resistivity not less than $10^7$ Ω·cm.

In the present invention, an undercoat layer including a metal oxide or a mixture thereof is formed on an undercoat layer including no metal oxide, and further the metal oxide or the mixture thereof has a specific resistivity not less than $10^7$ Ω·cm, and preferably not greater than a specific resistivity of the binder resin to prevent the background fouling and reduce the residual potential.

The specific resistivity is measured by a resistance measurer for powder. A metal oxide in a cell is sandwiched with electrodes, loaded to have a thickness of about 2 mm, and then a voltage is applied between the electrodes to measure a current between the electrodes. The contact area of the electrodes is about 2.6 $cm^2$, and the load is 1 kg and a current 60 seconds after the voltage is applied therebetween is measured.

The metal oxide for use in the present invention preferably has a high purity to reduce the residual potential. The metal oxide preferably has a purity not less than 99.0%, and more preferably not less than 99.4%. Particularly, impurities included in titanium oxide are mainly hygroscopic and ionic materials such as $Na_2O$ and $K_2O$, and when the purity is lower than 99.4%, the dependency on the environment becomes large. In addition, in an environment of high humidity, the background fouling possibly increases. The purity of the metal oxide can be measured by a method specified in JIS K5116.

The metal oxide for use in the present invention preferably has an average primary particle diameter of from 0.01 to 0.8 μm, and more preferably from 0.05 to 0.5 μm. When only the metal oxide having an average primary particle diameter not greater than 0.1 μm is used, the background fouling is effectively prevented, but the prevention of the moire tends to deteriorate. When only the metal oxide having an average primary particle diameter greater than 0.4 μm is used, the moire is effectively prevented, but the prevention of the background fouling tends to slightly deteriorate. In such a case, metal oxides having different primary particle diameters are effectively mixed to reduce the residual potential as well as the background fouling and the moire.

When two or more metal oxides having different primary particle diameters are mixed, the following relationship is preferably satisfied:

$$0.2<(D2/D1)\leqq 0.5$$

wherein D1 is an average primary particle diameter of a metal oxide having the largest average primary particle diameter and D2 is an average primary particle diameter of a metal oxide having the smallest average primary particle diameter. D2 is preferably less than 0.2 μm because of fully preventing the background fouling.

In addition, a mixing ratio of the two or more metal oxides having different primary particle diameters preferably satisfy the following relationship:

$$0.2\leqq T2/(T1+T2)\leqq 0.8$$

wherein T1 is a content of a metal oxide having the largest average primary particle diameter and T2 is a content of a metal oxide having the smallest average primary particle diameter. When less than 0.2, the prevention of the background fouling possibly deteriorates. When greater than 0.8, the prevention of the moire possibly deteriorates.

Heat-hardening resins are used as a binder resin for use in the undercoat layer including a metal oxide. A block isocyanate compound is mixed therein as a main resin and a hardener, and a blocker separates therefrom when heated to harden the undercoat layer. When the undercoat layer is hardened with heat, solving out thereof in a solvent included in a photosensitive layer coating liquid coated thereon can be prevented, and the stability of the layers and coating liquids can be maintained.

In the present invention, a block isocyanate compound is used as a hardener. The block isocyanate compound is a product from an addition reaction between a diisocyanate or polyisocyanate compound and an isocyanate blocker. The isocyanate group is masked with the blocker, and which prevents the coating liquid from gelating and thickening. In the present invention, in order to maintain the stability of the coating liquid and coating quality, a block isocyanate compound wherein isocyanate group is masked with the blocker needs to be used. Specific examples of the blocker include phenols such as phenol, cresol and xynol; active methylene compounds such as acetoacetic ester and allonic acid diethyl ester; oximes such as ε-caprolactam, aceto oxime and cyclohexanone oxime; and tertiary alcohols such as tertiarybutyl alcohol. Specific examples of the diisocyanate or polyisocyanate compound include isophoronediisocyanate, hexamethylene diisocyanate, tolylenediisocyanate, xylylenediisocyanate, diphenylmethanediisocyanate and polyphenylmethanepolyisocyanate. Specific examples of the block isocyanate compound include IPDI-B1065 and IPDI-B1530 which are brand names of isophoronediisocyanate using ε-caprolactam as a blocker from Degussa-Huls AG and IPDI-BF1540 which is a brand name of inner blocked urethodione bonding type block isophoronediisocyanate from Degussa-Huls AG, and oxime-blocked 2,4-trilenediisocyanate, 2,6-trilenediisocyanate, diphenylmethane-4,4'-diisocyanate, hexamethylene diisocyanate, etc. Specific examples of the oxime include formaldehyde oxime, acetoaldo oxime, methyl ethyl ketone oxime and cyclohexanone oxime. Specific examples of the oxime-blocked blocked isocyanate include DM-60 and DM-160 which are brand names from Meisei Chemical Works, Ltd. and Burnock B7-887-60, B3-867 and DB980K from Dainippon Ink And Chemicals, Inc.

The block isocyanate compound is effectively used to largely increase the dispersibility of the metal oxide as well as to improve the solvent resistance and prevent the generation of formaldehyde. In the undercoat layer including a metal oxide, a charge tends to leak from the electroconductive substrate to a part where the metal oxide agglutinates, and the background fouling tends to occur. When the dispersibility of the metal oxide increases, the aggregation thereof and the leakage of a charge can be prevented to prevent the background fouling. Further, in combination with the undercoat layer including no metal oxide, the prevention of the background fouling is largely improved. In addition, when the block isocyanate compound is used as a hardener, an irradiated part potential decreases and the temporal stability increases.

On the other hand, the main resin having plural active hydrogen atoms (hydrogen atoms of —OH group, —$NH_2$ group, —NH group, etc.) and hardening with the block isocyanate compound is effectively used, and particularly an alkyd resin is preferably used. The alkyd resin less affects the residual potential, effectively prevents the background fouling, and maintains the dispersibility of the metal oxide when mixed with the block isocyanate compound.

The main resin preferably has a hydroxyl value not less than 60. When less than 60, the hardening is not sufficiently performed because of having less reactive site with the isocyanate, resulting in deterioration of the layer formability, adherence between a photosensitive layer and an electroconductive substrate, and increase of the residual potential. When greater than 150, a moisture resistance of the resultant photoreceptor deteriorates because an unreacted functional group remains, resulting in extreme increase of the residual potential and deterioration of photosensitivity thereof in an environment of high humidity. The hydroxyl value is determined by a method specified in JIS K 0070.

The alkyd resin is a saturated polyester resin formed of a polybasic acid and a polyalcohol, and has a direct chain structure bonded with an ester bonding without a fatty acid and many different types thereof.

Specific examples of the alkyd resin for use in the present invention Bekkolite M-6401-50, M-6402-50, M-6003-60, M-6005-60, 46-118, 46-119, 52-584, M-6154-50, M-6301-45, 55-530, 54-707, 46-169-S, M-6201-40-1M, M-6205-50, 54-409 which are brand names of oil-free alkyd resins from Dainippon Ink And Chemicals, Inc.; and Espel 103, 110, 124 and 135 which are brand names of oil-free alkyd resins from Hitachi Chemical Co., Ltd.

The main resin and hardener, i.e. block isocyanate compound are preferably mixed such that the number of moles of hydroxyl groups present in the main resin equals to that of isocyanate groups of the block isocyanate compound. When the excessive isocyanate group remains unreacted, the residual potential possibly increases. In addition, when the main resin and the block isocyanate compound are not mixed in a proper mixing ratio, the volume contraction when hardened with heat is considered to be large, resulting in coating defects such as a crack. Since the coating defect of the undercoat layer causes the leakage of a charge and directly leads to increase of the background fouling, the coating quality thereof needs to be maintained well. In the present invention, the undercoat layer including a metal oxide preferably includes an alkyd resin and a block isocyanate compound at a ratio (alkyd resin/block isocyanate compound) of from 1/1 to 4/1 by weight, and which prevents the coating defect and reduce influence of increase of the residual potential.

A content ratio of the metal oxide and that of the binder resin affect the background fouling and residual potential. When the content ratio of the metal oxide to that of the binder resin is high, the residual potential decreases and the background fouling increases. When low, the background fouling decreases and the residual potential increases. The metal oxide and the binder resin preferably have a volume ratio (metal oxide/binder resin) of from 1/1 to 3/1. When less than 1/1, not only the moire prevention deteriorates, but also the residual potential possibly increases due to repeated use. When greater than 3/1, not only the binding capability of the binder resin deteriorates, but also the coating surfaceness deteriorates, and which occasionally exerts a bad influence upon formation of the upper layer. When a photosensitive layer is a multilayer and the upper layer is a charge generation layer which is thin, the charge generation layer has a nonuniform thickness causing a local charge deterioration, resulting in possible deterioration of prevention of the background fouling. Further, when greater than 3/1, the surface of the metal oxide is less covered with the binder resin and directly contacts a charge generation material, resulting in occasional worsening of the background fouling.

The thickness of the undercoat layer including a metal oxide depends on that of the undercoat layer including no metal oxide, and is preferably from 1 to 10 μm, and more preferably from 2 to 7 μm when the metal oxide is a titanium oxide. When less than 1 μm, the prevention of the moire occasionally deteriorates and the chargeability occasionally deteriorates. When thicker than necessary, the residual potential possibly increases. In the present invention, the undercoat layer including a metal oxide preferably has a thickness thicker than that of the undercoat layer including no metal oxide, which can prevent the deterioration of the chargeability due to fatigue and effectively prevents the background fouling.

The metal oxide and binder resin are dispersed in a solvent by known dispersers such as a ball mill, a sand mill and an attritor to prepare the undercoat layer coating liquid. The binder resin may be added thereto as a resin solution before or after dispersed. In addition, agents, solvents, additives, hardening accelerators, etc., which are required for hardening (crosslinking) can optionally be added thereto. The coating liquid is coated on an electroconductive substrate by known methods such as a dip coating method, a spray coating method, a ring coating method, a bead coating method and a nozzle coating method to form the undercoat layer. After coated, the coating liquid is heated, dried and optionally hardened with light irradiation.

In the present invention, the undercoat layer has a functionally-separated double layer structure. Further, an undercoat layer including a metal oxide is formed on an undercoat layer including no metal oxide.

When the undercoat layer including no metal oxide is formed on the undercoat layer including a metal oxide, the residual potential quickly increases. Therefore, an electroconductive metal oxide is used therein, resulting in deterioration of prevention of the background fouling. On the contrary, the metal oxide included in the undercoat layer including a metal oxide formed on the undercoat layer including no metal oxide need not be an electroconductive metal oxide and less affects the residual potential, and therefore the prevention of the background fouling is largely improved. In addition, the charge deterioration and late charge can be prevented. Further, the undercoat layer including no metal oxide needs to be thin to reduce the residual potential, and is preferably formed on a smooth electroconductive substrate rather than the undercoat layer including a metal oxide having a large surface roughness such that the resultant photoreceptor uniformly prevents the background fouling in whole.

In addition, an insulative resin coating is preferably formed on the electroconductive substrate to hide a defect thereof and maintain the adhesiveness of a photosensitive layer.

Next, the photosensitive layer will be explained.

The photosensitive layer may be a single layer including a charge generation material and a charge transport material, however, as mentioned above, is preferably a multilayer including a charge generation layer and charge transport layer to have good sensitivity, durability and prevention of the background fouling in the present invention.

The charge generation layer (CGL) is mainly formed of a charge generation material (CGM). Suitable CGMs include inorganic materials and organic materials. Specific examples of the inorganic CGMs include crystalline selenium, amorphous selenium, selenium-tellurium alloys, selenium-tellurium-halogen alloys, selenium-arsenic alloys, amorphous silicon, etc. The amorphous silicon includes a dangling bond terminated with a hydrogen atom or a halogen atom, a doped boron atom, a doped phosphorus atom, etc.

Specific examples of the organic CGMs include known materials such as a disazo pigment; an asymmetric disazo pigment; a trisazo pigment; azo pigments such as an azo pigment having a carbazole skeleton (disclosed in Japanese Laid-Open Patent Publication No. 53-95033), an azo pigment having a distyrylbenzene skeleton (disclosed in Japanese Laid-Open Patent Publication No. 53-133445), an azo pigment having a triphenylamine skeleton (disclosed in Japanese Laid-Open Patent Publication No. 53-132347), an azo pigment having a diphenylamine skeleton, an azo pigment having a dibenzothiophene skeleton (disclosed in Japanese Laid-Open Patent Publication No. 54-21728), an azo pigment having a fluorenone skeleton (disclosed in Japanese Laid-Open Patent Publication No. 54-22834), an azo pigment having an oxadiazole skeleton (disclosed in Japanese Laid-Open Patent Publication No. 54-12742), an azo pigment having a bisstilbene skeleton (disclosed in Japanese Laid-Open Patent Publication No. 54-17733), an azo pigment having a distyryloxadiazole skeleton (disclosed in Japanese Laid-Open Patent Publication No. 54-2129) and an azo pigment having a distyrylcarbazole skeleton (disclosed in Japanese Laid-Open Patent Publication No. 54-14967); an azulenium pigment; a squaric acid methine pigment; perylene pigments; anthraquinone or polycyclic quinone pigments; quinoneimine pigments; diphenyl and triphenyl methane pigments; benzoquinone and naphthoquinone pigments; cyanine and azomethine pigments; indigoid pigments; bisbenzimidazole pigments; and phthalocyanine pigments such as metallophthalocyanine and metal-free phthalocyanine having the following formula (N):

(N)

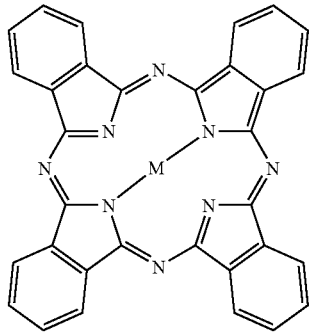

wherein M (central metal) represents a metal or a metal-free (hydrogen) element.

Specific examples of the central metal include, but are not limited to, elementary substances such as H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Ot, Au, Hg, TI, La, Ce, Pr, Nd, Pm, Sm, Eu, Gd, Tb, Dy, Ho, Er, Tm, Yb, Lu, Th, Pa, U, Np and Am; and combinations of oxides, chloride, fluorinates, hydroxides, bromides, etc.

The CGM having a phthalocyanine skeleton in the present invention may have at least a basic skeleton having the formula (N), and may have a multimeric structure such as a dimeric or a trimeric structure. In addition, the basic skeleton may have various substituents. Among the phthalocyanines, oxotitaniumphthalocyanine having TiO as a central metal, metal-free phthalocyanine and chlorogalliumphthalocyanine, etc. are preferably used.

The phthalocyanines are known to have various crystal forms, e.g., the oxotitaniumphthalocyanine has α, β, γ, m and Y types and copper phthalocyanine has α, β and γ types. Even the phthalocyanines having the same central metal vary in properties when having different crystal forms. In addition, it is said that photoreceptors using phthalocyanines having different crystal forms vary in properties as well. Therefore, it is important to select the crystal forms of the phthalocyanines, and the Y-type oxotitaniumphthalocyanine is effectively used for higher sensitivity of the resultant photoreceptor. The CGMs can be used alone or in combination.

Specific examples of the binder resins optionally used in the CGL include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The CGL preferably includes the binder resin in an amount of from 0 to 500 parts by weight, and more preferably from 10 to 300 parts by weight per 100 parts by weight of the CGM. In addition, the CGL can optionally include various additives such as leveling agents such as dimethylsilicone oil and methylphenylsilicone oil; a sensitizer; and a dispersant.

Suitable solvents for use in the coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. These can be used alone or in combination. A coating liquid for forming the CGL mainly includes a CGM, a solvent and a binder resin, and may include known additives such as a sensitizer, a dispersant, a surfactant and silicone oil.

The CGL can be formed by dispersing a CGM and optionally a binder resin in a proper solvent in a ball mill, an attritor, a sand mill or a supersonic disperser to prepare a coating liquid, coating the coating liquid on an electroconductive substrate, and then drying the coating liquid. The binder resin may be added thereto before or after dispersed.

The coating liquid can be coated by methods such as a dip coating method, a spray coating method, a bead coating method, a nozzle coating method, a spinner coating method and a ring coating method. The CGL preferably has a thickness of from 0.01 to 5 μm, and more preferably from 0.05 to 2 μm.

The charge transport layer (CTL) can be formed by dissolving or dispersing a charge transport material (CTM) and a binder resin in a proper solvent to prepare a coating liquid, coating the coating liquid on the CGL, and drying the coated liquid. Additives such as a plasticizer, a leveling agent and an antioxidant may optionally be included in the CTL.

The CTM includes a positive-hole transport material and an electron transport material.

Specific examples of the electron transport material include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives, etc.

Specific examples of the positive-hole transport material include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These CTMs can be used alone or in combination.

Specific examples of the binder resin include thermoplastic resins or thermosetting resins such as polystyrene, a styrene-acrylonitrile copolymer, a styrene-butadiene copolymer, a styrene-maleic anhydride copolymer, polyester, polyvinyl chloride, a vinylchloride-vinylacetate copolymer, polyvinyl acetate, polyvinylidene chloride, polyarylate, a phenoxy resin, polycarbonate, a cellulose acetate resin, an ethyl cellulose resin, a polyvinyl butyral resin, a polyvinyl formal resin, polyvinyl toluene, poly-N-vinyl carbazole, an acrylic resin, a silicone resins, an epoxy resin, a melamine resin, a urethane resin, a phenolic resin and an alkyd resin.

In addition, the CTL preferably includes a polymer CTM, which has both a binder resin function and a charge transport function, because the resultant CTL has good abrasion resistance. Suitable charge transport polymer materials include known polymer CTMs. Among these materials, polycarbonate resins having a triarylamine structure in their main chain and/or side chain are preferably used. In particular, polymer CTMs having the following formulae (I) to (X) are preferably used:

(I)

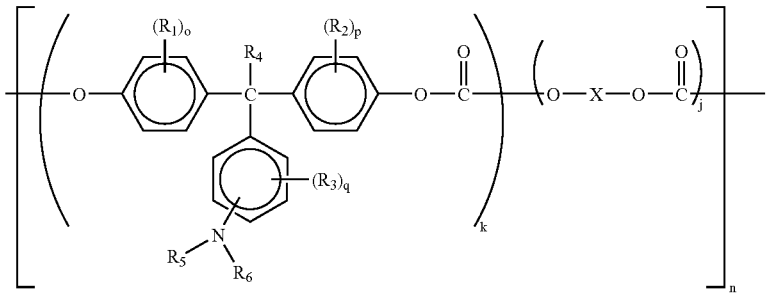

wherein, $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; o, p and q independently represent 0 or an integer of from 1 to 4; k is a number of from 0.1 to 1.0 and j is a number of from 0 to 0.9; n represents a repeating number and is an integer of from 5 to 5000; and X represents a divalent aliphatic group, a divalent alicyclic group or a divalent group having the following formula:

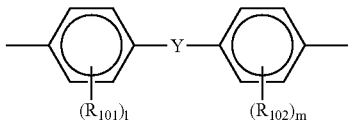

wherein, $R_{101}$ and $R_{102}$ independently represent a substituted or unsubstituted alkyl group, an aromatic ring group or a halogen atom; 1 and m represent 0 or an integer of from 1 to 4; and Y represents a direct bonding, a linear alkylene group, a branched alkylene group, a cyclic alkylene group, —O—, —S—, —SO—, —SO2-, —CO—, —CO—O-Z-O—CO— (Z represents a divalent aliphatic group), or a group having the following formula:

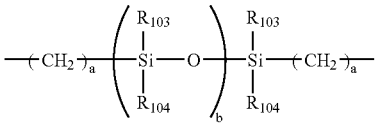

wherein, a is an integer of from 1 to 20; b is an integer of from 1 to 2000; and $R_{103}$ and $R_{104}$ independently represent a substituted or unsubstituted alkyl group, or a substituted or unsubstituted aryl group, and wherein $R_{101}$, $R_{102}$, $R_{103}$ and $R_{104}$ may be the same or different from the others; and the two copolymers in the formula (I) may be random copolymers;

(II)

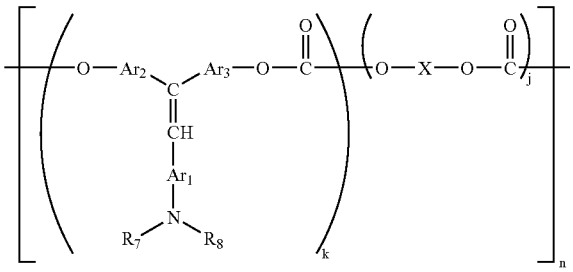

wherein, $R_7$ and $R_8$ represent a substituted or unsubstituted aryl group; $Ar_1$, $Ar_2$ and $Ar_3$ independently represent an arylene group; and X, k, j and n are same in the formula (I); and the two copolymers in the formula (II) may be random copolymers;

(III)

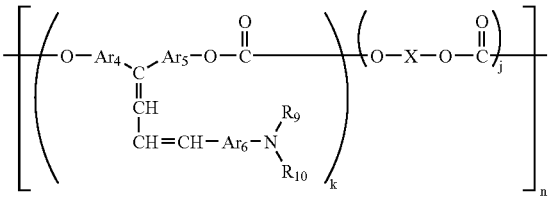

wherein, $R_9$ and $R_{10}$ represent a substituted or unsubstituted aryl group; $Ar_4$, $Ar_5$ and $Ar_6$ independently represent an arylene group; and X, k, j and n are same in formula (I); and the two copolymers in the formula (III) may be random copolymers;

(IV)

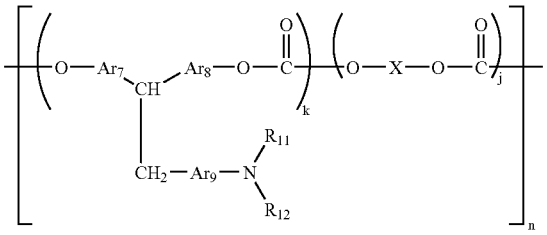

wherein, $R_{11}$ and $R_{12}$ represent a substituted or unsubstituted aryl group; $Ar_7$, $Ar_8$ and $Ar_9$ independently represent an arylene group; p is an integer of from 1 to 5; and X, k, j and n are same in formula (I); and the two copolymers in the formula (IV) may be random copolymers;

(V)

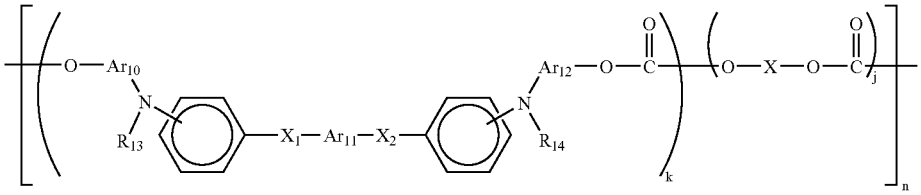

wherein, $R_{13}$ and $R_{14}$ represent a substituted or unsubstituted aryl group; $Ar_{10}$, $Ar_{11}$ and $Ar_{12}$ independently represent an arylene group; $X_1$ and $X_2$ represent a substituted or unsubstituted ethylene group, or a substituted or unsubstituted vinylene group; and X, k, j and n are same in formula (I); and the two copolymers in the formula (V) may be random copolymers;

(VI)

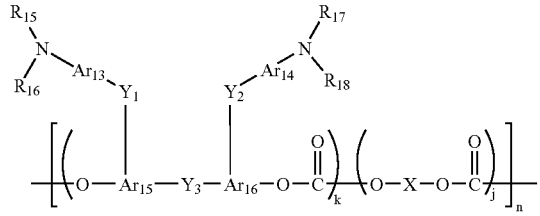

wherein, $R_{15}$, $R_{16}$, $R_{17}$ and $R_{18}$ represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a direct bonding, a substituted or unsubstituted alkylene group, a substituted or unsubstituted cycloalkylene group, a substituted or unsubstituted alkylene ether group, an oxygen atom, a sulfur atom, or a vinylene group; and X, k, j and n are same in formula (I); and the two copolymers in the formula (VI) may be random copolymers;

(VII)

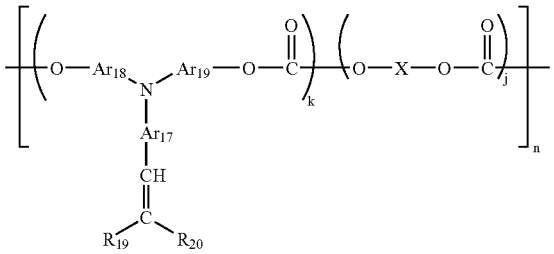

wherein, $R_{19}$ and $R_{20}$ represent a hydrogen atom, or substituted or unsubstituted aryl group, and $R_{19}$ and $R_{20}$ may form a ring; $Ar_{17}$, $Ar_{18}$ and $Ar_{19}$ independently represent an arylene group; and X, k, j and n are same in formula (I); and the two copolymers in the formula (VII) may be random copolymers;

(VIII)

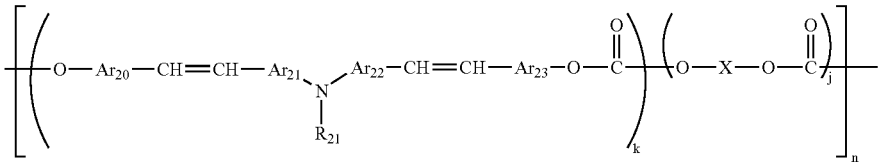

wherein, $R_{21}$ represents a substituted or unsubstituted aryl group; $Ar_{20}$, $Ar_{21}$, $Ar_{22}$ and $Ar_{23}$ independently represent an arylene group; and X, k, j and n are same in formula (I); and the two copolymers in the formula (VIII) may be random copolymers;

(IX)

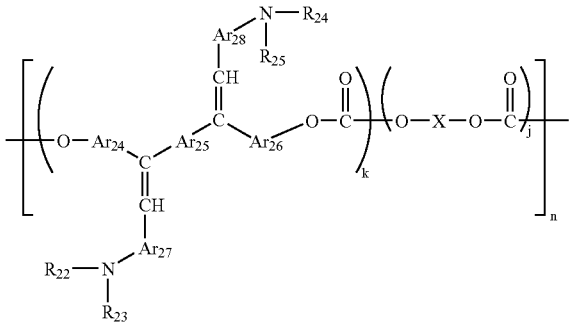

wherein, $R_{22}$, $R_{23}$, $R_{24}$ and $R_{25}$ represent a substituted or unsubstituted aryl group; $Ar_{24}$, $Ar_{25}$, $Ar_{26}$, $Ar_{27}$ and $Ar_{28}$ independently represent an arylene group; and X, k, j and n are same in formula (I); and the two copolymers in the formula (IX) may be random copolymers;

(X)

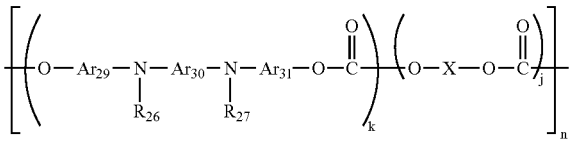

wherein, $R_{26}$ and $R_{27}$ independently represent a substituted or unsubstituted aryl group; $Ar_{29}$, $Ar_{30}$ and $Ar_{31}$ independently represent an arylene group; and X, k, j and n are same in formula (I); and the two copolymers in the formula (X) may be random copolymers.

The CTL preferably includes a CTM in an amount of from 20 to 300 parts by weight, and more preferably from 40 to 150 parts by weight per 100 parts by weight of the binder resin. The CTL preferably has a thickness of from 5 to 100 μm, and more preferably from 10 to 40 μm.

Suitable solvents for use in the coating liquid include tetrahydrofuran, dioxane, toluene, dichloromethane, monochlorobenzene, dichloroethane, cyclohexanone, methyl ethyl ketone, acetone and the like solvents. Particularly, a non-halide solvent is preferably used for the purpose of lessening the burden on the environment, and preventing the background fouling. Specific examples of the solvent include tetrahydrofuran, dioxolane, cyclic ethers such as dioxane, toluene, aromatic carbon hydrides such as xylene and their derivatives.

The CTL in the present invention may include additives such as a plasticizer and a leveling agent. Specific examples of the plasticizer include known plasticizers, which are used for plasticizing typical resins, such as dibutyl phthalate and dioctyl phthalate. The CTL preferably includes a plasticizer in an amount of from 0 to 30% by weight based on total weight of the binder resin. Specific examples of the leveling agent include silicone oil such as dimethyl silicone oil and methyl phenyl silicone oil, polymers or oligomers including a perfluoroalkyl group in their side chain, etc. The CTL preferably includes a leveling agent of from 0 to 1% by weight base on total weight of the binder resin.

The multilayer photosensitive layer has been explained so far, and the photosensitive layer may be single-layered in the present invention. The single-layered photosensitive layer includes at least the above-mentioned CGM and binder resin used in the CGL and CTL.

In addition, a CTM is preferably used at the same time in the single-layered photosensitive layer for high photosensitivity and charge transportability, and low residual potential. The CTM is selected from the positive-hole transport materials and electron transport materials according to the surface polarity of the resultant photoreceptor. Further, the above-mentioned charge transport polymer material is preferably used because of having both functions of the binder resin and CTM.

A crosslinked CTL can effectively be formed on the outermost layer of the electrophotographic photoreceptor of the present invention primarily intended to increase the abrasion resistance of thereof. This can prevent the electric field intensity from increasing, and can more effectively prevent the background fouling. In addition, this prevents the residual potential from increasing, improves the scratch resistance of the surface of a photoreceptor, prevents a toner from forming a film over the surface thereof, reduces image defects and realizes high durability.

The crosslinked CTL is formed for the purpose of reducing the abrasion of the photoreceptor due to repeated use, and stabilizing the image quality without background fouling for long periods.

The scratches formed on the surface of a photoreceptor and foreign particles such as a toner, additives thereof, a carrier and a paper powder adhered thereto noticeably deteriorate the cleanability of a photoreceptor and image quality. Therefore, it is essential to minimize the scratches and toner film on the surface thereof as well as to increase the abrasion resistance thereof for higher durability thereof. For that purpose, a photoreceptor preferably has a smooth surface layer having high hardness and elasticity.

The crosslinked CTL of the present invention has a crosslinked three-dimensional network structure having high crosslinked density, wherein a radical polymerizing monomer having three or more functional groups is hardened. Therefore the crosslinked CTL has high hardness and elasticity, high uniformity and smoothness, and high abrasion and scratch resistance. It is important to increase the crosslinked density, i.e., the number of crosslinked bond per unit volume of the surface of a photoreceptor. However, the crosslinked CTL has an inner stress due to volume contraction because a number of crosslinked bonds are instantly formed when hardened. Since the inner stress increases as the crosslinked CTL has thicker thickness, the crosslinked CTL tends to have a crack and a peel-off when hardened. Even though the crack and peel-off do not initially appear, they occasionally appear as time passes while charging, developing, transferring and cleaning processes are repeated in the electrophotographic image forming process.

In order to solve this problem, (1) a polymer material is included in the crosslinked CTL, (2) a number of monofunctional and bifunctional radical polymerizing monomers are used, and (3) a multifunctional monomer having a flexible group is used, to soften the hardening resin layer, but any of which reduces the crosslinked density, resulting in less abrasion resistance of the resultant photoreceptor. However, the crosslinked CTL of the present invention, having three-dimensional network structure with high crosslinked density and a thickness of from 1 to 10 μm, is free from the crack and peel-off and has high abrasion resistance. The crosslinked CTL more preferably has a thickness of from 2 to 8 μm.

The reason why the photoreceptor of the present invention is free from the crack and peel-off is partly because the inner stress does not become large since the crosslinked CTL is thin, and partly because the inner stress can be reduced since a CTL is formed thereunder. Therefore, a number of polymer materials need not be included in the crosslinked CTL, and an incompatible hardened product from a reaction between the polymer material and the radical polymerizing constituents such as a radical polymerizing monomer and a radical polymerizing compound having a charge transport structure do not often cause scratches and toner films.

Further, when a CTL is hardened with light, the light transmittance is prevented because the charge transport structure absorbs light, resulting in occasional insufficient progress of the hardening reaction. In the crosslinked CTL of the present invention, having a thickness not greater than 10 μm, the hardening reaction uniformly progresses therein. Therefore, even the interior thereof has high abrasion resistance as well as the surface thereof. In addition, the crosslinked CTL of the present invention further includes a monofunctional radical polymerizing compound having a charge transport structure in addition to the radical polymerizing monomer having three or more functional groups, and which is taken in the crosslinked bond when the radical polymerizing monomer having three or more functional groups is hardened.

When a low-molecular-weight CTM is included in a crosslinked CTL, the low-molecular-weight CTM separates out or becomes cloudy due to its low compatibility, and the mechanical strength thereof deteriorates as well. When a charge transport compound having two or more functional groups is used as a main component, plural bondings are fixed in the crosslinked structure and the crosslinked density becomes higher, the charge transport structure is so bulky that the hardening resin structure has a large distortion, resulting in higher inner stress in the crosslinked CTL.

Further, the photoreceptor of the present invention has good electrical properties. This is because the crosslinked CTL includes a monofunctional radical polymerizing compound having a charge transport structure, which is fixed between the crosslinked bond in the shape of a pendant. As mentioned above, the CTM having no functional group separates out and becomes cloudy, and noticeably deteriorates electrical properties in repeated use, such as deterioration of the sensitivity and increase of the residual potential. When a charge transport compound having two or more functional groups is used as a main component, plural bondings are fixed in the crosslinked structure and an intermediate structure (a cation radical) when transporting a charge cannot stably be maintained, resulting in deterioration of the sensitivity due to a trapped charge and increase of the residual potential. The deterioration of these electrical properties causes deterioration of the resultant image density and thinning of letter images. Further, the underlying CTL of the photoreceptor of the present invention is designable to have less charge trap and can minimize electrical adverse effects of the crosslinked CTL.

Further, the crosslinked CTL of the present invention is preferably insoluble in an organic solvent. The crosslinked CTL is formed by hardening a radical polymerizing monomer having no charge transport structure and three or more functional groups and a monofunctional radical polymerizing compound having a charge transport structure, and has three-dimensional network structure with high crosslinked density. However, other contents besides these, i.e., additives such as a monofunctional or bifunctional monomer, a polymer binder, an antioxidant, a leveling agent and a plasticizer, and contaminants from the underlying CTL; and hardening conditions locally thin the crosslinked density or form a microscopic aggregate of hardened materials densely crosslinked.

Such hardened materials are not tightly bonded with each other and soluble in an organic solvent, and the crosslinked CTL is locally abraded and the microscopic hardened materials are easily removable. However, the crosslinked CTL of the present invention, insoluble in an organic solvent, wherein in addition to the three-dimensional network structure with high crosslinked density, a chain reaction is progressed to polymerize the hardened materials, has significantly high abrasion resistance.

Next, constituents of a coating liquid for the crosslinked CTL of the present invention will be explained.

The radical polymerizing monomer having no charge transport structure and three or more functional groups for use in the present invention represents a monomer which has neither a positive hole transport structure such as triarylamine, hydrazone, pyrazoline and carbazole nor an electron transport structure such as condensed polycyclic quinone, diphenoquinone, a cyano group and an electron attractive aromatic ring having a nitro group, and has three or more radical polymerizing functional groups. Any radical polymerizing functional groups can be used, provided they have a carbon-carbon double bonding and capable of radically polymerizing. Specific examples of the radical polymerizing functional groups include the following 1-substituted ethylene functional groups and 1,1-substituted ethylene functional groups.

Specific examples of the 1-substituted ethylene functional groups include functional groups having the following formula (10):

$$CH_2{=}CH{-}X_1{-} \quad (10)$$

wherein $X_1$ represents a substituted or an unsubstituted phenylene group, an arylene group such as a naphthylene group, a substituted or an unsubstituted alkenylene group, a —CO-group, a —COO-group and a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group.

Specific examples of the substituents include vinyl groups, styryl groups, 2-methyl-1,3-butadienyl groups, vinylcarbonyl groups, acryloyloxy groups, acryloylamide groups, vinylthioether groups, etc.

Specific examples of the 1,1-substituted ethylene functional groups include functional groups having the following formula (11):

$$CH_2{=}CH(Y){-}X_2{-} \quad (11)$$

wherein $Y_1$ represents a substituted or an unsubstituted alkyl group, a substituted or an unsubstituted aralkyl group, a substituted or an unsubstituted phenyl group, an aryl group such as a naphtyl group, a halogen atom, a cyano group, a nitro group, an alkoxy group such as a methoxy group or a ethoxy group and a —$COOR_{11}$ group wherein $R_{11}$ represents a hydrogen atom, a substituted or an unsubstituted methyl group, an alkyl group such as an ethyl group, a substituted or an unsubstituted benzyl group, an aralkyl group such as a phenethyl group, a substituted or an unsubstituted phenyl group and an aryl group such as a naphtyl group, or a —$CONR_{12}R_{13}$ wherein $R_{12}$ and $R_{13}$ independently represent a hydrogen atom, a substituted or an unsubstituted methyl group, an alkyl group such as an ethyl group, a substituted or an unsubstituted benzyl group, a naphthylmethyl group, an aralkyl group such as a phenethyl group, a substituted or an unsubstituted phenyl group and an aryl group such as a naphtyl group; $X_2$ represents a substituted or an unsubstituted phenylene group, an arylene group such as a naphthylene group, a substituted or an unsubstituted alkenylene group, a —CO-group, a —COO-group, a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group; and at least either Y or $X_2$ is an oxycarbonyl group, a cyano group, an alkenylene group and an aromatic ring.

Specific examples of the substituents include α-acryloyloxy chloride groups, methacryloyloxy groups, α-cyanoethylene groups, α-cyanoacryloyloxy groups, α-cyanophenylene groups, methacryloylamino groups, etc.

Specific examples of further substituents for the substituents of $X_1$, $X_2$ and Y include halogen atoms, nitro groups, cyano groups, methyl groups, alkyl groups such as ethyl groups, methoxy groups, alkoxy groups such as ethoxy groups, aryloxy groups such as phenoxy groups, phenyl groups, aryl groups such as naphthyl groups, benzyl groups, aralkyl groups such as phenethyl groups.

Among these radical polymerizing function groups, the acryloyloxy groups and methacryloyloxy groups are effectively used. A compound having three or more acryloyloxy groups can be formed by, e.g., performing an ester reaction or an ester exchange reaction among a compound having three or more hydroxyl groups, an acrylic acid (salt), halide acrylate and ester acrylate. A compound having three or more methacryloyloxy groups can be formed by the same method. The radical polymerizing functional groups in a monomer having three or more radical polymerizing function groups may be the same or different from one another.

Specific examples of the radical polymerizing monomer having no charge transport structure and three or more functional groups include the following materials, but which are not limited thereto.

Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The radical polymerizing monomer having no charge transport structure and three or more functional groups for use in the present invention preferably has a ratio of the molecular weight to the number of functional groups (molecular weight/number of functional groups) in the monomer not greater than 250. When the ratio is greater than 250, the resultant crosslinked CTL has a rather lowered abrasion resistance, and it is not preferable to use the HPA, EO and PO-modified monomers having extremely long modified groups.

The crosslinked CTL preferably includes the radical polymerizing monomer having no charge transport structure and three or more functional groups in an amount of from 20 to 80% by weight, and more preferably from 30 to 70% by weight. When less than 20% by weight, a three-dimensional crosslinked bonding density of the crosslinked CTL is insufficient, and the abrasion resistance thereof does not remarkably improve more than a layer including a conventional thermoplastic resin. When greater than 80% by weight, a content of a charge transporting compound lowers and electrical properties of the resultant photoreceptor deteriorates.

Although it depends on a required abrasion resistance and electrical properties, in consideration of a balance therebetween, a content of the radical polymerizing monomer having no charge transport structure and three or more functional groups is most preferably from 30 to 70% by weight based on total weight of the crosslinked CTL.

The monofunctional radical polymerizing compound having a charge transport structure for use in the crosslinked CTL of the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymerizing functional group. Specific examples of the radical polymerizing functional group include the above-mentioned radical polymerizing monomers, and particularly the acryloyloxy groups and methacryloyloxy groups are effectively used. In addition, a triarylamine structure is effectively used as the charge transport structure. Further, when a compound having the following formula (1) or (2), electrical properties such as a sensitivity and a residual potential are preferably maintained.

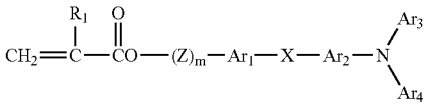

(1)

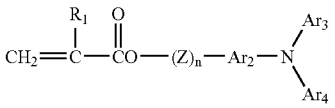

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (1) and (2), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$ is preferably a hydrogen atom or a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condnesed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene and oxadiazole.

Specific examples of the substituted or unsubstituted aryl group represented by $Ar_3$ and $Ar_4$ include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, 1-propoxy groups, t-butoxy groups, s-butoxy groups, 1-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

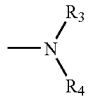

(6)

wherein $R_3$ and $R_4$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include amino groups, diethylamino groups, N-methyl-N-phenylamino groups, N,N-diphenylamino groups, N-N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkylene ether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethylene oxy, propylene oxy, ethylene glycol, propylene glycol, diethylene glycol, tetraethylene glycol and tripropylene glycol, and the alkylene group of the alkyleneether group may include a substituent such as a hydroxyl group, a methyl group and an ethyl group.

The vinylene group has the following formula:

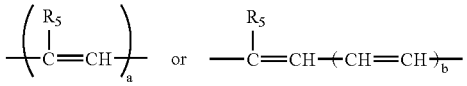

wherein $R_5$ represents a hydrogen atom, an alkyl group (same as those specified in (2)), an aryl group (same as those represented by $Ar_3$ and $Ar_4$); a represents 1 or 2; and b represents 1, 2 or 3.

Z represents a substituted or an unsubstituted alkylene group, a divalent substituted or an unsubstituted alkyleneether group and alkyleneoxycarbonyl group.

Specific examples of the substituted or unsubstituted alkylene group include those of X.

Specific examples of the divalent substituted or unsubstituted alkyleneether group include those of X.

Specific examples of the divalent alkyleneoxycarbonyl group include a divalent caprolactone-modified group.

In addition, the monofunctional radical polymerizing compound having a charge transport structure of the present invention is more preferably a compound having the following formula (3):

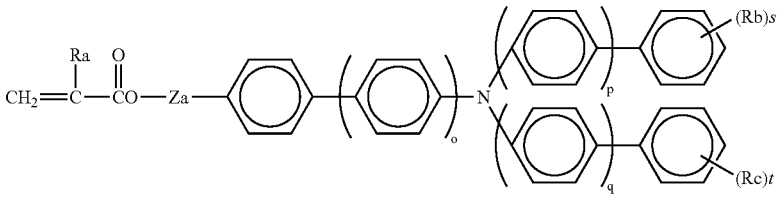

(3)

wherein o, p and q independently represent 0 or 1; Ra represents a hydrogen atom or a methyl group; Rb and Rc represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

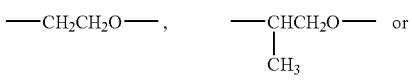

-continued

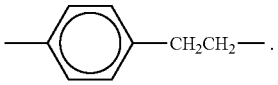

The compound having formula (3) are preferably a compound having an methyl group or a ethyl group as a substituent of Rb and Rc.

The monofunctional radical polymerizing compound having a charge transport structure of the formulae (1), (2) and particularly (3) for use in the present invention does not become an end structure because a double bonding between the carbons is polymerized while opened to the both sides, and is built in a chain polymer. In a crosslinked polymer polymerized with a radical polymerizing monomer having three or more functional groups, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is supposed that the monofunctional radical polymerizing compound having a charge transport structure in a surface layer of an electrophotographic photoreceptor can have an intramolecular structure wherein blocking of a charge transport route is comparatively prevented.

Specific examples of the monofunctional radical polymerizing compound having a charge transport structure include compounds having the following formulae, but the compounds are not limited thereto.

No. 1

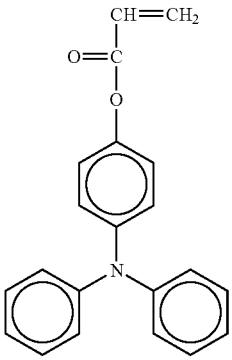

-continued

No. 2

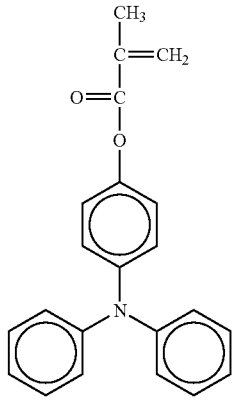

No. 3

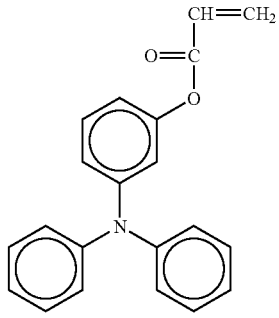

No. 4

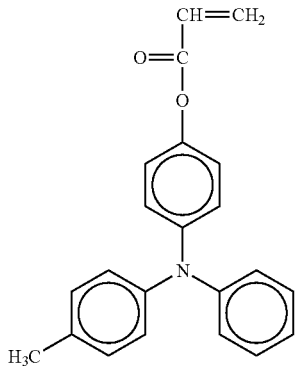

No. 5

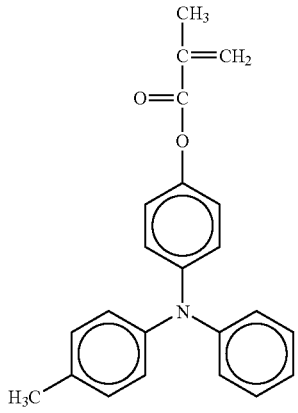

-continued
No. 6
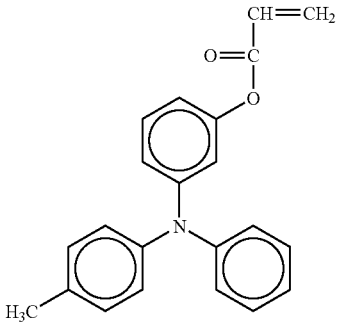
No. 7
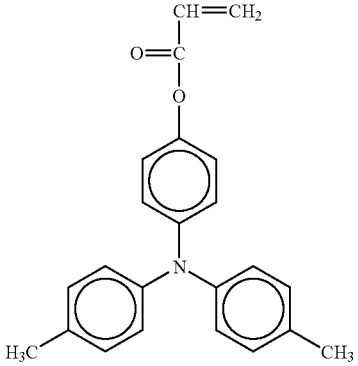
No. 8
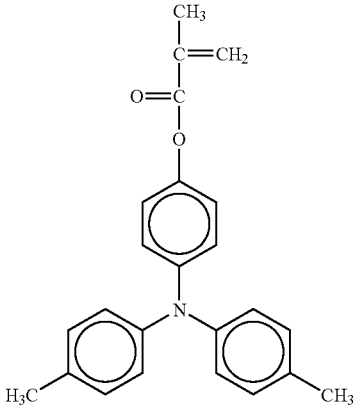
No. 9
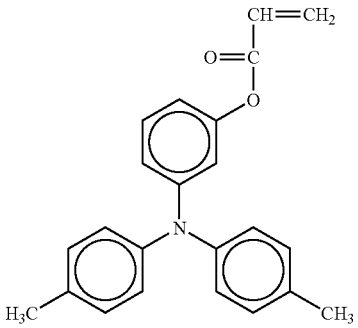
-continued
No. 10
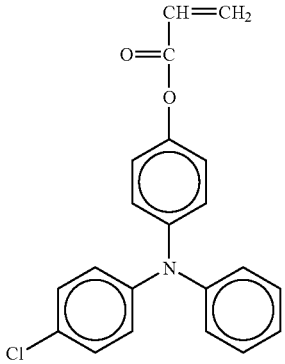
No. 11
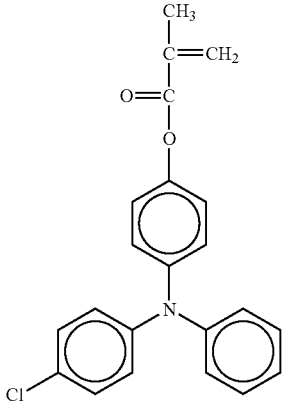
No. 12
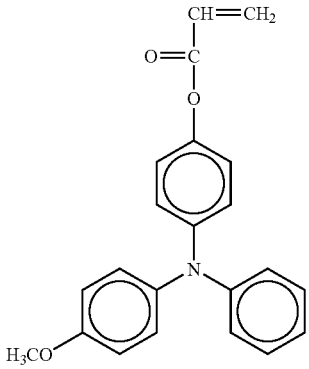
No. 13
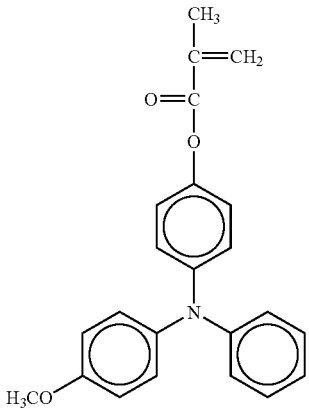

-continued
No. 14
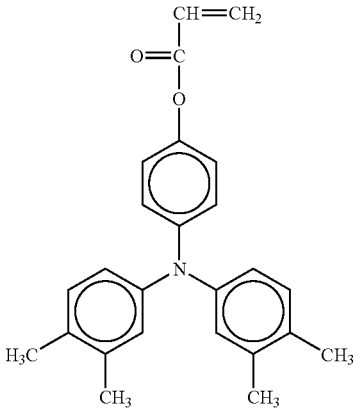
No. 15
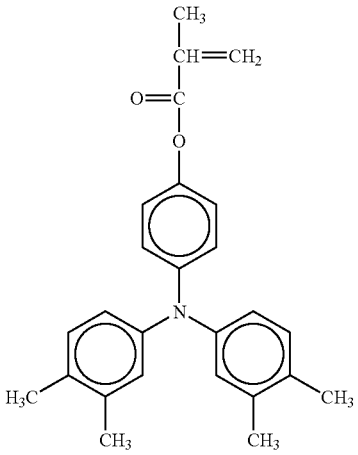
No. 16
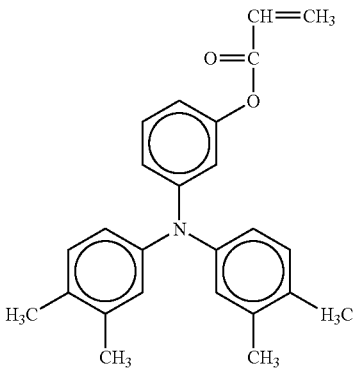
-continued
No. 17
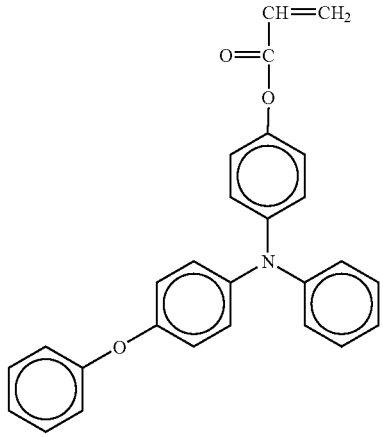
No. 18
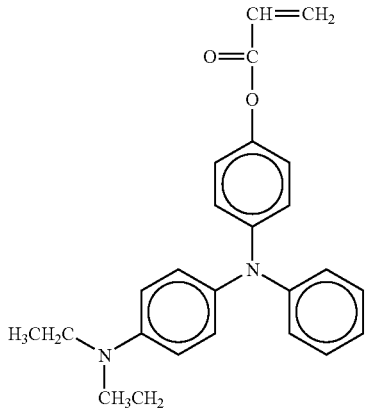
No. 19
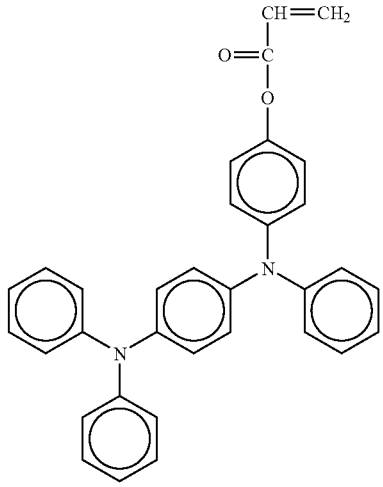

-continued
No. 20
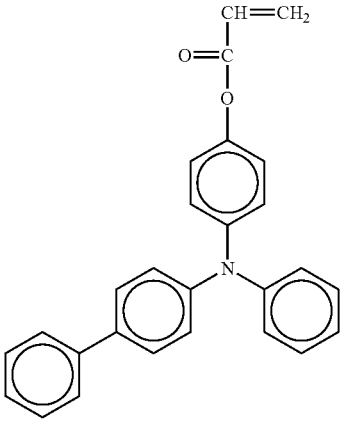
No. 21
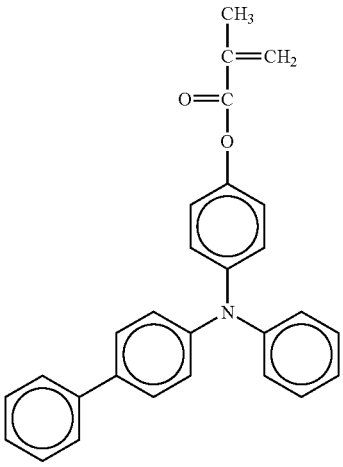
No. 22
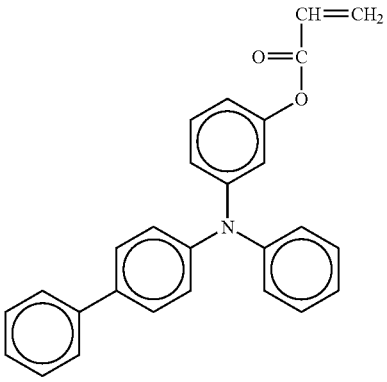
-continued
No. 23
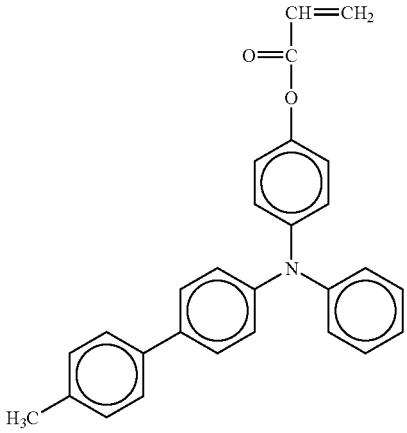
No. 24
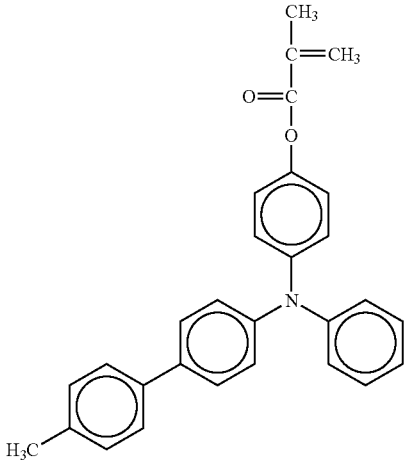
No. 25
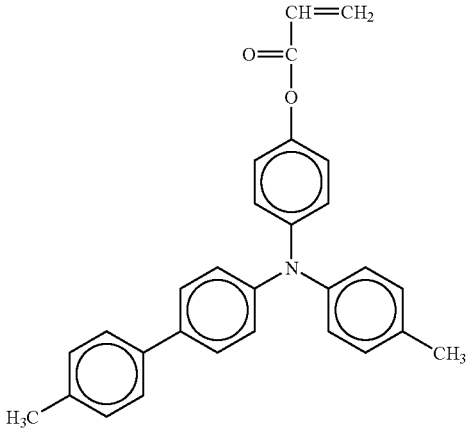

-continued
No. 26
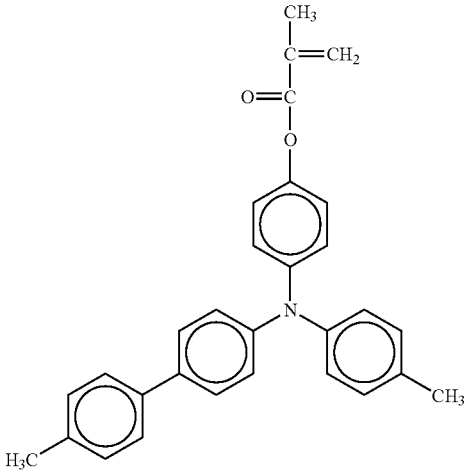
No. 27
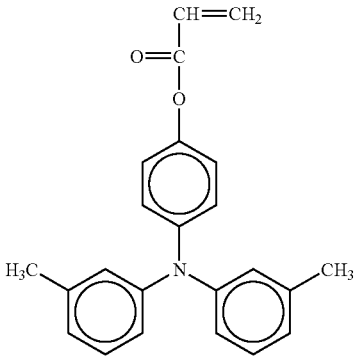
No. 28
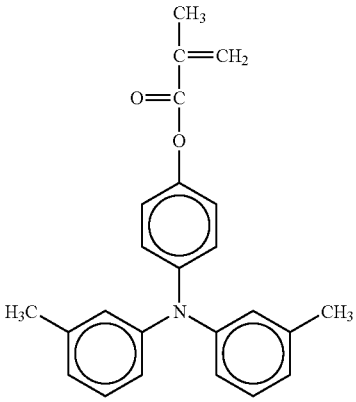
-continued
No. 29
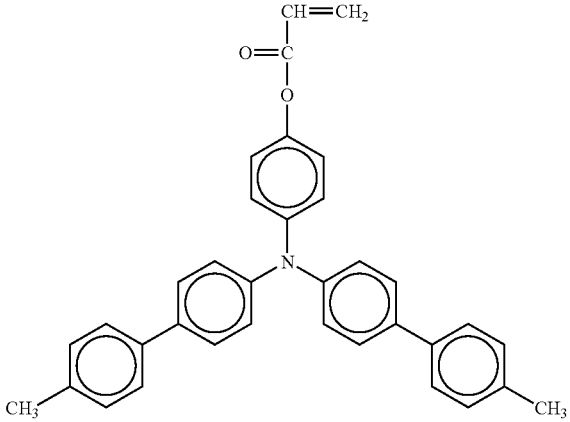
No. 30
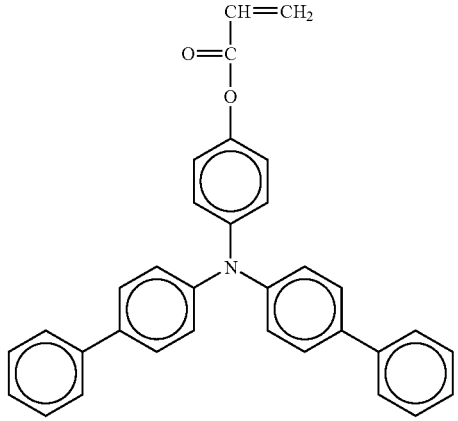
No. 31
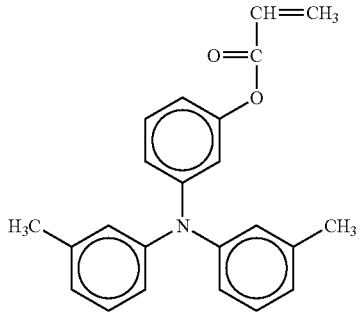
No. 32
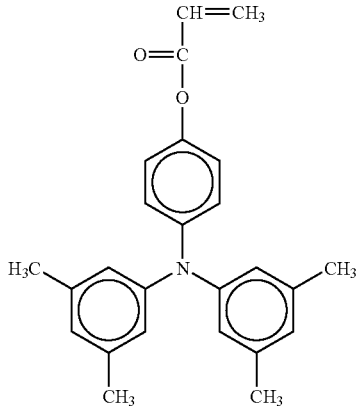

-continued
No. 33
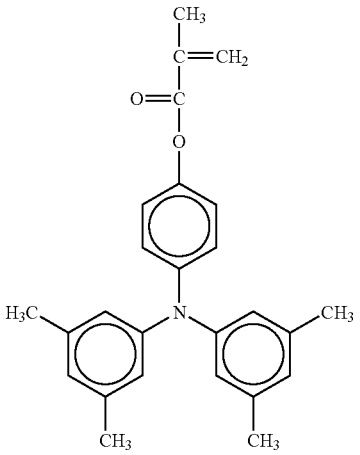
No. 34
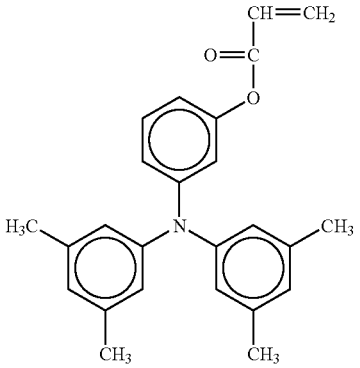
No. 35
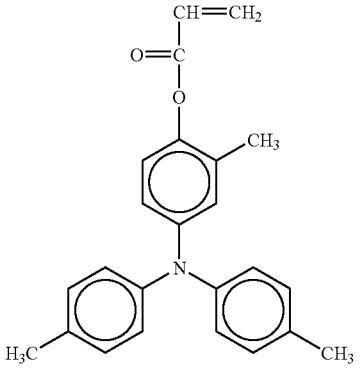
No. 36
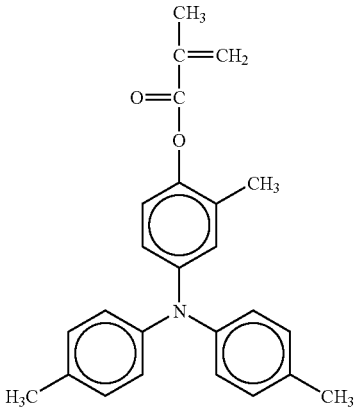
-continued
No. 37
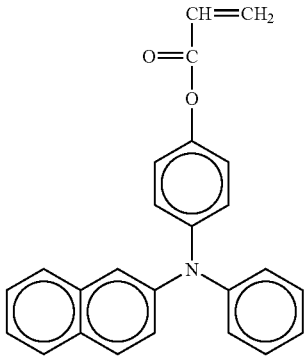
No. 38
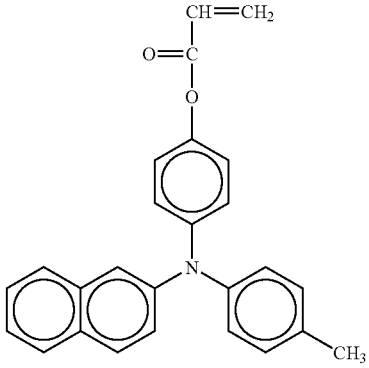
No. 39
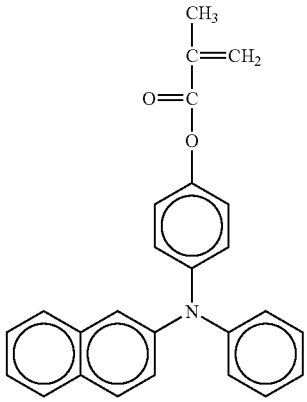
No. 40
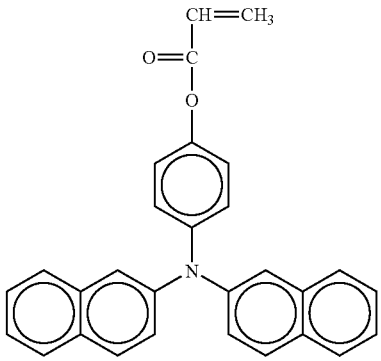

-continued
No. 41
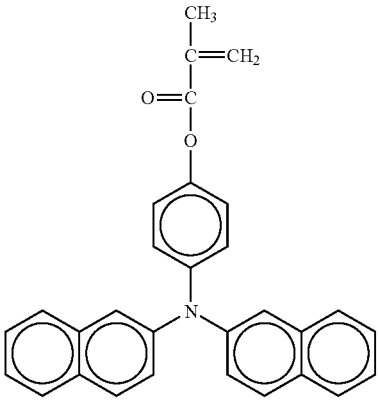
No. 42
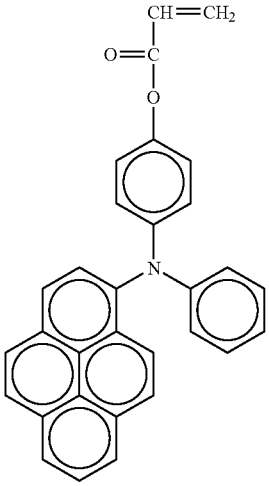
No. 43
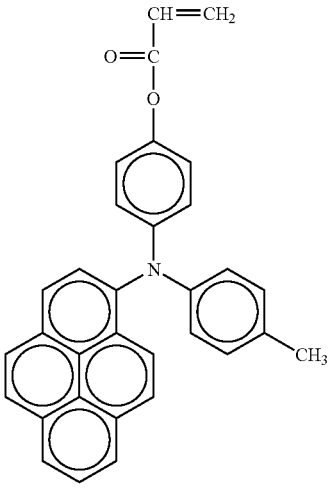
-continued
No. 44
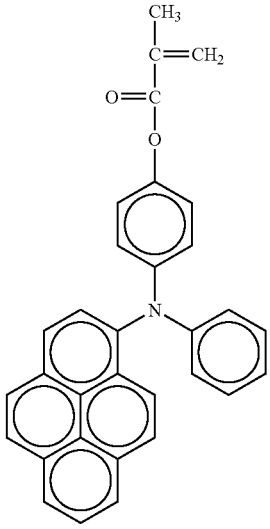
No. 45
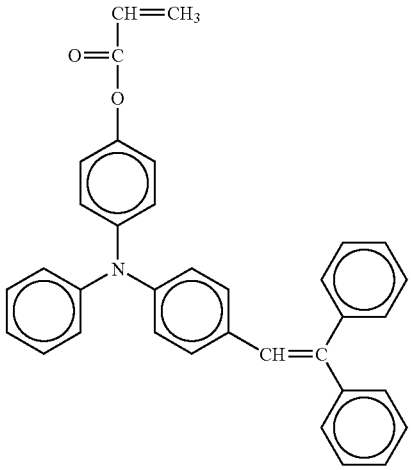
No. 46
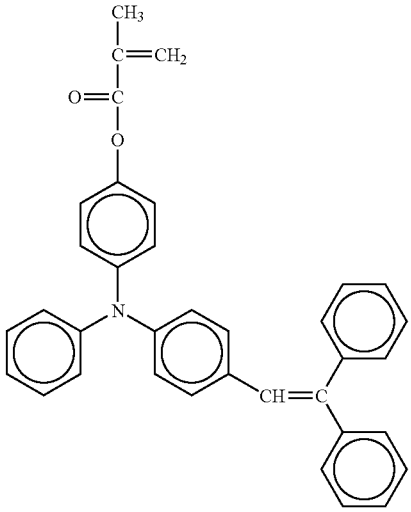

-continued
No. 47
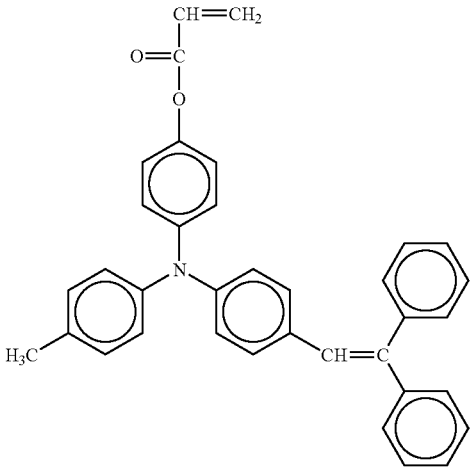
No. 48
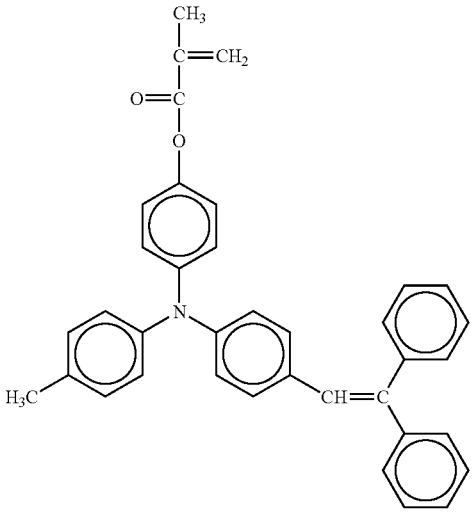
No. 49
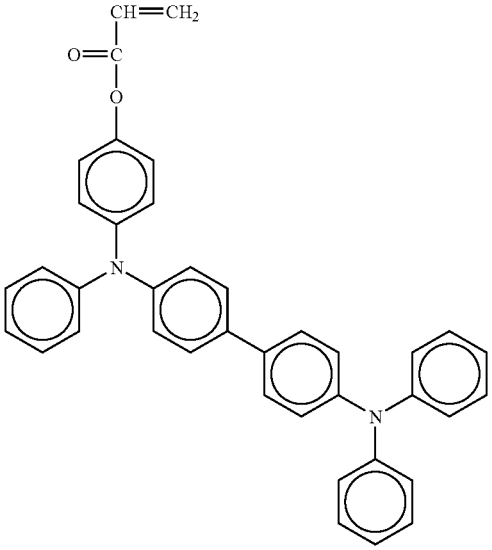
-continued
No. 50
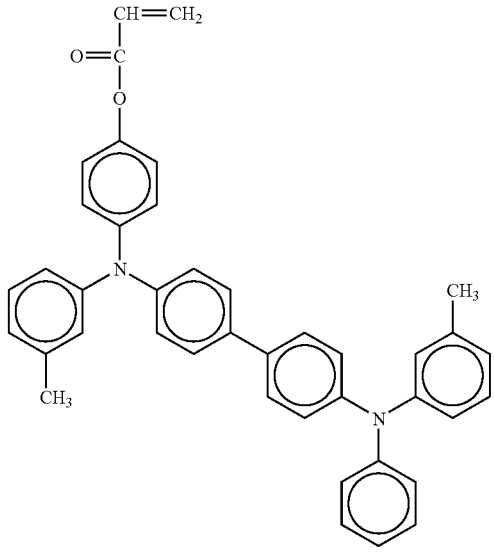
No. 51
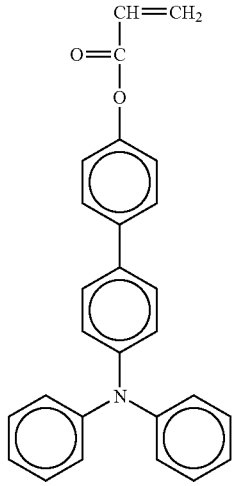
No. 52
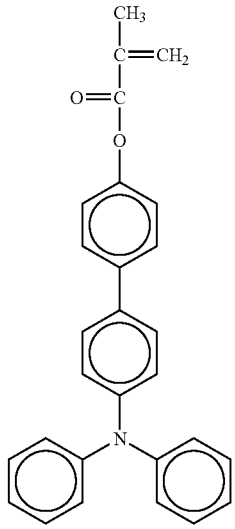

-continued
No. 53
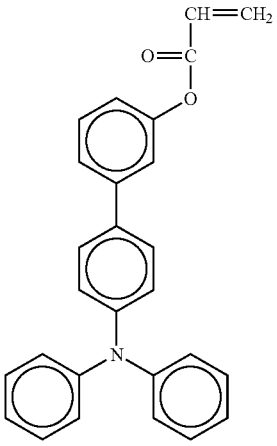
No. 54
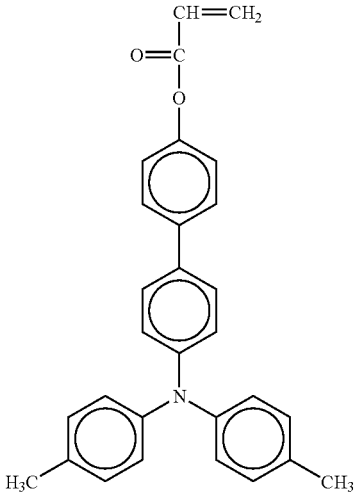
No. 55
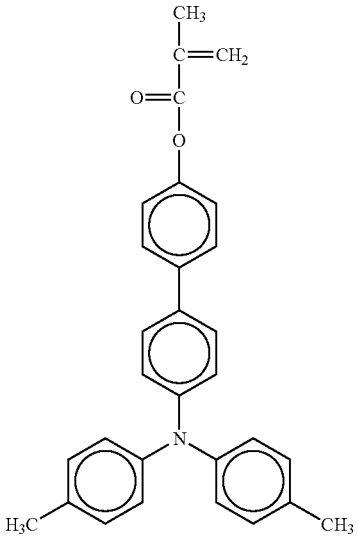
-continued
No. 56
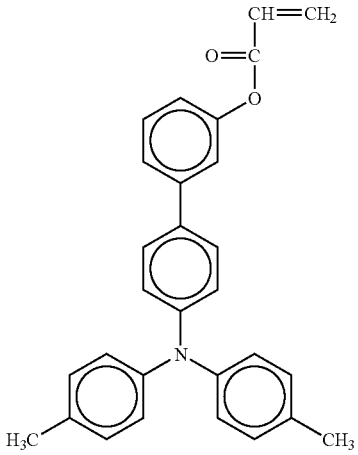
No. 57
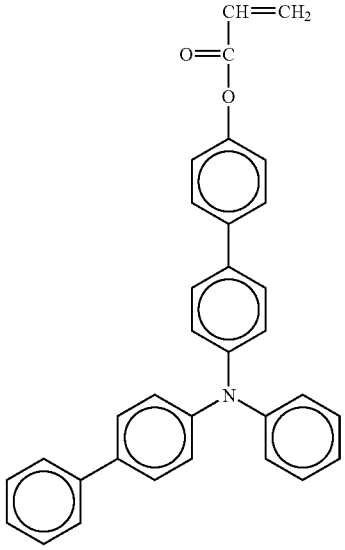
No. 58
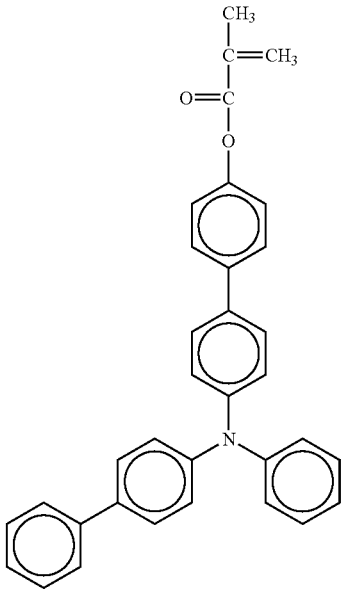

-continued
No. 59
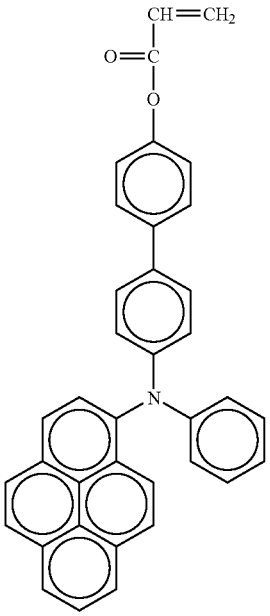
No. 60
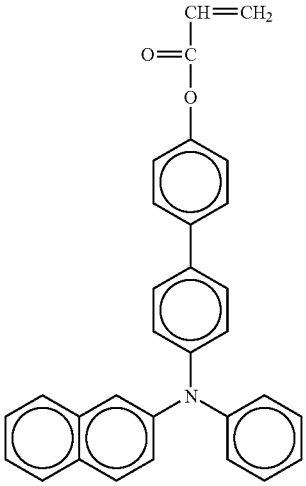
No. 61
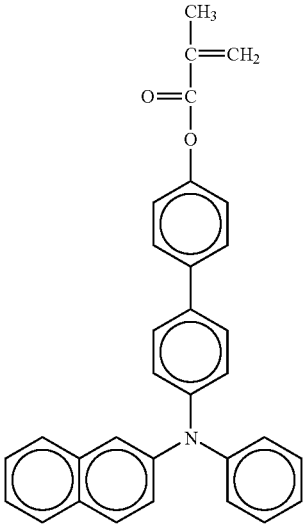
-continued
No. 62
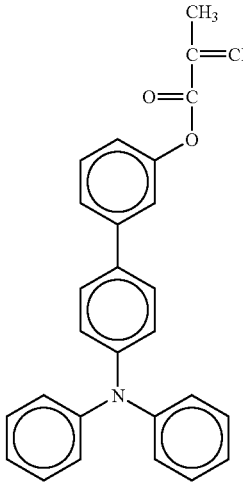
No. 63
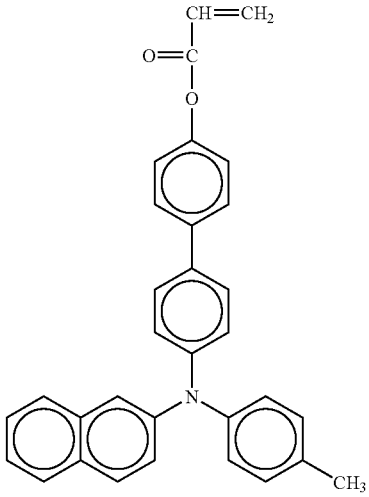
No. 64
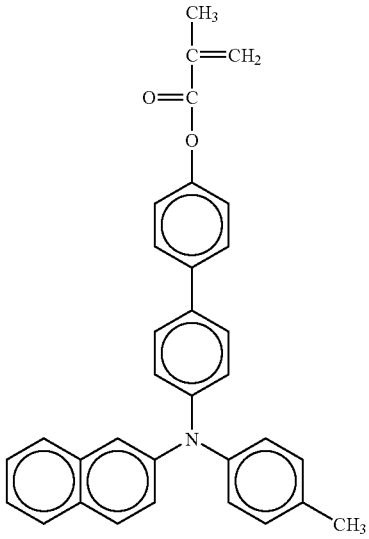

-continued
No. 65
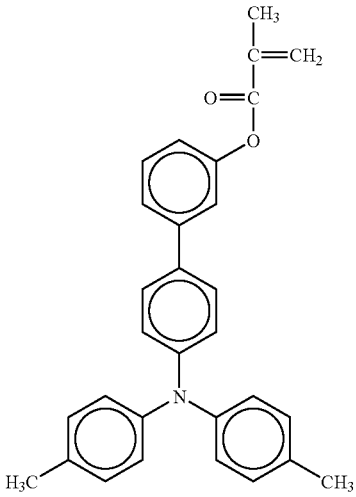
No. 66
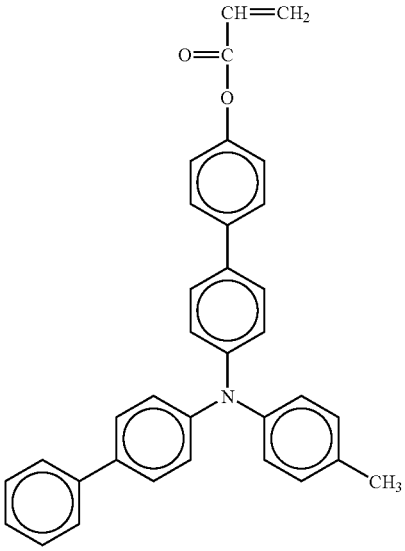
No. 67
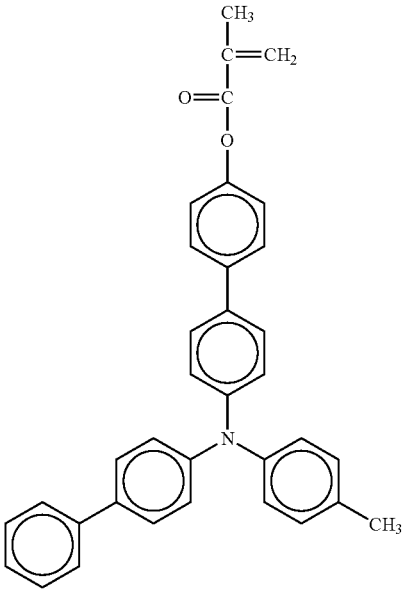
-continued
No. 68
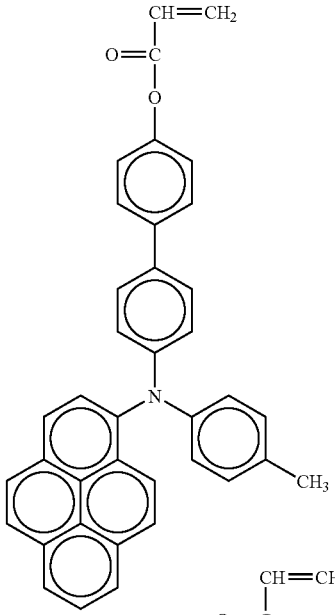
No. 69
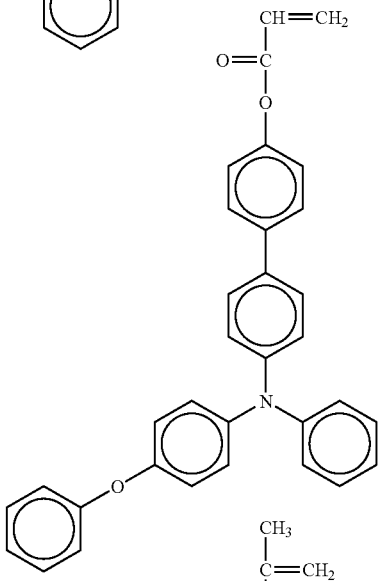
No. 70
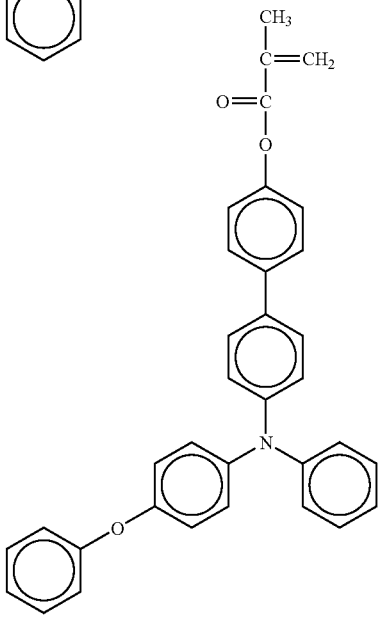

-continued
No. 71
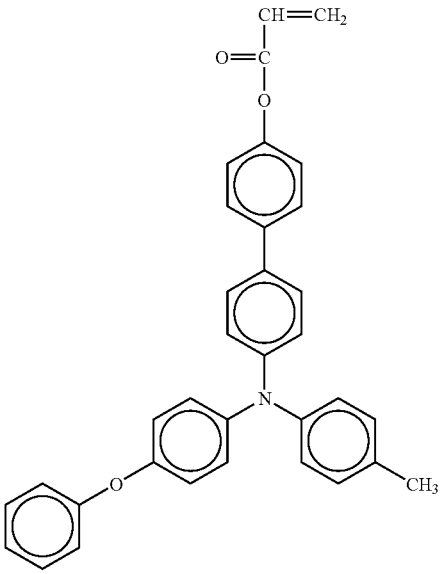
No. 72
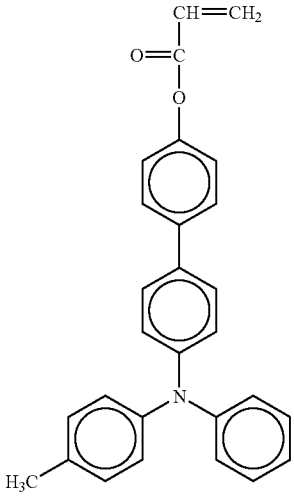
No. 73
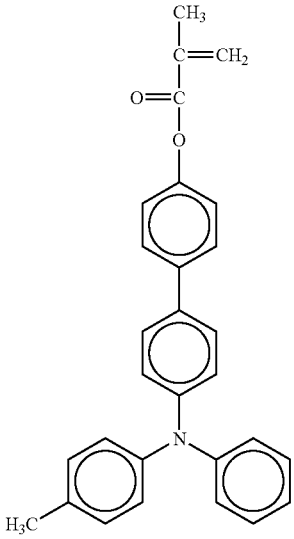
-continued
No. 74
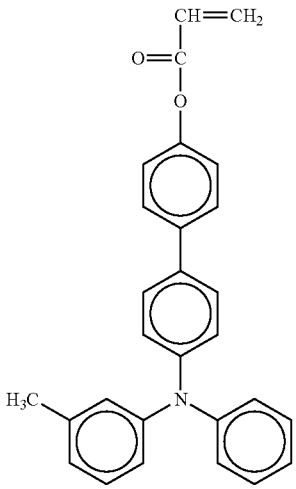
No. 75
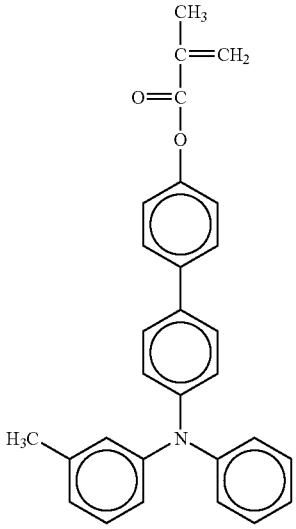
No. 76
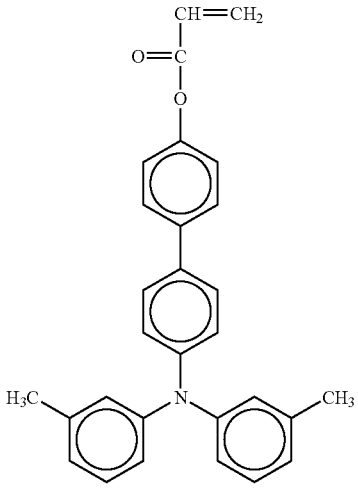

-continued
No. 77
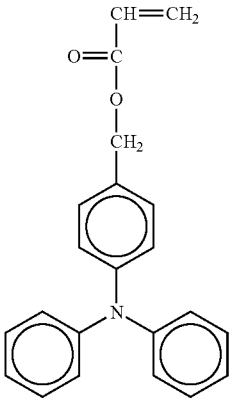
No. 78
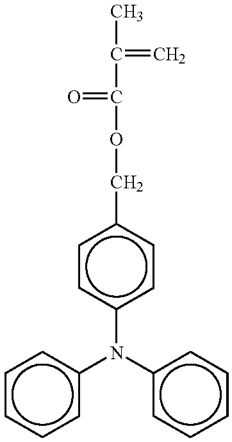
No. 79
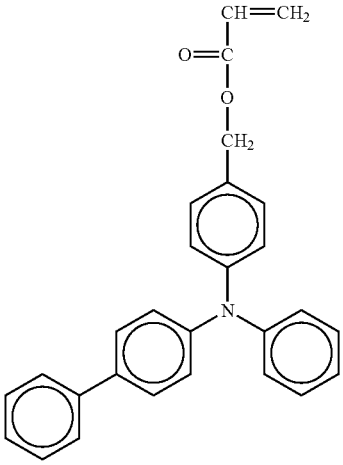
-continued
No. 80
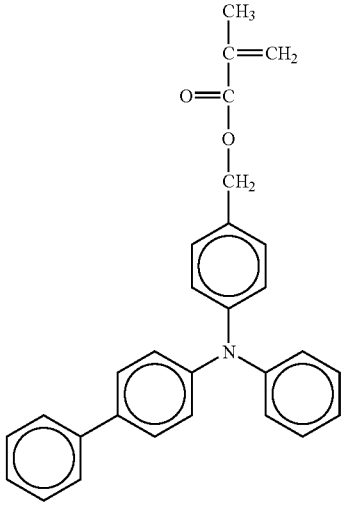
No. 81
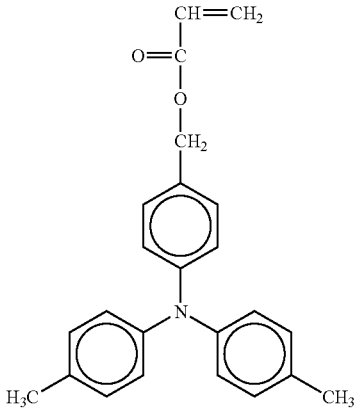
No. 82
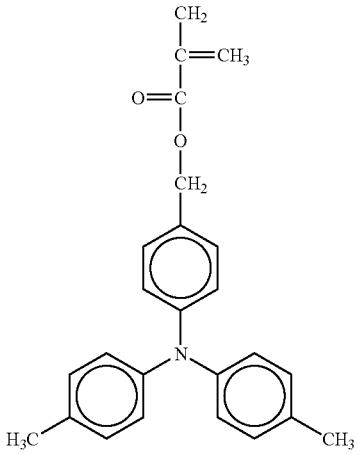

-continued
No. 83
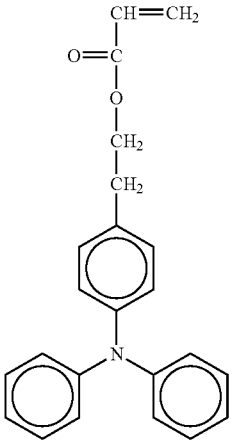
No. 84
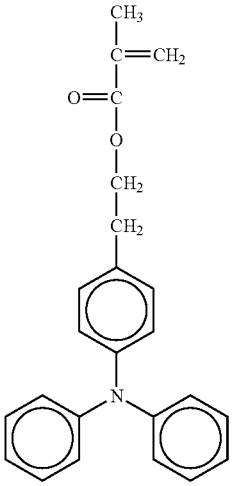
No. 85
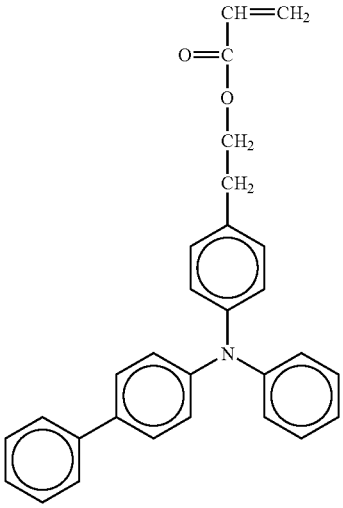
-continued
No. 86
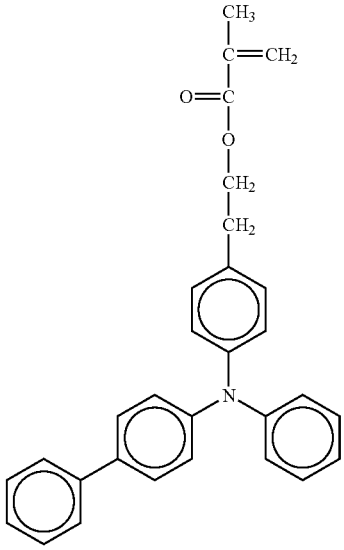
No. 87
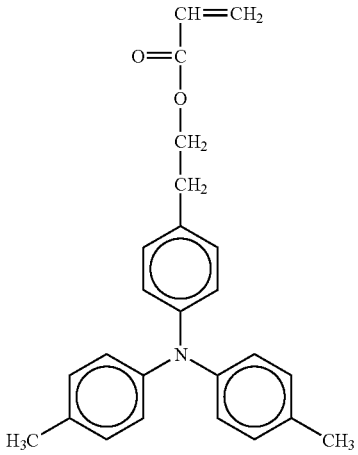
No. 88
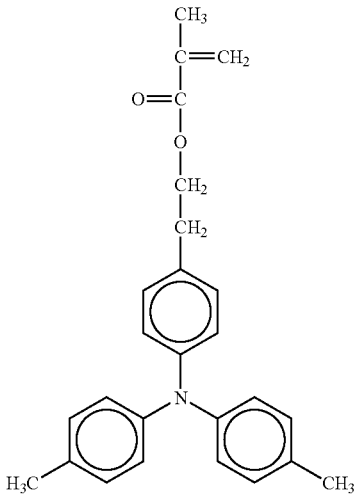

-continued
No. 89
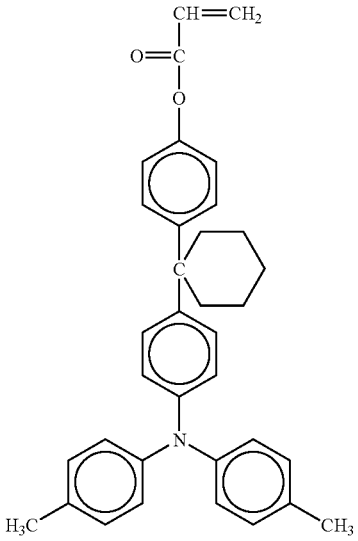
No. 90
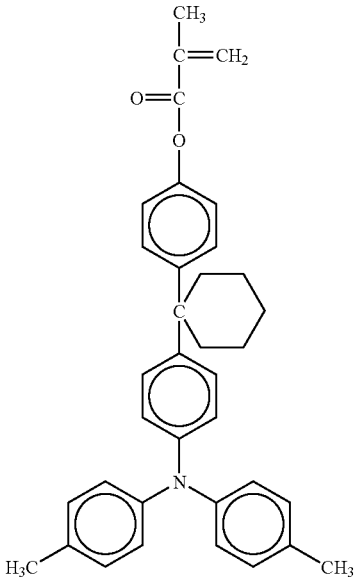
-continued
No. 91
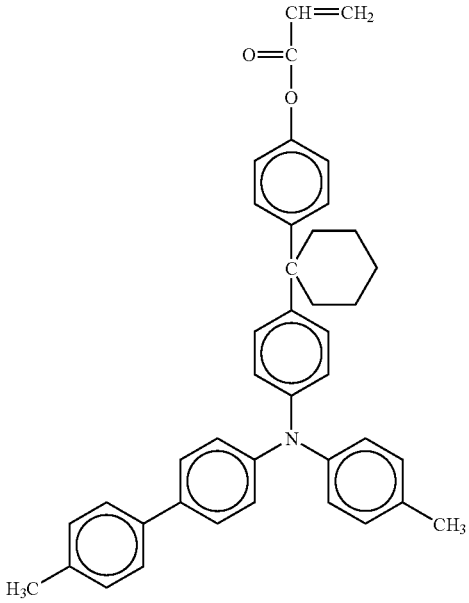
No. 92
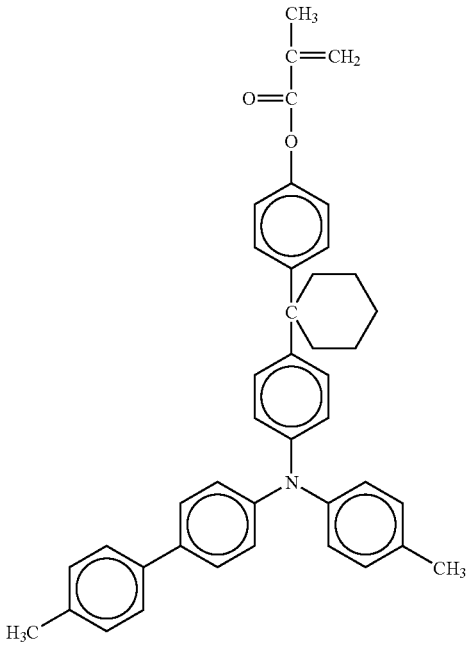

-continued
No. 93
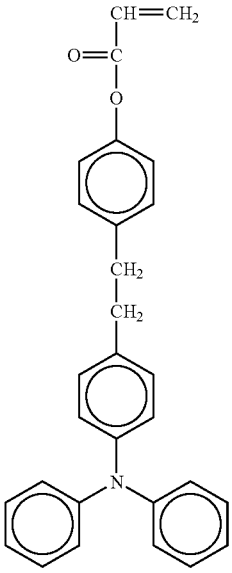
No. 94
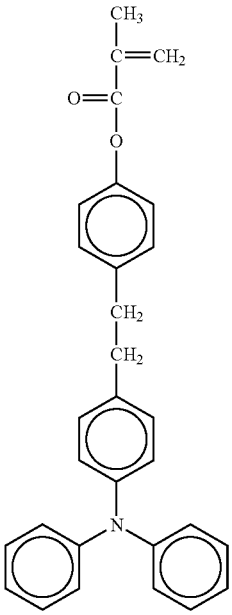
-continued
No. 95
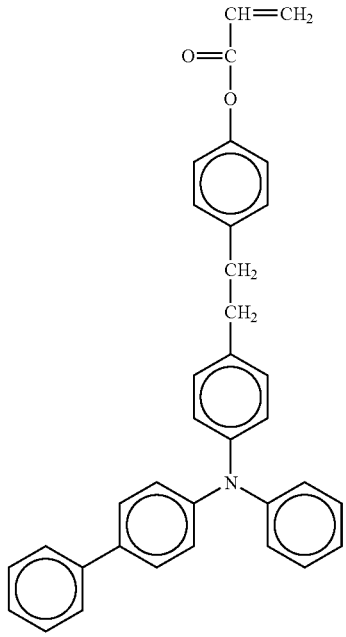
No. 96
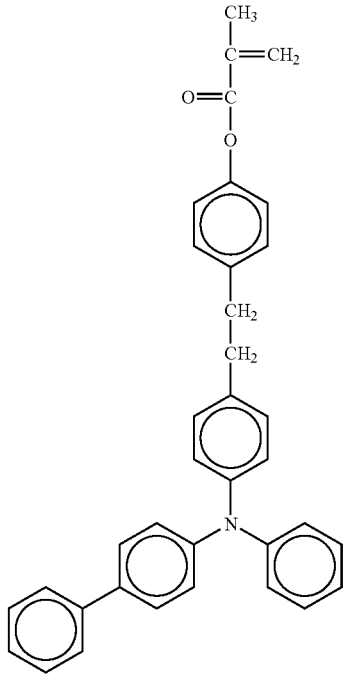

-continued
No. 97
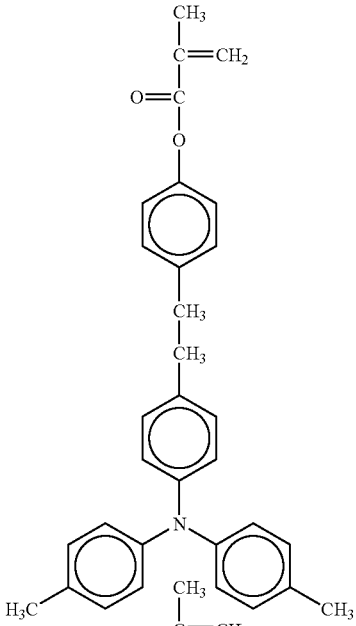
No. 98
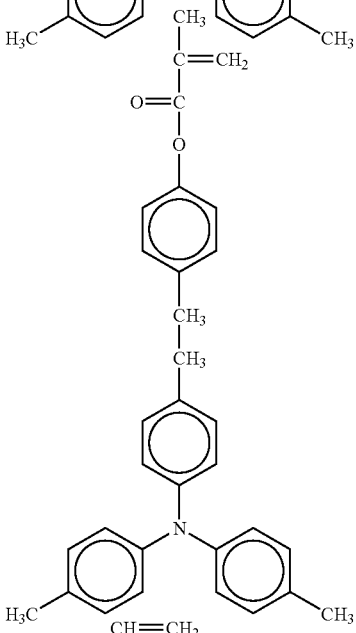
No. 99
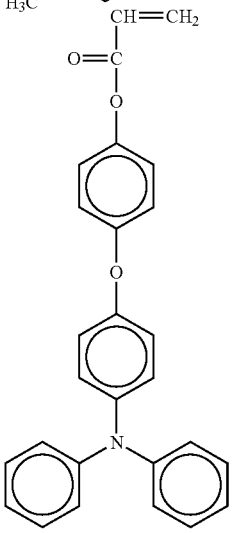
-continued
No. 100
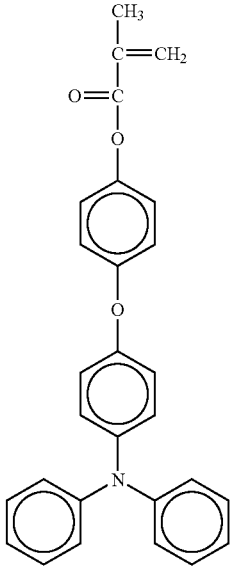
No. 101
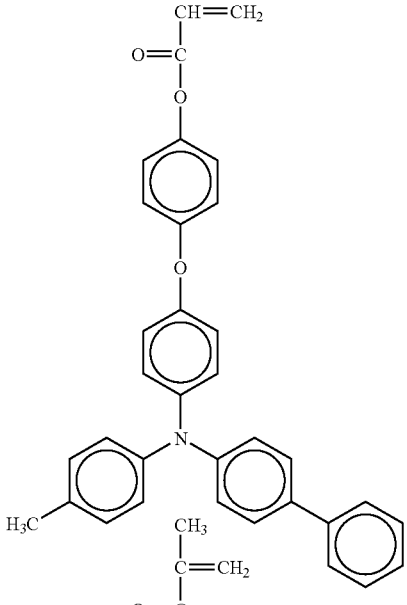
No. 102
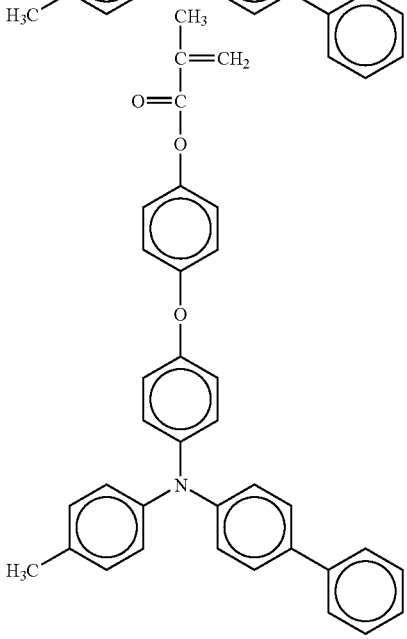

-continued
No. 103
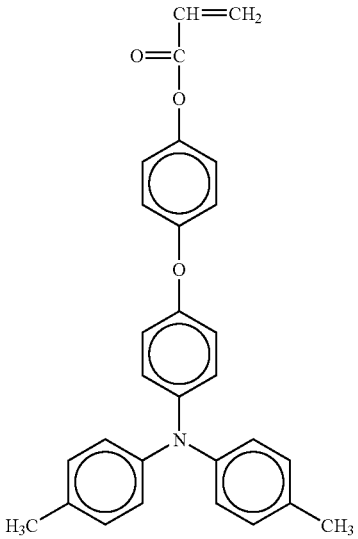
-continued
No. 105
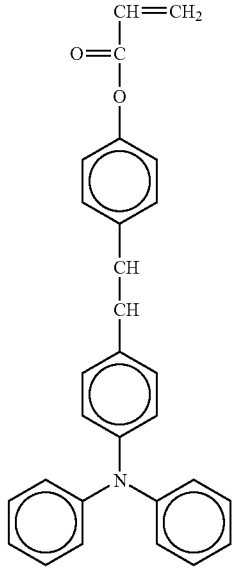
No. 104
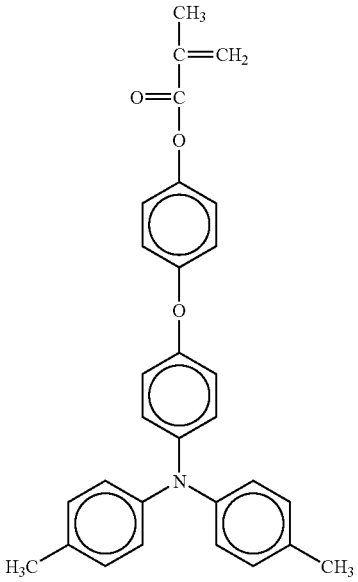
No. 106
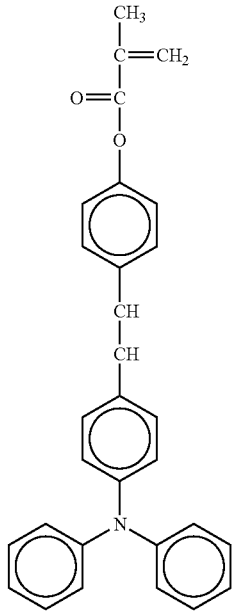

-continued
No. 107
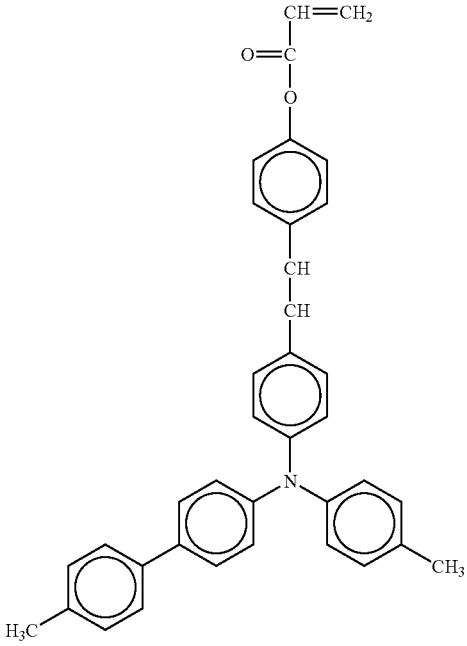
No. 108
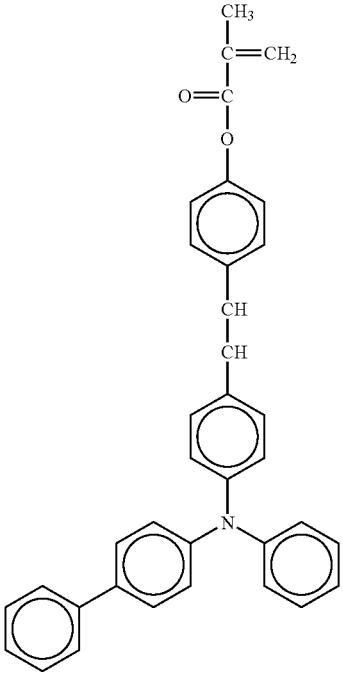
-continued
No. 109
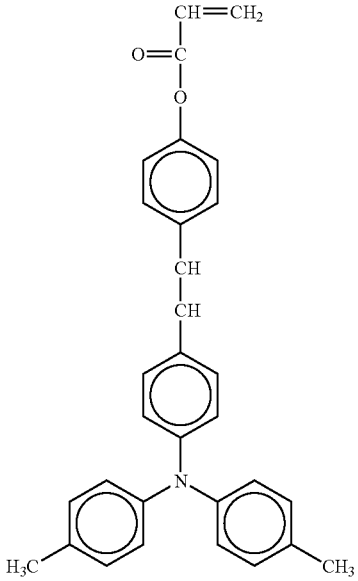
No. 110
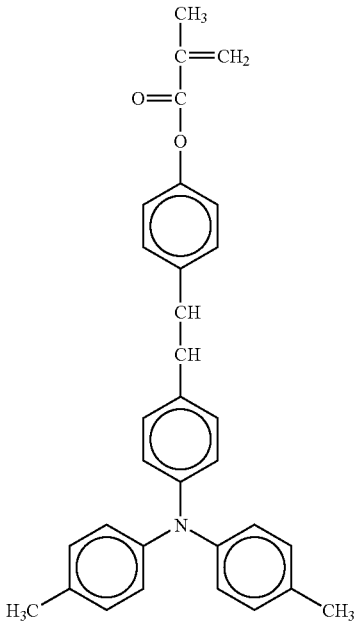

-continued
No. 111
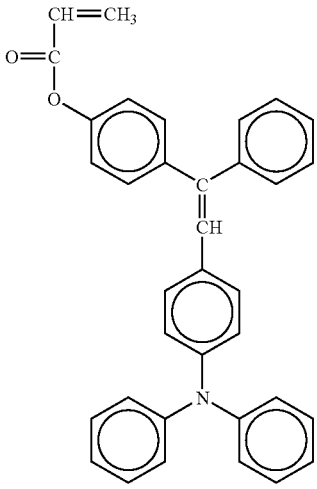
No. 112
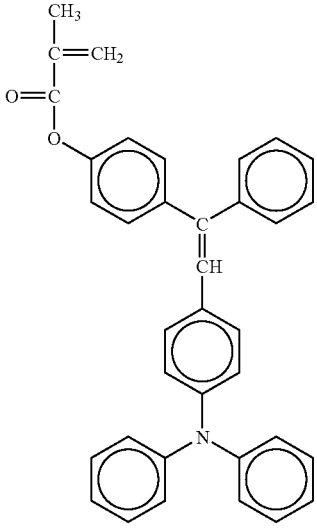
No. 113
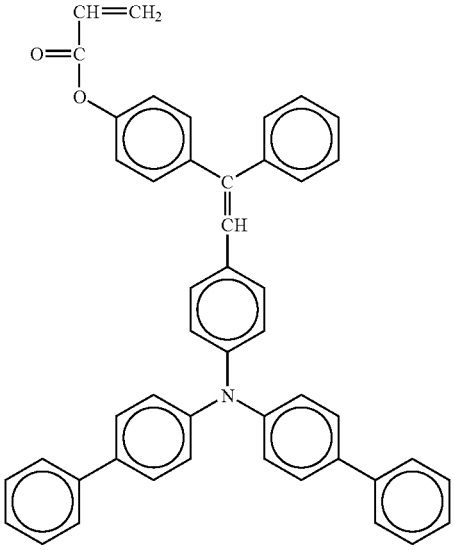
-continued
No. 114
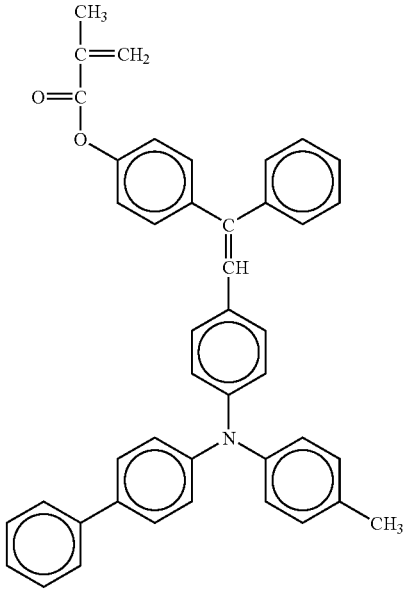
No. 115
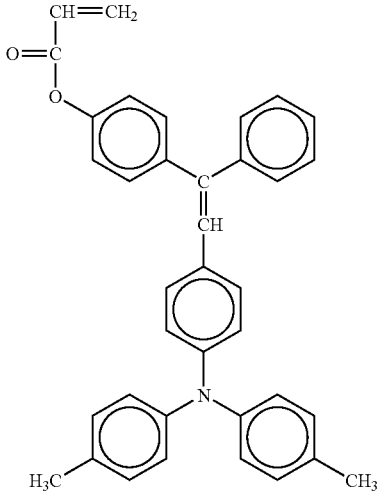
No. 116
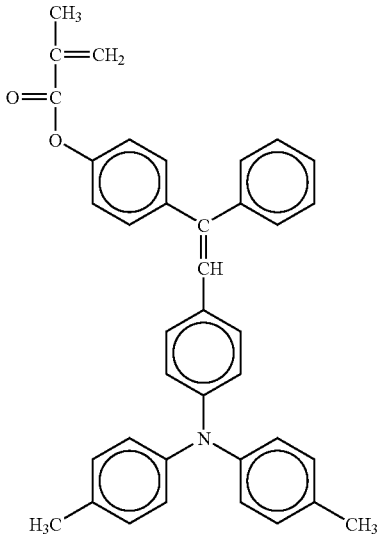

-continued
No. 117
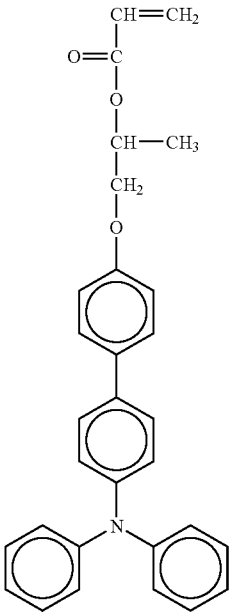
No. 118
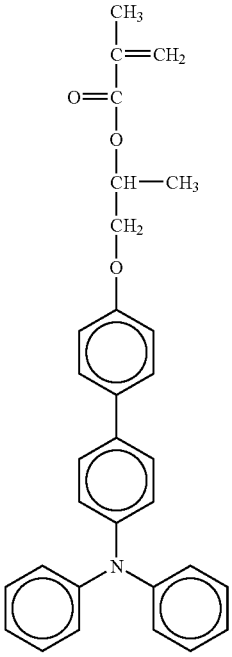
-continued
No. 119
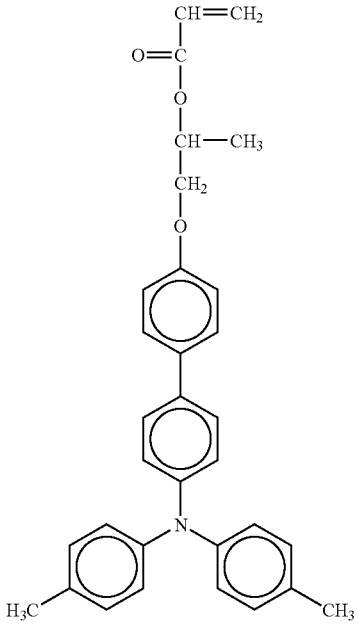
No. 120
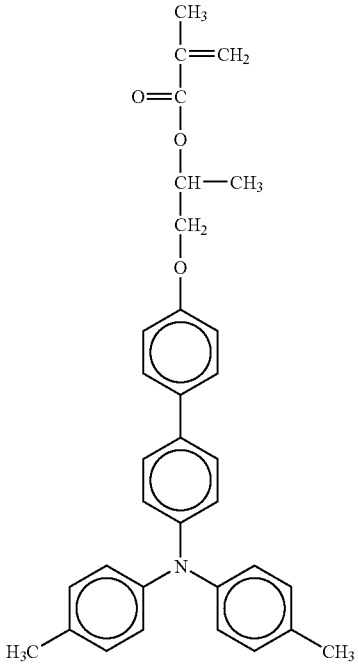

-continued
No. 121
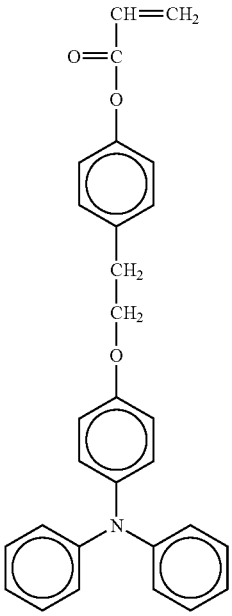
No. 122
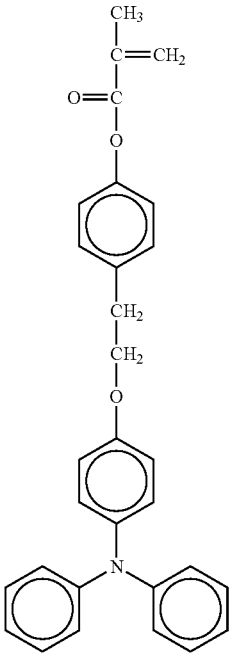
-continued
No. 123
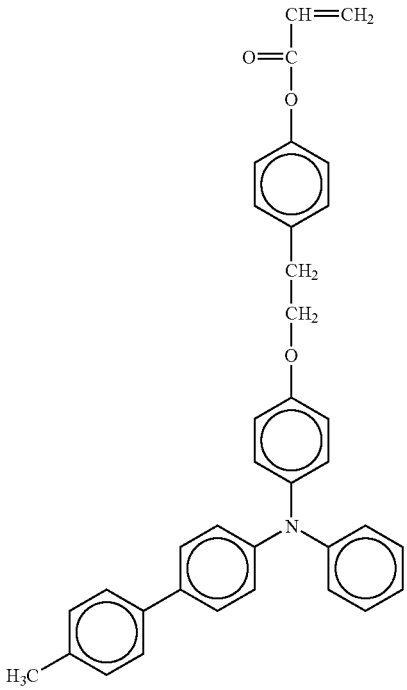
No. 124
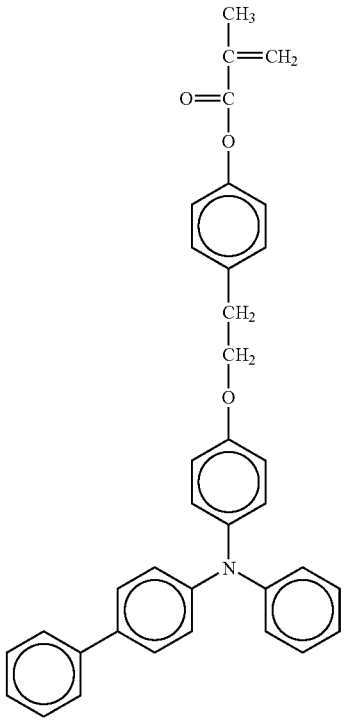

-continued
No. 125
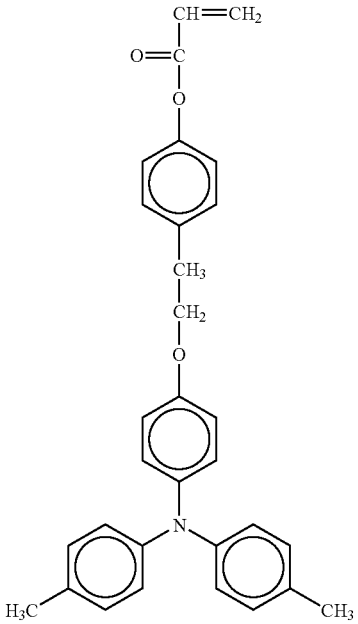
No. 126
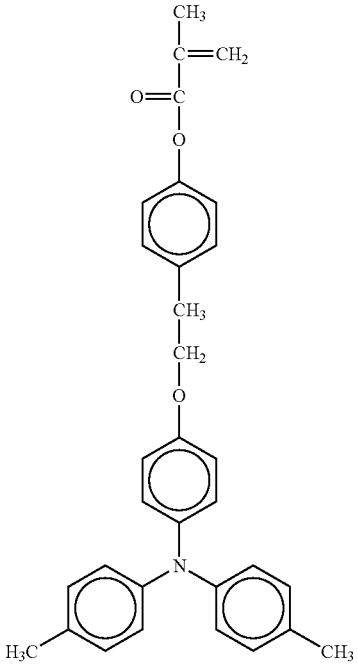
-continued
No. 127
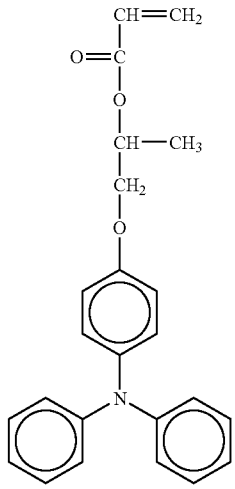
No. 128
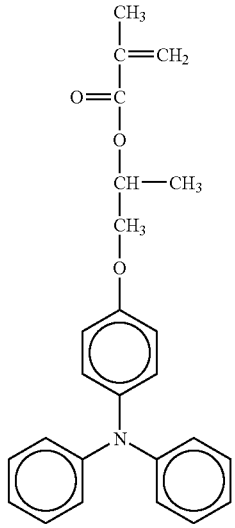
No. 129
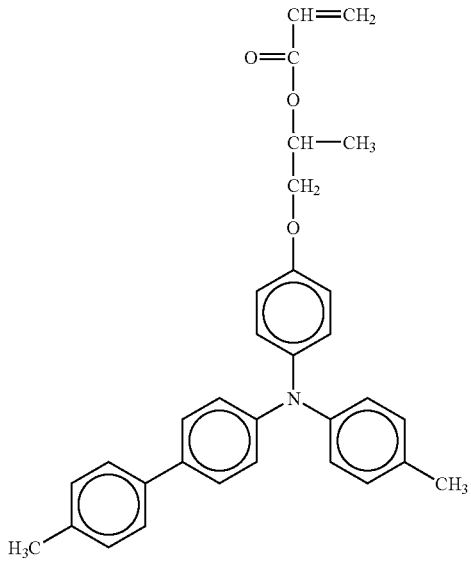

-continued
No. 130
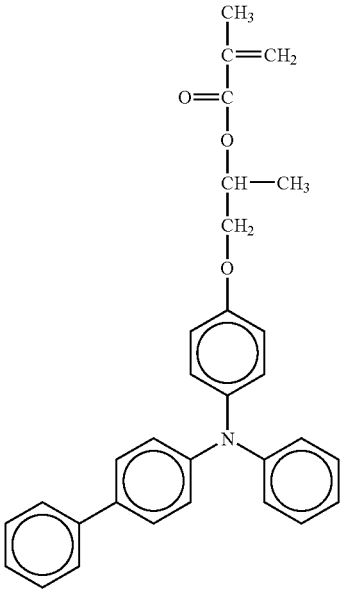
No. 131
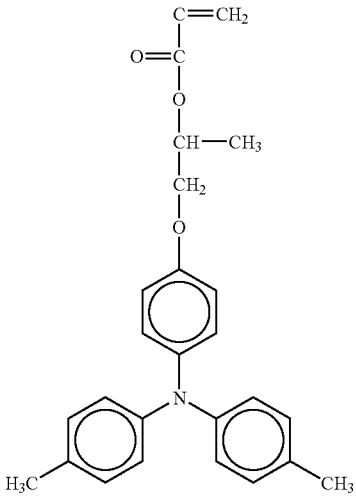
No. 132
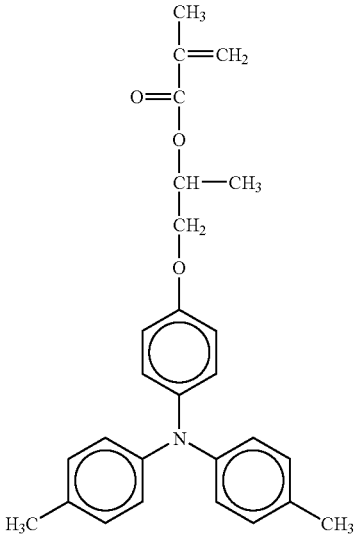
-continued
No. 133
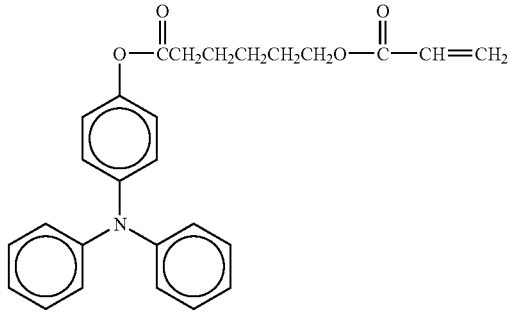
No. 134
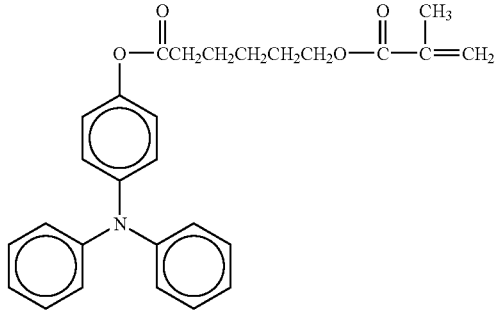
No. 135
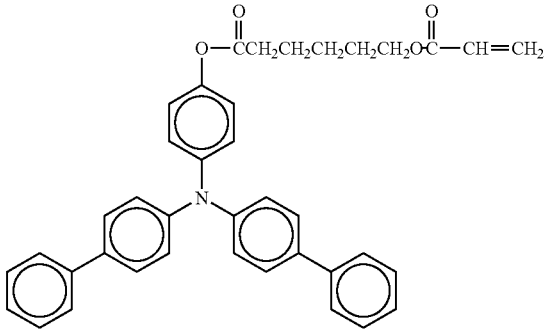
No. 136
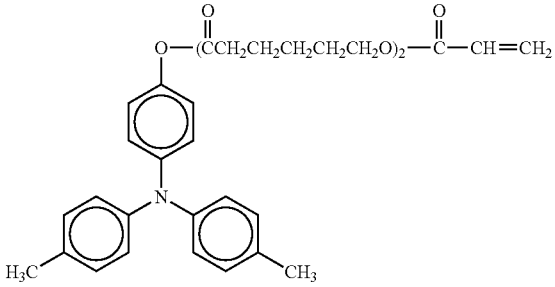

-continued
No. 137
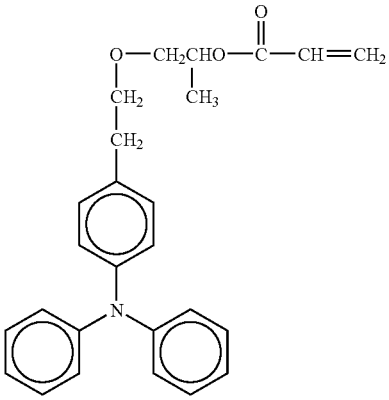
No. 138
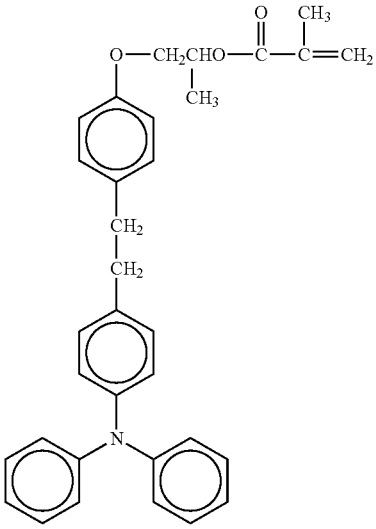
No. 139
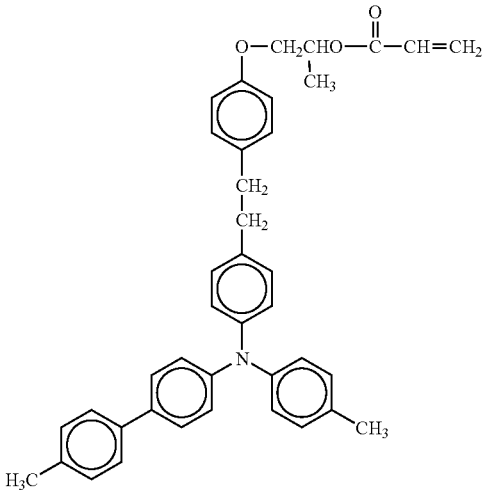
-continued
No. 140
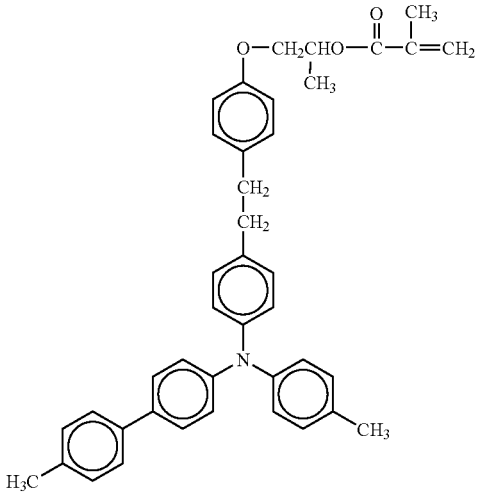
No. 141
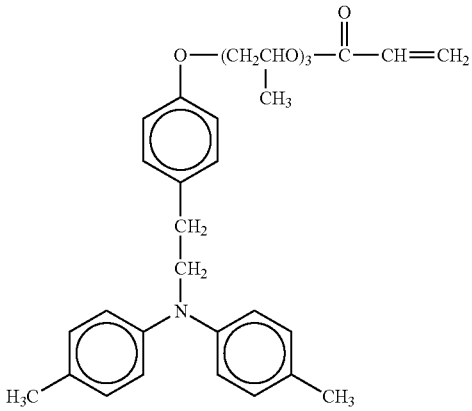
No. 142
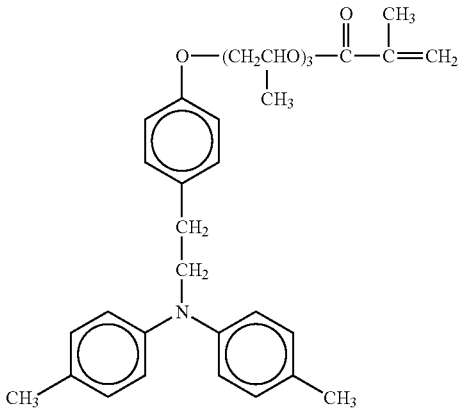

-continued
No. 143
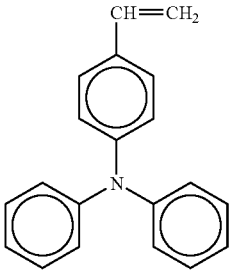
No. 144
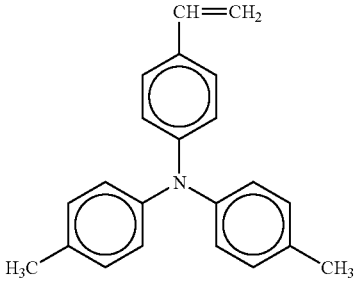
No. 145
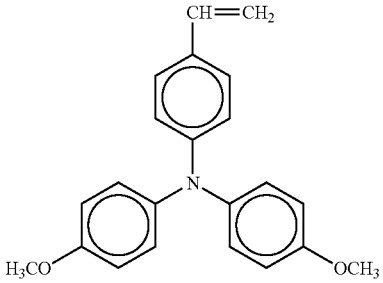
No. 146
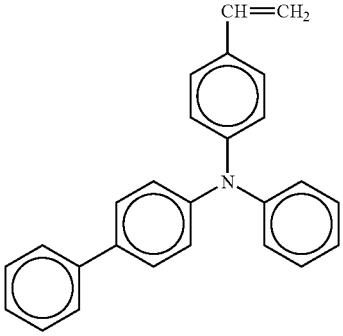
No. 147
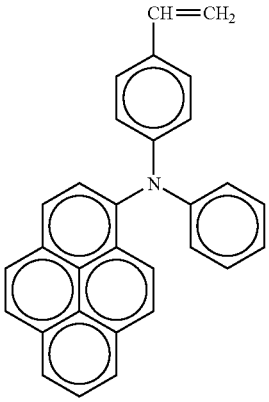
-continued
No. 148
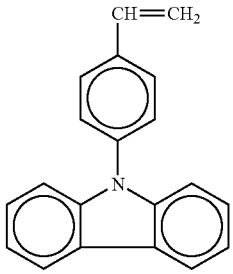
No. 149
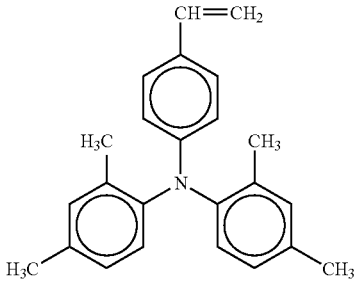
No. 150
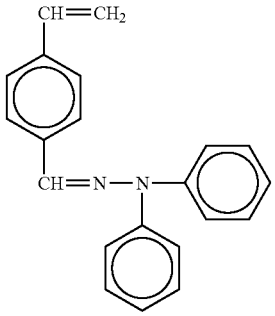
No. 151
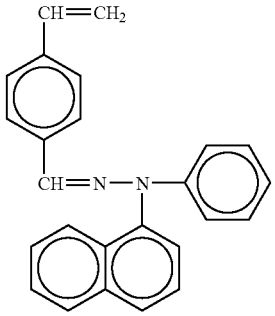
No. 152
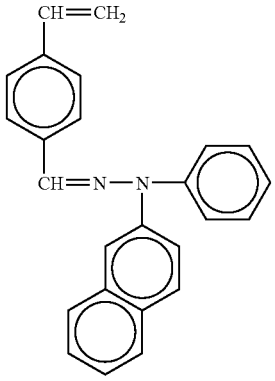

-continued

No. 153

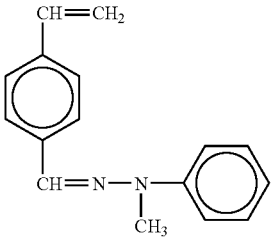

No. 154

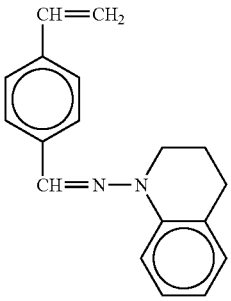

No. 155

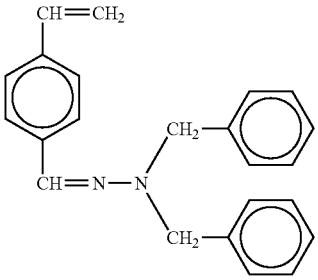

No. 156

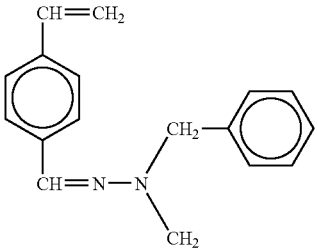

No. 157

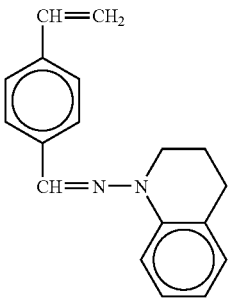

-continued

No. 158

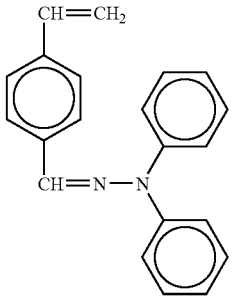

No. 159

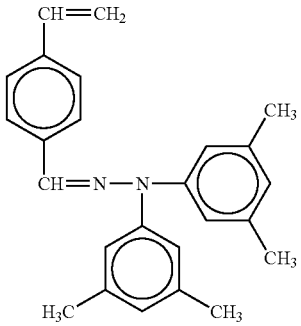

No. 160

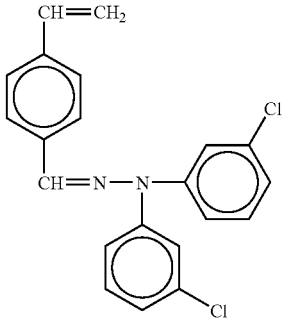

The monofunctional radical polymerizing compound having a charge transport structure for use in the present invention is essential for imparting a charge transportability to the crosslinked CTL, and is preferably included therein in an mount of 20 to 80% by weight, and more preferably from 30 to 70% by weight based on total weight thereof. When less than 20% by weight, the crosslinked CTL cannot maintain the charge transportability, a sensitivity of the resultant photoreceptor deteriorates and a residual potential thereof increases in repeated use. When greater than 80% by weight, a content of the monomer having three or more functional groups without a charge transport structure decreases and the crosslinked density deteriorates, and therefore the resultant photoreceptor does not have a high abrasion resistance. Although it depends on a required abrasion resistance and electrical properties, in consideration of a balance therebetween, a content of the monofunctional radical polymerizing compound having a charge transport structure is most preferably from 30 to 70% by weight.

The crosslinked CTL of the present invention is formed by hardening at least the radical polymerizing monomer having no charge transport structure and three or more functional groups and the monofunctional radical polymerizing compound having a charge transport structure, and can include a monofunctional or bifunctional radical polymerizing monomer and a radical polymerizing oligomer as well to control a viscosity of the layer when coated, reduce a stress of thereof, impart a low surface free energy thereto and reduce friction coefficient thereof. Known radical polymerizing monomers and oligomers can be used.

Specific examples of the monofunctional radical monomer include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the bifunctional radical monomer include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomers include octafluoropentylacrylate, 2-perfluorooctylethylacrylate, 2-perfluorooctylethylmethacrylate, 2-perfluoroisononylethylacrylate, etc., wherein a fluorine atom is substituted; vinyl monomers having a polysiloxane group with a repeat unit of from 20 to 70 disclosed in Japanese Patent Publications Nos. 5-60503 and 6-45770, such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl; acrylate; and methacrylate.

Specific examples of the radical polymerizing oligomer includes epoxyacrylate oligomers, urethaneacrylate oligomers and polyetseracrylate oligomers. However, when the crosslinked CTL includes a large amount of the monofunctional or bifunctional radical polymerizing monomer and radical polymerizing oligomer, the three-dimensional crosslinked bonding density thereof substantially deteriorates, resulting in deterioration of the abrasion resistance thereof. Therefore, the surface layer of the present invention preferably includes the monomers and oligomers in an amount not greater than 50 parts by weight, and more preferably not greater than 30 parts by weight per 100 parts by weight of the radical polymerizing monomer having three or more functional groups.

The crosslinked CTL, wherein at least the radical polymerizing monomer having no charge transport structure and three or more functional groups and the monofunctional radical polymerizing compound having a charge transport structure are hardened, can optionally include a polymerization initiator to effectively proceed the hardening reaction.

Specific examples of heat polymerization initiators include peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydobeloxide and lauroylperoxide; and azo initiators such as azobisisobutylnitrile, azobiscyclohexanecarbonitrile, azobisisomethylbutyrate, azobisisobutylamidinehydorchloride and 4,4'-azobis-4-cyanovaleric acid.

Specific examples of photo polymerization initiators include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone.

These polymerization initiators can be used alone or in combination. The surface layer of the present invention preferably includes the polymerization initiators in an amount of 0.5 to 40 parts by weight, and more preferably from 1 to 20 parts by weight per 100 parts by weight of the radical polymerizing compounds.

Further, a coating liquid for the crosslinked CTL of the present invention may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. A content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. A content thereof is preferably not greater than 3% by weight.

The crosslinked CTL of the present invention is formed by coating and hardening a coating liquid including at least the radical polymerizing monomer having no charge transport structure and three or more functional groups and the monofunctional radical polymerizing compound having a charge transport structure. The coating liquid can include other components when the radical polymerizing monomer is a liquid, and is optionally diluted with a solvent and coated. Specific examples of the solvent include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and Cellosoves such as methyl Cellosolve, ethyl Cellosolve and Cellosolve acetate. These solvents can be used alone or in combination. A dilution ratio with the solvent can optionally be decided upon solubility of the compositions, a coating method and a purposed layer thickness. The crosslinked CTL can be coated by a dip coating method, a spray coating method, a bead coating method, a ring coating method, etc.

In the present invention, after the coating liquid is coated to form layer, an external energy is applied thereto for hardening the layer to form the crosslinked CTL. The external energy includes a heat, a light and a radiation. A heat energy is applied to the layer from the coated side or from the substrate using air, a gaseous body such as nitrogen, a steam, a variety of heating media, infrared or an electromagnetic wave. The heating temperature is preferably from 100 to 170° C. When less than 100° C., the reaction is slow in speed and is not completely finished. When greater than 170° C., the reaction nonuniformly proceeds and a large distortion appears in the crosslinked CTL. To uniformly proceed the hardening reaction, after heated at comparatively a low temperature less than 100° C., the reaction is completed at not less than 100° C. Specific examples of the light energy include UV irradiators such as high-pressure mercury lamps and metal halide lamps having an emission wavelength of UV light; and a visible light source adaptable to absorption wavelength of the radical polymerizing compounds and photo polymerization initiators. An irradiation light amount is preferably from 50 to 1,000 mW/cm$^2$. When less than 50 mW/cm$^2$, the hardening reaction takes time. When greater than 1,000 mW/cm$^2$, the reaction nonuniformly proceeds and the crosslinked CTL has a large surface roughness. The radiation energy includes a radiation energy using an electron beam. Among these energies, the heat and light energies are effectively used because of their simple reaction speed controls and simple apparatuses.

The crosslinked CTL of the present invention preferably has a thickness of from 1 to 10 μm, and more preferably from 2 to 8 μm. When thicker than 10 μm, the layer tends to crack and peel. When not thicker than 8 μm, the crosslinked density can be higher, and further, materials and hardening conditions can be selected to increase the abrasion resistance. The radical polymerization reaction tends to be disturbed with oxygen, i.e., the surface of the crosslinked CTL contacting the atmospheric air is not well crosslinked or nonuniformly crosslinked because of a radical trap of the oxygen. This noticeable appears when less than 1 μm, and the crosslinked CTL having a thickness less than 1 μm tends to have deterioration in its abrasion resistance and nonuniform abrasion. In addition, the underlying CTL components mix in the crosslinked CTL when coated thereon. When the crosslinked CTL is thin, the crosslinked CTL is wholly contaminated with impurities, resulting in inhibition of the hardening reaction and deterioration of the crosslinked density. The crosslinked CTL of the present invention, having a thickness not less than 1 μm, has good abrasion resistance and scratch resistance, however, when locally abraded until the underlying CTL due to repeated use, the locally abraded part of the crosslinked CTL expands and the chargeability and sensitivity of the resultant photoreceptor vary, which tends to produce halftone images having irregular image density. Therefore, the crosslinked CTL preferably has a thickness not less than 2 μm such that the resultant photoreceptor has a longer life and produces higher quality images, including a respect of maintaining the abrasion resistance thereof.

Further, when a CGL, a CTL and a crosslinked CTL are layered in this order, the outermost layer, i.e., the crosslinked CTL is preferably insoluble in an organic solvent in terms of abrasion and scratch resistance. A method of testing the solubility in an organic solvent includes putting a drop of an organic solvent having high solubility for polymer materials such as tetrahydrofuran and dichloromethane on the surface of a photoreceptor; and observing a deformation thereof with a stereoscopic microscope after naturally dried. When soluble, the center of the drop is concave and the circumference thereof is mounded, a CTM separates out and is crystallized to overcloud the surface of a photoreceptor, and wrinkles are formed thereon because of swelling and contracting afterwards. When insoluble, the surface of a photoreceptor is free from these phenomena, and has no deformation as it has before putting the drop thereon.

In order to make the crosslinked CTL insoluble in an organic solvent, (1) controlling the constituents and contents thereof in the crosslinked CTL coating liquid, (2) controlling a diluent solvent and a concentration of solid contents therein, (3) selecting methods of coating the crosslinked CTL coating liquid, (4) controlling the hardening conditions of the crosslinked, (5) making the underlying CTL insoluble, etc. are essential. However, the method is not limited to only one of these.

When an additive such as a binder resin not having a radical polymerizing functional group, an antioxidant and a plasticizer besides the radical polymerizing monomer having no charge transport structure and three or more functional groups and the monofunctional radical polymerizing compound having a charge transport structure is included in the crosslinked CTL coating liquid in a large amount, a phase separation between the hardened material and the additive is formed, resulting in deterioration of the crosslinked density and soluble in an organic solvent. Specifically, it is essential that the additive is included in the coating liquid in an amount of not greater than 20% by weight based on total weight of solid contents therein. In addition, in order not to make the crosslinked density thin, a radical polymerizing monomer having one or two functional groups, a reactive oligomer or a reactive polymer is preferably included therein in an amount not greater than 20% by weight based on total weight of the radical polymerizing monomer having three or more functional groups. When a radical polymerizing compound having two or more functional groups with a charge transport structure is included therein in a large amount, bulky structures plurally bonded and fixed in the crosslinked structure, and therefore the resultant crosslinked CTL tends to become distorted and an aggregation of microscopic hardened materials. This is why the layer is occasionally soluble in an organic solvent. Although depending on the structure of the compound, the radical polymerizing compound having two or more functional groups with a charge transport structure is preferably included therein in an amount not greater than 10% by weight based on total weight of the monofunctional radical polymerizing compound having a charge transport structure.

When a solvent having a low evaporation rate is used as the diluent solvent for the crosslinked CTL coating liquid, a residual solvent prevents the hardening reaction and increases a mixed amount of the underlayer components, resulting in nonuniform crosslink and deterioration of crosslinked density. This is why the layer is liable to be soluble in an organic solvent. Specifically, tetrahydrofuran, a mixed solvent of tetrahydrofuran and methanol, ethyl acetate, methyl ethyl ketone, ethyl cellosolve, etc. are effectively used, and selected according to the coating method. When a concentration of solid contents is too low, the resultant layer is liable to be soluble in an organic solvent. A maximum concentration thereof is limited by limitations of the thickness of the layer and the viscosity of the coating liquid. Specifically, the solid contents are preferably included in the coating liquid in an amount of from 10 to 50% by weight. The coating liquid preferably includes a solvent as little as possible, and the underlayer preferably contacts the solvent for as short as possible. Specifically, a spray coating method and a ring coating method regulating an amount of the coating liquid are preferably used. In order to prevent the underlayer components from mixing in the crosslinked CTL, the CTL (underlayer) effectively includes a charge transport polymer material or an intermediate layer insoluble in the solvent used in the crosslinked CTL coating liquid is effectively formed therebetween.

The crosslinked CTL is not completely hardened when the heat or light irradiation energy is low, and is more soluble in an organic solvent. When hardened with a very high energy, the crosslinked CTL is nonuniformly hardened, wherein an uncrosslinked part and a radical discontinuation part increase, and is liable to have an aggregation of microscopic hardened materials. Therefore, the crosslinked CTL is occasionally soluble in an organic solvent. The crosslinked CTL is preferably hardened with a heat at from 100 to 170° C. for 10 min to 3 hrs, or with UV light irradiation at from 50 to 1,000 mW/cm$^2$ for 5 sec to 5 min, and at not higher than 50° C.

In order to form a crosslinked CTL insoluble in an organic solvent, an acrylate monomer having three acryloyloxy groups and a triarylamine compound having one acryloyloxy group are mixed at a ratio (acrylate monomer having three acryloyloxy groups/a triarylamine compound having one acryloyloxy group) of from 7/3 to 3/7 to prepare a mixture; a polymerization initiator is added thereto in an amount of from 3 to 20% by weight based on total weight thereof to prepare another mixture; and a solvent is added thereto to prepare a coating liquid. For example, when an underlayer of the crosslinked CTL, i.e., the CTL includes a triarylamine donor as a charge transport material and a polycarbonate resin as a binder resin, and the coating liquid is sprayed thereon, the solvent is preferably tetrahydrofuran, 2-butanone, ethylacetate, etc., in an amount of 3 to 10 times as much as the total weight of the mixture of the acrylate monomer having three acryloyloxy groups and the triarylamine compound having one acryloyloxy group.

On a substrate such as an aluminum cylinder, an undercoat layer, a CGL and a CTL are layered in this order to prepare a photoreceptor, and the coating liquid is sprayed thereon. Then, the photoreceptor is dried naturally or at comparatively a low temperature for a short time, i.e., at 25 to 80° C. for 1 to 10 min, and is irradiated with UV light or heated to harden the coated layer thereof.

A metal halide lamp, or the like, is preferably used to irradiate the UV light at an illuminance of from 50 to 1,000 mW/cm$^2$. For example, when the UV light having an illuminance of 500 mW/cm$^2$ is irradiated onto the photoreceptor (drum), plural lamps may circumferentially irradiate the drum for about 30 sec, seeing that the drum does not have a temperature higher than 50° C.

When heated, the heating temperature is preferably from 100 to 170° C., and an oven blower, or the like, is used as a heater. When the heating temperature is 150° C., the heating time is from 20 min to 3 hrs.

After hardened, further heated at from 100 to 150° C. for 10 to 30 min to reduce the residual solvent.

Thus, the electrophotographic photoreceptor of the present invention is prepared.

Next, the image forming apparatus of the present invention will be explained in detail, referring to the drawings.

Figure 3:
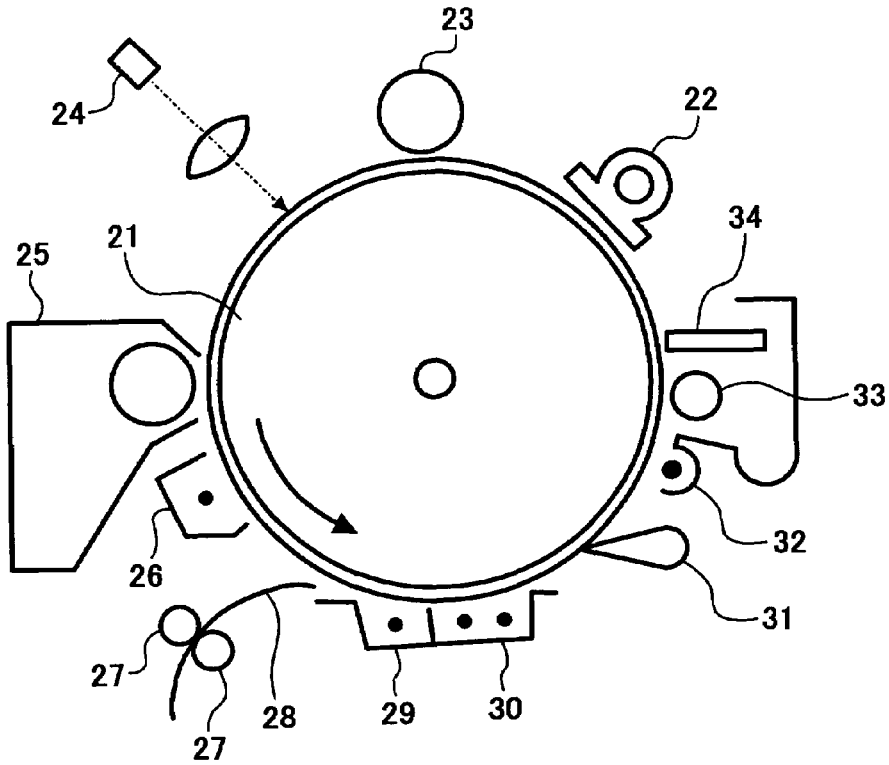
FIG. 3 is a schematic view illustrating a partial cross-section of an embodiment of the image forming apparatus of the present invention.

FIG. 3 is a schematic view illustrating a partial cross-section of an embodiment of the image forming apparatus of the present invention, and the following modified example is in scope of the present invention.

In FIG. 3, a photoreceptor (21) includes at least a double-layered undercoat layer including at least a layer including a metal oxide and another layer including no metal oxide, and a photosensitive layer on an electroconductive substrate. The photoreceptor (21) has the shape of a drum, and may have the shape of a sheet or an endless belt. Known chargers such as corotrons, scorotrons, solid state chargers, charging rollers and transfer rollers can be used for a charging roller (23), a pre-transfer charger (26), a transfer charger (29), a separation charger (30) and a ore-cleaning charger (32).

Figure 4:
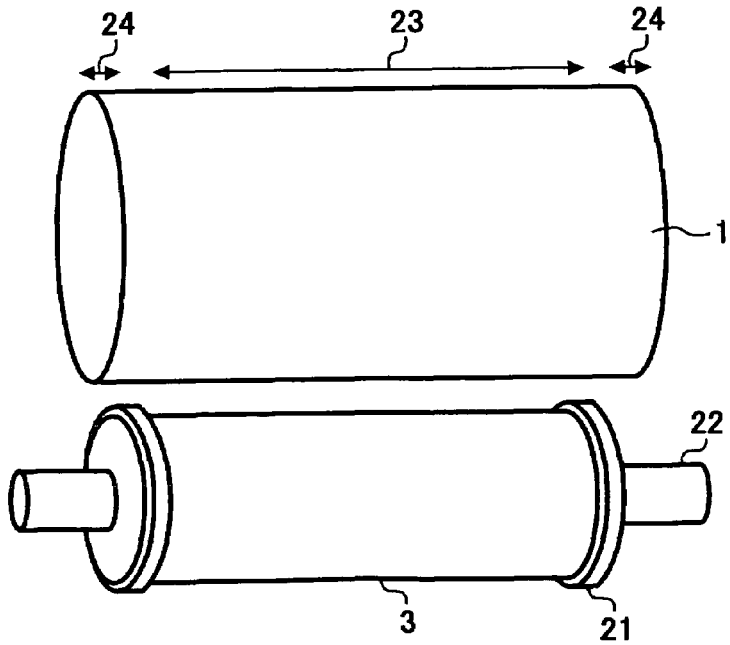
FIG. 4 is a schematic view illustrating a non-contact charger for use in the present invention.

Preferred charging methods include known corona charging methods using the scorotron; contact charging methods of contacting a charging roller or a charging brush to a photoreceptor; and non-contact charging methods wherein a charger and a photoreceptor are placed to have a gap not greater than 200 μm, and preferably not greater than 100 μm as shown in FIG. 4, wherein numeral 1 is a photoreceptor, 3 is charging roller, 21 is a gap former, 22 is a metallic shaft, 23 is an image forming area and 24 is a non-image forming area. These charging methods have disadvantages of causing a dielectric breakdown of the photoreceptor because of applying a high-voltage thereto, however, the photoreceptor of the present invention has quite a high pressure resistance because of having plural undercoat layers. Therefore, the photoreceptor is resistant to the dielectric breakdown and has a longer life. In addition, a DC voltage overlapped with an AC voltage can be applied the charger to prevent irregular charge.

In a conventional image forming apparatus, an electric field intensity applied to a photoreceptor is set low, not greater than 40 V/μm and preferably not greater than 30 V/μm, to prevent the background fouling. This is because the background fouling is dependent on the electric field intensity and the probability of the background fouling increases when the electric field intensity increases. However, such a low electric field intensity deteriorates photocarrier generation efficiency and photosensitivity. In addition, since the electric field intensity between the surface of the photoreceptor and electroconductive substrate is low, the straightness of the photocarrier generated in the photosensitive layer deteriorates and the photocarrier is scattered due to clone repulsion, resulting in deterioration of image resolution. However, the electric field intensity applied to the photoreceptor of the present invention, considerably preventing the background fouling, need not be lower than necessary, and even a electric field intensity not less than 40 V/μm can be applied thereto.

A light source such as a laser emitting diode (LED), a laser diode (LD) and an electroluminescence (EL) having a high brightness is used for an irradiator (24).

Suitable light sources for use in a discharging lamp (22) include general light-emitting materials such as fluorescent lamps, tungsten lamps, halogen lamps, mercury lamps, sodium lamps, LEDs, LDs, light sources using electroluminescence (EL), etc. In addition, in order to obtain light having a desired wave length range, filters such as sharp-cut filters, band pass filters, near-infrared cutting filters, dichroic filters, interference filters, color temperature converting filters, etc. can be used.

Particularly, the laser emitting diode (LED) and laser diode (LD) having a high irradiating energy and a long wavelength of from 600 to 800 nm are preferably used for the phthalocyanine pigment having a specific crystal form and high sensitivity for use in the present invention.

The above-mentioned light sources can be used for not only the process illustrated in FIG. 3, but also other processes such as a transfer process, a discharging process, a cleaning process, a pre-exposure process including light irradiation to the photoreceptor.

When a toner image formed on the photoreceptor (21) by a developing unit (25) is transferred onto a transfer sheet (28), all of the toner image is not transferred thereto, and a residual toner remains on the surface of the photoreceptor (21). The residual toner is removed therefrom by a fur brush (33) and a cleaning blade (34). The residual toner remaining on the photoreceptor 1 can be removed by only a cleaning brush. Suitable cleaning brushes include known cleaning brushes such as fur brushes and mag-fur brushes.

When the photoreceptor positively (or negatively) charged is exposed to imagewise light, an electrostatic latent image having a positive (or negative) charge is formed on the photoreceptor. When the latent image having a positive (or negative) charge is developed with a toner having a negative (or positive) charge, a positive image can be obtained. In contrast, when the latent image having a positive (negative) charge is developed with a toner having a positive (negative) charge, a negative image can be obtained. As the developing method, known developing methods can be used.

Figure 5:
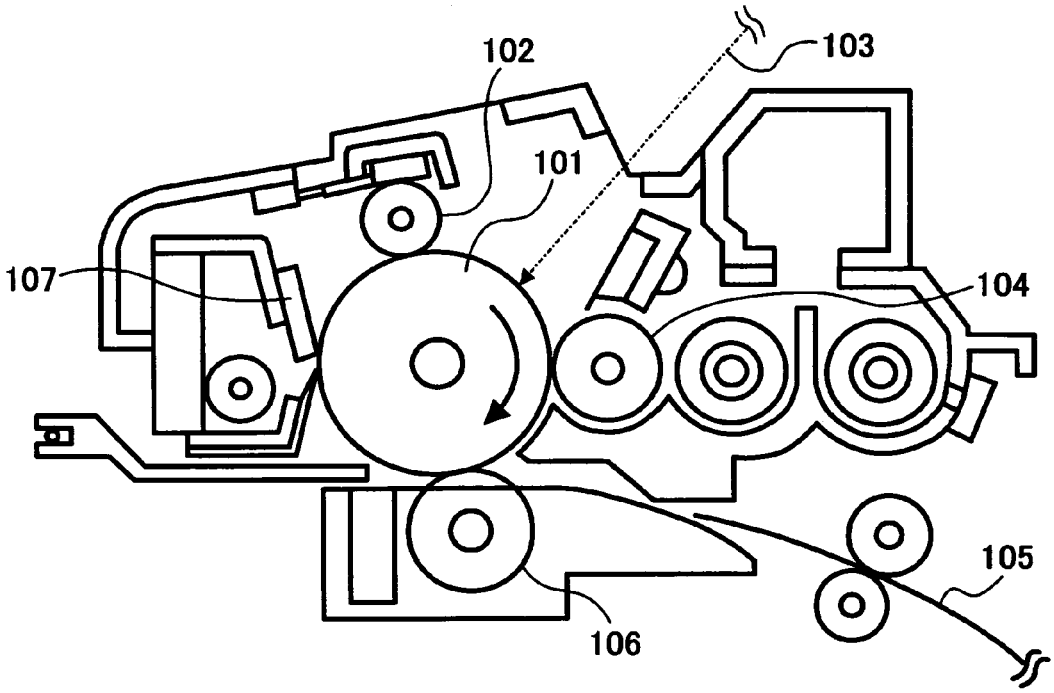
FIG. 5 is a schematic view illustrating a cross-section of an embodiment of the process cartridge detachable from an image forming apparatus of the present invention.

The above-mentioned image forming units may be fixedly set in a copier, a facsimile or a printer. However, the image forming units may be set therein as a process cartridge. The process cartridge means an image forming unit (or device) including at least a photoreceptor; and one of a charger, an imagewise light irradiator, an image developer, an image transferer and a cleaner. Various process cartridges can be used in the present invention. FIG. 5 illustrates an embodiment of the process cartridge, wherein a photoreceptor drum (101) rotates in the direction indicated by an arrow, and a charger (102), an irradiator (103), an image developer (104), a transferer (106) and a cleaner (107) are located around the photoreceptor drum (101), and a transfer sheet (105) is fed thereto. The photoreceptor drum (101) includes at least plural undercoat layers and a photosensitive layer on an electroconductive substrate.

Figure 6:
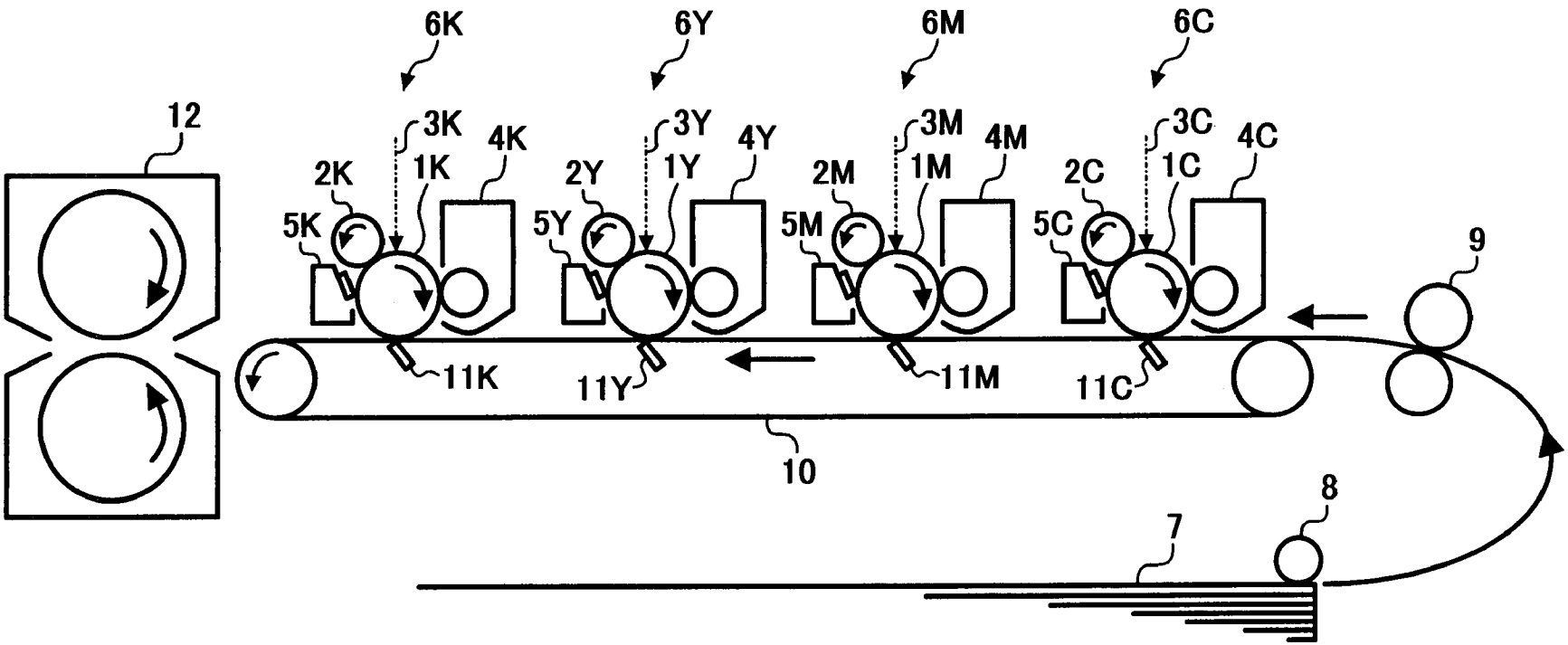
FIG. 6 is a schematic view illustrating an embodiment of the tandem full-color image forming apparatus of the present invention.

FIG. 6 is a schematic view illustrating an embodiment of the tandem full-color image forming apparatus of the present invention, and the following modified example is in scope of the present invention.

In FIG. 6, numerals 1C, 1M, 1Y and 1K represent drum-shaped photoreceptors, and they are the photoreceptors of the present invention.

The photoreceptors 1C, 1M, 1Y and 1K rotate in the direction indicated by an arrow, and around them, chargers 2C, 2M, 2Y and 2K; image developers 4C, 4M, 4Y and 4*k*; and cleaners 5C, 5M, 5Y and 5K are arranged in a rotation order thereof. The chargers 2C, 2M, 2Y and 2K uniformly charge surfaces of the photoreceptors.

Laser beams 3C, 3M, 3Y and 3K from irradiators (not shown) irradiate the surfaces of the photoreceptors between the chargers 2C, 2M, 2Y and 2K and image developers 4C, 4M, 4Y and 4*k* to form electrostatic latent images on the surfaces of the photoreceptors 1C, 1M, 1Y and 1K.

Four image forming units 6C, 6M, 6Y and 6K including the photoreceptors 1C, 1M, 1Y and 1K are arranged along a transfer feeding belt 10 feeding a transfer material. The transfer feeding belt 10 contacts the photoreceptors 1C, 1M, 1Y and 1K between the image developers 4C, 4M, 4Y and 4*k* and cleaners 5C, 5M, 5Y and 5K of the image forming units 6C, 6M, 6Y and 6K. Transfer brushes 11*c*, 11M, 11Y and 11K are arranged on a backside of the transfer feeding belt 10, which is an opposite side to the photoreceptors, to apply a transfer bias to the transfer feeding belt 10. The image forming units 6C, 6M, 6Y and 6K just handle different color toners respectively, and have the same structures.

In the full-color electrophotographic apparatus in FIG. 6, images are formed as follows. First, in the image forming units 6C, 6M, 6Y and 6K, the photoreceptors 1C, 1M, 1Y and 1K are charged by the chargers 2C, 2M, 2Y and 2K rotating in the same direction of the photoreceptors. Next, the laser beams 3C, 3M, 3Y and 3K from irradiators (not shown) irradiate the surfaces of the photoreceptors to form electrostatic latent images having different colors respectively thereon. Then, the image developers 4C, 4M, 4Y and 4*k* develop the electrostatic latent images to form toner images.

Next, the image developers 4C, 4M, 4Y and 4*k* develop the electrostatic latent images with toners having a cyan color C, a magenta color M, a yellow color Y and a black color K respectively. The color toner images respectively formed on the photoreceptors 1C, 1M, 1Y and 1K are overlaid on a transfer sheet 7. The transfer sheet 7 is fed by a paper feeding roller 8 from a tray and stopped once by a pair of resist rollers 9, and fed onto the transfer feeding belt 10 in timing with formation of the toner images on the photoreceptors. The transfer sheet 7 borne by the transfer feeding belt 10 is transferred to the contact (transfer) position of each photoreceptor 1C, 1M, 1Y and 1K, where each color toner image is transferred onto the transfer sheet 7.

The toner images on the photoreceptors are transferred to the transfer sheet 7 by an electric field formed with a potential difference between the transfer bias applied by the transfer brushes 11*c*, 11M, 11Y and 11K and the photoreceptors 1C, 1M, 1Y and 1K. The transfer sheet 7 having passed the four transfer positions and bearing the four color toner images overlaid thereon is fed to a fixer 12 fixing the toner images on the transfer sheet. The transfer sheet 7 on which the toner images are fixed is fed onto a sheet receiver (not shown). Residual toners remaining on the photoreceptors 1C, 1M, 1Y and 1K, which were not transferred on the transfer sheet at the transfer position are collected by the cleaners 5C, 5M, 5Y and 5K.

In an embodiment in FIG. 6, the image forming units are lined in order of C, M, Y and K from an upstream to a downstream of feeding direction of the transfer sheet. However, the order is not limited thereto and the color orders are optional. When only a black image is produced, the image forming units 6C, 6M and 6Y except for 6K can be stopped in the apparatus of the present invention. In FIG. 6, the charger contacts the photoreceptor, however, a gap therebetween of from 10 to 200 μm can decrease an abrasion amount thereof and toner film over the charger.

The above-mentioned image forming units may be fixedly set in a copier, a facsimile or a printer. However, the image forming units may be set therein as a process cartridge. The process cartridge means an image forming unit (or device) including at least a photoreceptor; and one of a charger, an imagewise light irradiator, an image developer, an image transferer and a cleaner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The monofunctional compound having a charge transport structure of the present invention is synthesized by, e.g., a method disclosed in Japanese Patent No. 3164426. The following method is one of the examples thereof.

(1) Synthesis of a Hydroxy Group Substituted Triarylamine Compound Having the Following Formula B 113.85 g (0.3 mol) of a methoxy group substituted triarylamine compound having the formula A, 138 g (0.92 mol) of sodium iodide and 240 ml of sulfolane were mixed to prepare a mixture. The mixture was heated to have a temperature of 60° C. in a nitrogen stream. 99 g (0.91 mol) of trimethylchlorosilane were dropped therein for 1 hr and the mixture was stirred for 4 hrs at about 60° C. About 1.5 L of toluene were added thereto and the mixture was cooled to have a room temperature, and repeatedly washed with water and an aqueous solution of sodium carbonate. Then, a solvent removed therefrom and refined by a column chromatographic process using silica gel as an absorption medium, and toluene and ethyl acetate (20-to-1) as a developing solvent. Cyclohexane was added to the thus prepared buff yellow oil to separate a crystal out. Thus, 88.1 g (yield of 80.4%) of a white crystal having the following formula B and a melting point of from 64.0 to 66.0° C. was prepared. The Element analytical values thereof are shown in Table 1.

TABLE 1

A

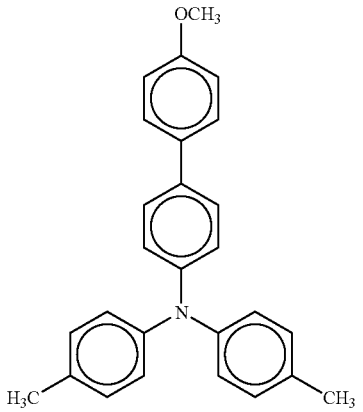

B

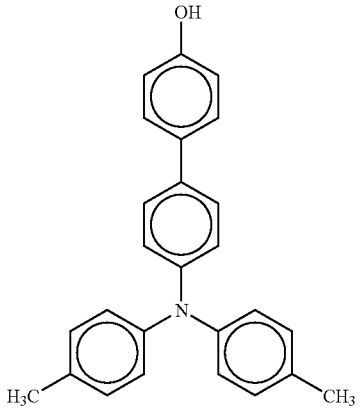

| | Element analytical value (%) | | |
|---|---|---|---|
| | C | H | N |
| Actual measurement | 85.06 | 6.41 | 3.73 |
| Calculated value | 85.44 | 6.34 | 3.83 |

(2) A Triarylamino Group Substituted Acrylate Compound (Compound No. 54)

82.9 g (0.227 mol) of the hydroxy group substituted triarylamine compound having the formula B prepared in (1) were dissolved in 400 ml of tetrahydrofuran to prepare a mixture, and an aqueous solution of sodium hydrate formed of 12.4 g of NaOH and 100 mil of water was dropped therein in a nitrogen stream. The mixture was cooled to have a temperature of 5° C., and 25.2 g (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent removed therefrom and refined by a column chromatographic process using silica gel as an absorption medium and toluene as a developing solvent. N-hexane was added to the thus prepared colorless oil to separate a crystal out. Thus, 80.73 g (yield of 84.8%) of a white crystal of the compound No. 54 having a melting point of from 117.5 to 119.0° C. was prepared. The Element analytical values thereof are shown in Table 2.

TABLE 2

| | Element analytical value (%) | | |
|---|---|---|---|
| | C | H | N |
| Actual measurement | 83.13 | 6.01 | 3.16 |
| Calculated value | 83.02 | 6.00 | 3.33 |

Example 1

An undercoat layer 1 coating liquid 1, an undercoat layer 2 coating liquid, a CGL coating liquid and a CTL coating liquid having the following formulations were coated and dried in this order on an aluminium cylinder having a diameter of 100 mm to prepare an electrophotographic photoreceptor 1 having an undercoat layer 1 0.7 μm thick, an undercoat layer 2 and a CGL of 3.5 μm thick, and a CTL of 28 μm thick. Each layer was dried to the touch after coated, and further dried with heat at 130, 140, 90 and 135° C. respectively.

Undercoat Layer 1 Coating Liquid

| | |
|---|---|
| N-methoxymethylated nylon (FR101 from Namariichi Co., Ltd.) | 5 |
| Methanol | 70 |
| n-butanol | 30 |

Undercoat Layer 2 Coating Liquid

| | |
|---|---|
| Titanium oxide (CR-EL from Ishihara Sangyo Kaisha, Ltd., having a purity of 99.7%, an average primary particle diameter about 0.25 μm and specific resistivity of $3.5 \times 10^9$ Ω · cm) | 70 |
| Alkyd resin (Bekkolite M6401-50 from Dainippon Ink And Chemicals, inc., having a solid content of 50% and a hydroxyl value of 130) | 14 |
| Block isocyanate resin (Burnock B7-887-60 from Dainippon Ink And Chemicals, inc., having a solid content of 60%) | 8 |
| 2-butanone | 90 |

The metal oxide to the alkyd resin is about 2/1 in content ratio. The alkyd resin to the block isocyanate resin is about 1.5/1 in weight ratio.

CGL Coating Liquid

Figure 7:
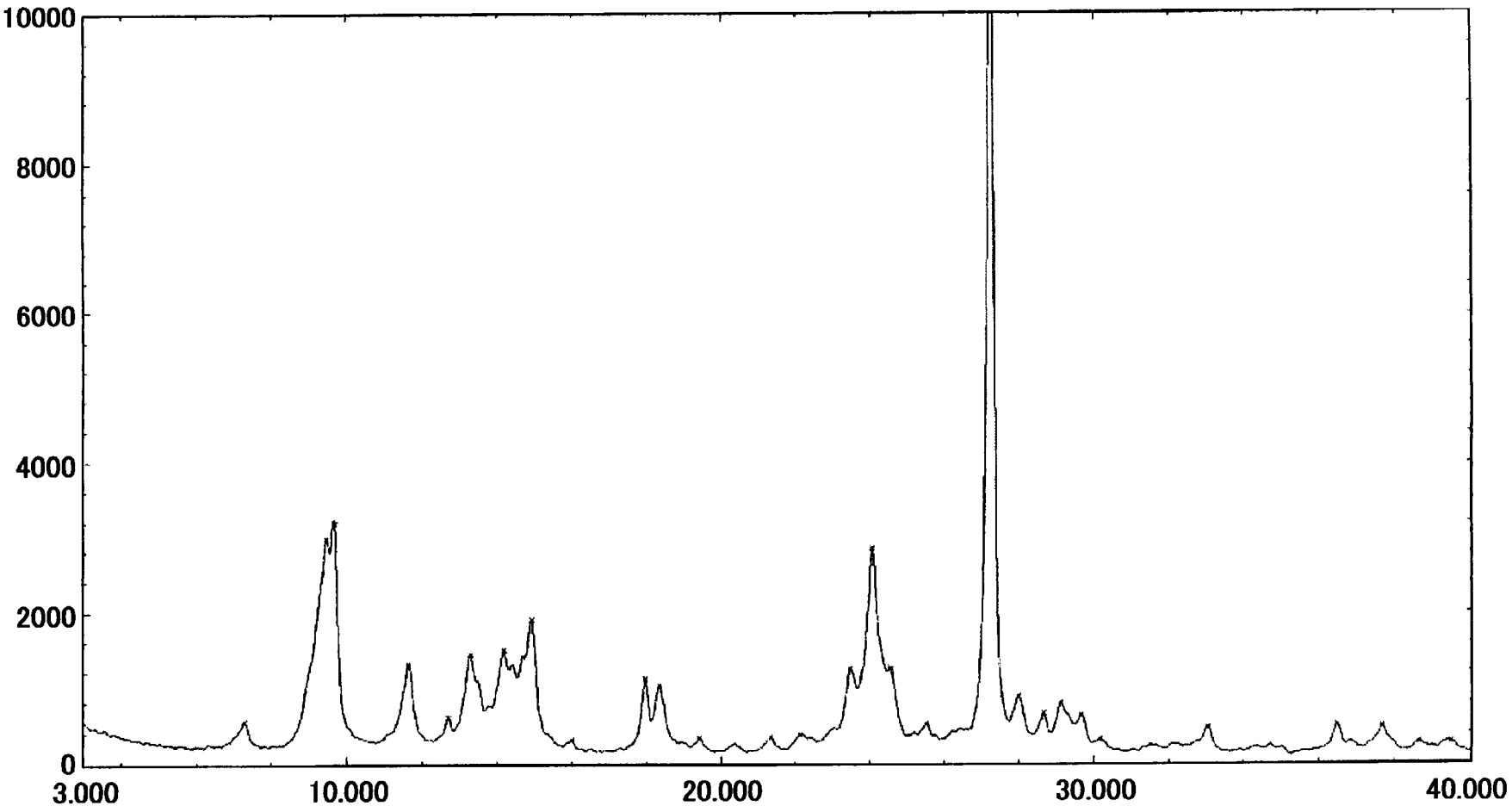
FIG. 7 is a X-ray diffraction spectrum of the titanylphthalocyanine crystal for use in Example 1 of the present invention.

| | |
|---|---|
| Titanylphthalocyanine shown in XD spectrum in FIG. 7 | 8 |
| Polyvinylbutyral (BX-1 from Sekisui Chemical Co., Ltd.) | 5 |
| 2-butanone | 400 |

CTL Coating Liquid

| | |
|---|---|
| Polycarbonate (TS2050 from Teijin Chemicals Ltd.) | 10 |
| CTM having the following formula | 7 |

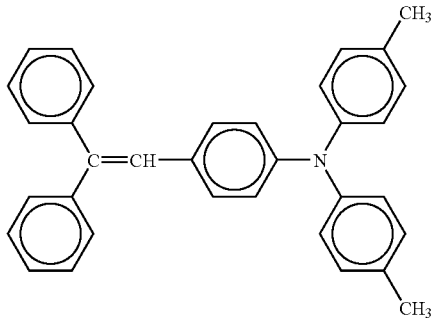

| | |
|---|---|
| Tetrahydrofuran | 100 |
| Tetrahydrofuran solution of silicone oil (KF-50 from Shin-Etsu Chemical Co., Ltd., having a dynamic viscosity of 100 cs) | 0.2 |

Example 2

The procedure for preparation of the electrophotographic photoreceptor 1 in Example 1 was repeated to prepare an electrophotographic photoreceptor 2 except for replacing the undercoat layer 2 coating liquid with a coating liquid having the following formulation.

Undercoat Layer 2 Coating Liquid

| | |
|---|---|
| Titanium oxide (CR-EL from Ishihara Sangyo Kaisha, Ltd., having a purity of 99.7%, an average primary particle diameter about 0.25 μm and specific resistivity of $3.5 \times 10^9$ Ω · cm) | 80 |
| Alkyd resin (Bekkolite M6163-60 from Dainippon Ink And Chemicals, inc., having a solid content of 60% and a hydroxyl value of 70) | 12 |
| Block isocyanate resin (Burnock B3-867 from Dainippon Ink And Chemicals, inc., having a solid content of 70%) | 10 |
| 2-butanone | 100 |

The metal oxide to the alkyd resin is about 1.9/1 in content ratio. The alkyd resin to the block isocyanate resin is about 1/1 in weight ratio.

Example 3

The procedure for preparation of the electrophotographic photoreceptor 1 in Example 1 was repeated to prepare an electrophotographic photoreceptor 3 except for replacing the undercoat layer 2 coating liquid with a coating liquid having the following formulation.

Undercoat Layer 2 Coating Liquid

| | |
|---|---|
| Zinc oxide (SAZEX 2000 from SAKAI CHEMICAL INDUSTRY CO., LTD., having a purity of 99.8%, an average primary particle diameter about 0.6 μm and specific resistivity of $5.4 \times 10^7$ Ω · cm) | 80 |
| Alkyd resin (Bekkolite M6401-50 from Dainippon Ink And Chemicals, inc., having a solid content of 50% and a hydroxyl value of 130) | 20 |
| Block isocyanate resin (Burnock B7-887-60 from Dainippon Ink And Chemicals, inc., having a solid content of 60%) | 10 |
| 2-butanone | 100 |

The metal oxide to the alkyd resin is about 1.3/1 in content ratio. The alkyd resin to the block isocyanate resin is about 1.7/1 in weight ratio.

Example 4

The procedure for preparation of the electrophotographic photoreceptor 1 in Example 1 was repeated to prepare an electrophotographic photoreceptor 4 except for replacing the undercoat layer 2 coating liquid with a coating liquid having the following formulation.

Undercoat Layer 2 Coating Liquid

| | |
|---|---|
| Aluminum oxide (Advanced Alumina AA-03 from Sumitomo Chemical Co., Ltd., having a purity of 99.9%, an average primary particle diameter about 0.3 μm and specific resistivity of $1.6 \times 10^7$ Ω · cm) | 90 |
| Alkyd resin (Bekkolite M6163-60 from Dainippon Ink And Chemicals, inc., having a solid content of 60% and a hydroxyl value of 70) | 14 |
| Block isocyanate resin (Burnock B7-887-60 from Dainippon Ink And Chemicals, inc., having a solid content of 60%) | 13 |
| 2-butanone | 110 |

The metal oxide to the alkyd resin is about 2.1/1 in content ratio. The alkyd resin to the block isocyanate resin is about 0.9/1 in weight ratio.

Example 5

The procedure for preparation of the electrophotographic photoreceptor 1 in Example 1 was repeated to prepare an electrophotographic photoreceptor 5 except for replacing the undercoat layer 2 coating liquid with a coating liquid having the following formulation.

Undercoat Layer 2 Coating Liquid

| | |
|---|---|
| Titanium oxide (CR97 from Ishihara Sangyo Kaisha, Ltd., having a purity of 93%, an average primary particle diameter about 0.3 μm and specific resistivity of $6.6 \times 10^8$ Ω · cm) | 70 |
| Alkyd resin (Bekkolite M6163-60 from Dainippon Ink And Chemicals, inc., having a solid content of 60% and a hydroxyl value of 70) | 16 |
| Block isocyanate resin (Burnock B7-887-60 from Dainippon Ink And Chemicals, inc., having a solid content of 60%) | 6 |
| 2-butanone | 90 |

The metal oxide to the alkyd resin is about 2/1 in content ratio. The alkyd resin to the block isocyanate resin is about 2.2/1 in weight ratio.

Example 6

The procedure for preparation of the electrophotographic photoreceptor 1 in Example 1 was repeated to prepare an electrophotographic photoreceptor 6 except for replacing the undercoat layer 2 coating liquid with a coating liquid having the following formulation.

Undercoat Layer 2 Coating Liquid

| | |
|---|---|
| Titanium oxide (CR-EL from Ishihara Sangyo Kaisha, Ltd., having a purity of 99.7%, an average primary particle diameter (D1) about 0.25 μm and specific resistivity of $3.5 \times 10^9$ Ω · cm) | 50 |
| Titanium oxide (PT-401M from Ishihara Sangyo Kaisha, Ltd., having a purity of 99.9%, an average primary particle diameter about 0.07 μm (D2) and specific resistivity of $6.2 \times 10^7$ Ω · cm) | 30 |
| Alkyd resin (Bekkolite M6401-50 from Dainippon Ink And Chemicals, inc., having a solid content of 50% and a hydroxyl value of 130) | 16 |
| Block isocyanate resin (Burnock B7-887-60 from Dainippon Ink And Chemicals, inc., having a solid content of 60%) | 9 |
| 2-butanone | 90 |

The metal oxide to the alkyd resin is about 2/1 in content ratio. The alkyd resin to the block isocyanate resin is about 1.5/1 in weight ratio. D2/D1 is 0.28 and PT-401M/CR-EL+PT-401M is about 0.38.

Example 7

The procedure for preparation of the electrophotographic photoreceptor 1 in Example 1 was repeated to prepare an electrophotographic photoreceptor 7 except for replacing the undercoat layer 2 coating liquid with a coating liquid having the following formulation.

Undercoat Layer 2 Coating Liquid

| | |
|---|---|
| Titanium oxide (CR-EL from Ishihara Sangyo Kaisha, Ltd., having a purity of 99.7%, an average primary particle diameter (D1) about 0.25 μm and specific resistivity of $3.5 \times 10^9$ Ω · cm) | 10 |
| Titanium oxide (PT-401M from Ishihara Sangyo Kaisha, Ltd., having a purity of 99.9%, an average primary particle diameter about 0.07 μm (D2) and specific resistivity of $6.2 \times 10^7$ Ω · cm) | 70 |
| Alkyd resin (Bekkolite M6401-50 from Dainippon Ink And Chemicals, inc., having a solid content of 50% and a hydroxyl value of 130) | 16 |
| Block isocyanate resin (Burnock B7-887-60 from Dainippon Ink And Chemicals, inc., having a solid content of 60%) | 9 |
| 2-butanone | 90 |

The metal oxide to the alkyd resin is about 2/1 in content ratio. The alkyd resin to the block isocyanate resin is about 1.5/1 in weight ratio. D2/D1 is 0.28 and PT-401M/CR-EL+PT-401M is about 0.13.

Example 8

The procedure for preparation of the electrophotographic photoreceptor 1 in Example 1 was repeated to prepare an electrophotographic photoreceptor 8 except for replacing the undercoat layer 2 coating liquid with a coating liquid having the following formulation.

Undercoat Layer 2 Coating Liquid

| | |
|---|---|
| Titanium oxide (CR-EL from Ishihara Sangyo Kaisha, Ltd., having a purity of 99.7%, an average primary particle diameter (D1) about 0.25 μm and specific resistivity of $3.5 \times 10^9$ Ω · cm) | 80 |
| Alkyd resin (ARAKYD 9103 from Arakawa Chemical Industries, Ltd., having a solid content of 60% and a hydroxyl value of 57) | 16 |
| Block isocyanate resin (Burnock B7-887-60 from Dainippon Ink And Chemicals, inc., having a solid content of 60%) | 9 |
| 2-butanone | 90 |

The metal oxide to the alkyd resin is about 2/1 in content ratio. The alkyd resin to the block isocyanate resin is about 1.5/1 in weight ratio.

Example 9

The procedure for preparation of the electrophotographic photoreceptor 1 in Example 1 was repeated to prepare an electrophotographic photoreceptor 9 except for replacing the undercoat layer 1 coating liquid with a coating liquid having the following formulation.

Undercoat Layer 1 Coating Liquid

| | |
|---|---|
| Copolymer nylon (AMILAN from Toray Industries, Inc.) | 5 |
| Methanol | 70 |
| n-butanol | 30 |

Example 10

The procedure for preparation of the electrophotographic photoreceptor 1 in Example 1 was repeated to prepare an electrophotographic photoreceptor 10 except for making the undercoat layer 1 have a thickness of 1.2 μm.

Example 11

The procedure for preparation of the electrophotographic photoreceptor 1 in Example 1 was repeated to prepare an electrophotographic photoreceptor 10 except for making the undercoat layer 1 have a thickness of 2.0 μm.

Example 12

The procedure for preparation of the electrophotographic photoreceptor 1 in Example 1 was repeated to prepare an electrophotographic photoreceptor 12 except for replacing the undercoat layer 1 coating liquid with a coating liquid having the following formulation.

Undercoat Layer 1 Coating Liquid

| | |
|---|---|
| Alkyd resin (Bekkolite M6401-50 from Dainippon Ink And Chemicals, inc., having a solid content of 50% and a hydroxyl value of 130) | 4 |
| Block isocyanate resin (Burnock B7-887-60 from Dainippon Ink And Chemicals, inc., having a solid content of 60%) | 2 |
| 2-butanone | 120 |

Comparative Example 1

The procedure for preparation of the electrophotographic photoreceptor 1 in Example 1 was repeated to prepare an electrophotographic photoreceptor 13 except for not forming the undercoat layer 1.

Comparative Example 2

The procedure for preparation of the electrophotographic photoreceptor 1 in Example 1 was repeated to prepare an electrophotographic photoreceptor 14 except for not forming the undercoat layer 2.

Comparative Example 3

The procedure for preparation of the electrophotographic photoreceptor 1 in Example 1 was repeated to prepare an electrophotographic photoreceptor 15 except for forming neither the undercoat layer 1 nor the undercoat layer 2.

Comparative Example 4

The procedure for preparation of the electrophotographic photoreceptor 1 in Example 1 was repeated to prepare an electrophotographic photoreceptor 16 except for replacing the undercoat layer 2 coating liquid with a coating liquid having the following formulation.

Undercoat Layer 2 Coating Liquid

| | |
|---|---|
| Alkyd resin (Bekkolite M6401-50 from Dainippon Ink And Chemicals, inc., having a solid content of 50% and a hydroxyl value of 130) | 14 |
| Block isocyanate resin (Burnock B7-887-60 from Dainippon Ink And Chemicals, inc., having a solid content of 60%) | 8 |
| 2-butanone | 100 |

A metal oxide was not included. The alkyd resin to the block isocyanate resin is about 1.5/1 in weight ratio.

Comparative Example 5

The procedure for preparation of the electrophotographic photoreceptor 1 in Example 1 was repeated to prepare an electrophotographic photoreceptor 17 except for replacing the undercoat layer 2 coating liquid with a coating liquid having the following formulation.

Undercoat Layer 2 Coating Liquid

| | |
|---|---|
| Antimony-doped tin oxide (from Mitsui Mining And Smelting Company, Limited, having an average primary particle diameter about 0.02 μm and specific resistivity of $9.4 \times 10^1$ Ω · cm) | 80 |
| Alkyd resin (Bekkolite M6401-50 from Dainippon Ink And Chemicals, inc., having a solid content of 50% and a hydroxyl value of 130) | 18 |
| Block isocyanate resin (Burnock B7-887-60 from Dainippon Ink And Chemicals, inc., having a solid content of 60%) | 10 |
| 2-butanone | 90 |

The metal oxide to the alkyd resin is about 1.1/1 in content ratio. The alkyd resin to the block isocyanate resin is about 1.5/1 in weight ratio.

Comparative Example 6

The procedure for preparation of the electrophotographic photoreceptor 1 in Example 1 was repeated to prepare an electrophotographic photoreceptor 18 except for replacing the undercoat layer 2 coating liquid with a coating liquid having the following formulation.

Undercoat Layer 2 Coating Liquid

| | |
|---|---|
| Electroconductive titanium oxide (ET500W from Ishihara Sangyo Kaisha, Ltd., having an average primary particle diameter about 0.3 μm and specific resistivity of $4.3 \times 10^2$ Ω · cm) | 70 |
| Alkyd resin (Bekkolite M6401-50 from Dainippon Ink And Chemicals, inc., having a solid content of 50% and | 15 |

-continued

| | |
|---|---|
| a hydroxyl value of 130) | |
| Block isocyanate resin (Burnock B7-887-60 from Dainippon Ink And Chemicals, inc., having a solid content of 60%) | 7 |
| 2-butanone | 80 |

The metal oxide to the alkyd resin is about 2/1 in content ratio. The alkyd resin to the block isocyanate resin is about 1.8/1 in weight ratio.

Comparative Example 7

The procedure for preparation of the electrophotographic photoreceptor 1 in Example 1 was repeated to prepare an electrophotographic photoreceptor 19 except for replacing the undercoat layer 2 coating liquid with a coating liquid having the following formulation.

Undercoat Layer 2 Coating Liquid

| | |
|---|---|
| Titanium oxide (CR-EL from Ishihara Sangyo Kaisha, Ltd., having a purity of 99.7%, an average primary particle diameter about 0.25 μm and specific resistivity of $3.5 \times 10^9$ Ω · cm) | 80 |
| Alkyd resin (Bekkolite M6401-50 from Dainippon Ink And Chemicals, inc., having a solid content of 50% and a hydroxyl value of 130) | 14 |
| Melamine resin (L-145-60 from Dainippon Ink And Chemicals, inc., having a solid content of 60%) | 10 |
| 2-butanone | 90 |

The metal oxide to the alkyd resin is about 2.1/1 in content ratio. The alkyd resin to the block isocyanate resin is about 1.2/1 in weight ratio.

Comparative Example 8

The procedure for preparation of the electrophotographic photoreceptor 1 in Example 1 was repeated to prepare an electrophotographic photoreceptor 20 except for replacing the undercoat layer 1 coating liquid with a coating liquid having the following formulation, and making the undercoat layer 1 have a thickness of 1.0 μm.

Undercoat Layer 1 Coating Liquid

| | |
|---|---|
| Titanium oxide (CR-EL from Ishihara Sangyo Kaisha, Ltd., having a purity of 99.7%, an average primary particle diameter about 0.25 μm and specific resistivity of $3.5 \times 10^9$ Ω · cm) | 40 |
| N-methoxymethylated nylon (FR101 from Namariichi Co., Ltd.) | 10 |
| Methanol | 120 |
| n-butanol | 50 |

Comparative Example 9

The procedure for preparation of the electrophotographic photoreceptor 1 in Example 1 was repeated to prepare an electrophotographic photoreceptor 21 except for replacing the undercoat layer 1(2) with the undercoat layer 2(1).

Comparative Example 10

The procedure for preparation of the electrophotographic photoreceptor 17 in Comparative Example 5 was repeated to prepare an electrophotographic photoreceptor 22 except for replacing the undercoat layer 1(2) with the undercoat layer 2(1).

Example 13

The procedure for preparation of the electrophotographic photoreceptor 1 in Example 1 was repeated to prepare an electrophotographic photoreceptor 23 except for replacing the CTL coating liquid with a coating liquid having the following formulation.

CTL Coating Liquid

| | |
|---|---|
| Methylene chloride | 100 |
| Tetrahydrofuran solution of silicone oil (KF-50 from Shin-Etsu Chemical Co., Ltd., having a dynamic viscosity of 100 cs) | 0.2 |
| Polymer CTM having the following formula and a weight-average molecular weight about 135,000 | 15 |

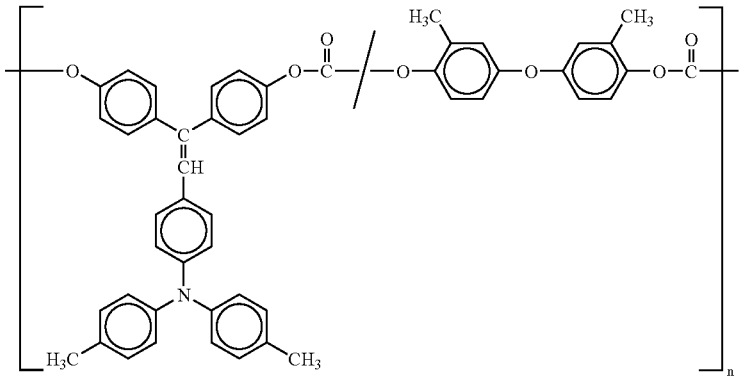

Example 14

The procedure for preparation of the electrophotographic photoreceptor 1 in Example 1 was repeated to prepare an electrophotographic photoreceptor 24 except for making the CTL have a thickness of 23 μm, and coating a crosslinked CTL coating liquid having the following formulation by spray coating to form a crosslinked CTL having a thickness of 5 μm thereon.

Crosslinked CTL Coating Liquid

| | |
|---|---|
| Radical polymerizing monomer having no charge transport structure and three or more functional groups (Trimethylolpropanetriacrylate, KAYARAD TMPTA from NIPPON KAYAKU CO., LTD.) having a molecular weight (Mw) of 296, 3 functional groups and Mw/3 of 99 | 10 |
| Monofunctional radical polymerizing compound having a charge transport structure (Compound No. 54) | 10 |
| Photo polymerization initiator (1-hydroxy-cyclohexyl-phenyl-ketone IRGACURE 184 from CIBA SPECIALTY CHEMICALS) | 1 |
| Tetrahydrofuran | 100 |

The crosslinked CTL was naturally dried for 20 min after coated, and irradiated by a metal halide lamp having a capacity of 160 W/cm at a distance of 120 mm and an irradiation intensity of 500 mW/cm$^2$ for 60 sec to harden the coated layer, and further dried at 130° C. for 20 min.

Example 15

The procedure for preparation of the electrophotographic photoreceptor 24 in Example 14 was repeated to prepare an electrophotographic photoreceptor 25 except for replacing the radical polymerizing monomer having no charge transport structure and three or more functional groups included in the crosslinked CTL coating liquid with the following monomer, and the monofunctional radical polymerizing compound having a charge transport structure with the compound No. 138.

| | |
|---|---|
| Pentaerythritoltetraacrylate SR-295 from Sartomer Company, Inc., having a molecular weight (Mw) of 352, four function groups (Fg), and a ratio (Mw/Fg) of 88 | |

Example 16

The procedure for preparation of the electrophotographic photoreceptor 24 in Example 14 was repeated to prepare an electrophotographic photoreceptor 26 except for replacing the radical polymerizing monomer having no charge transport structure and three or more functional groups included in the cross linked CTL coating liquid with the following monomer, the photopolymerization initiator with the following compound, and making the crosslinked CTL have a thickness of 5.0 μm.

| | |
|---|---|
| Caprolactone-modified dipentaerythritolhexaacrylate KAYARAD DPCA-60 from Nippon Kayaku Co., Ltd., having a molecular weight (Mw)of 1,947, 6 function groups (Fg) and a ratio (Mw/Fg) of 325 | 10 |
| 2,2-dimethoxy-1,2-diphenylethane-1-one IRGACURE 651 from CIBA SPECIALTY CHEMICALS | 1 |

Example 17

The procedure for preparation of the electrophotographic photoreceptor 1 in Example 1 was repeated to prepare an electrophotographic photoreceptor 27 except for making the CTL have a thickness of 23 μm, and coating a coating liquid having the following formulation to form a CTL including a metal oxide and having a thickness of 5 μm thereon.

CTL Including a Metal Oxide Coating Liquid

| | |
|---|---|
| Alumina SUMICORUNDUM AA-03 from Sumitomo Chemical Co., Ltd., having an average primary particle diameter of 0.3 μm | 2 |
| Wet dispersant BYK-P104 from BYK-Chemie, including a solid content of 50% | 0.025 |
| CTM having the following formula | 10 |

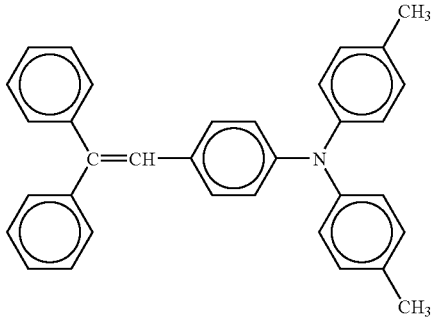

| | |
|---|---|
| Cyclohexanone | 500 |
| Tetrahydrofuran | 150 |

The thus prepared electrophotographic photoreceptors 1 to 27 were installed in a digital copier from Ricoh Company, Ltd., using a scorotron charger and a LD as a light source emitting light having a wavelength of 780 nm to write images through a polygon mirror, and wherein a voltage applied to the electrophotographic photoreceptors is controlled such that they have charged potentials (VD) of 900 (−V). The developing bias was set at 650 (−V) to produce images and the initial potential (VL) of irradiated part of each electrophotographic photoreceptor was measured, and qualities of the images were evaluated to classify them into the following 4 grades.

◎: very good

○: slightly deteriorated, but no problem

Δ: apparently deteriorated

X: very poor defective images

In addition, the potential (VL) of irradiated part thereof after 500,000 images were incessantly produced was also measured.

The results are shown in Table 3.

TABLE 3

| | | Evaluation Results | | | | |
|---|---|---|---|---|---|---|
| | | Initial | | After 500,000 images | | |
| | No. | VL (−V) | Image Quality | VL (−V) | Image Quality | Abraded amount (μm) |
| Ex. 1 | 1 | 140 | ◎ | 160 | ◎ | 7.0 |
| Ex. 2 | 2 | 140 | ◎ | 160 | ◎ | 7.0 |
| Ex. 3 | 3 | 130 | ◎ | 145 | ○background fouling | 7.0 |
| Ex. 4 | 4 | 160 | ◎ | 185 | ○background fouling | 7.0 |
| Ex. 5 | 5 | 155 | ◎ | 195 | ○image density deteriorated | 6.5 |
| Ex. 6 | 6 | 125 | ◎ | 140 | ◎ | 7.0 |
| Ex. 7 | 7 | 130 | ○moire | 140 | ○moire | 7.0 |
| Ex. 8 | 8 | 165 | ◎ | 190 | ○striped background fouling | 6.5 |
| Ex. 9 | 9 | 150 | ◎ | 180 | ◎ | 7.0 |
| Ex. 10 | 10 | 145 | ◎ | 170 | ◎ | 7.0 |
| Ex. 11 | 11 | 170 | ◎ | 210 | ○image density deteriorated | 7.0 |
| Ex. 12 | 12 | 165 | ◎ | 200 | ○image density deteriorated | 6.5 |
| Com. Ex. 1 | 13 | 125 | ◎ | 145 | Xbackground fouling | 7.0 |
| Com. Ex. 2 | 14 | 165 | Δmoire | 225 | Δmoire Δimage density deteriorated | 7.0 |
| Com. Ex. 3 | 15 | 155 | Δmoire Δbackground fouling | 210 | Δmoire ○image density deteriorated Xbackground fouling | 7.0 |
| Com. Ex. 4 | 16 | 350 | Ximage density deteriorated | | Image density deteriorated, and image production was stopped | |
| Com. Ex. 5 | 17 | 120 | ○background fouling | 135 | Δbackground fouling | 7.0 |
| Com. Ex. 6 | 18 | 120 | ○background fouling | 140 | Δbackground fouling | 7.0 |
| Com. Ex. 7 | 19 | 140 | ◎ | 160 | Δbackground fouling | 7.0 |
| Com. Ex. 8 | 20 | 145 | ○background fouling | 185 | Xbackground fouling | 7.0 |
| Com. Ex. 9 | 21 | 220 | ○image density deteriorated | 270 | Δimage density deteriorated | 7.0 |
| Com. Ex. 10 | 22 | 145 | ◎ | 160 | Δbackground fouling | 7.0 |
| Ex. 13 | 23 | 140 | ◎ | 170 | ◎ | 4.5 |
| Ex. 14 | 24 | 165 | ◎ | 175 | ◎ | 1.0 |
| Ex. 15 | 25 | 155 | ◎ | 170 | ◎ | 03.9 |
| Ex. 16 | 26 | 170 | ◎ | 170 | ○background fouling | 2.4 |
| Ex. 17 | 27 | 150 | ◎ | 185 | ○toner film was formed | 1.7 |

The electrophotographic photoreceptor of the present invention prevents the background fouling even after producing 500,000 images, and stability of the image quality was noticeably improved. In addition, the potential of the irradiated part thereof was reduced for higher durability and stability. On the contrary, an electrophotographic photoreceptor having a single-layered undercoat layer or no undercoat layer apparently increases moire and background fouling, and stability of the image quality largely deteriorated. An electrophotographic photoreceptor having an undercoat layer including a metal oxide having a specific resistivity less than $10^7$ Ω·cm or an electrophotographic photoreceptor having an undercoat layer including no metal oxide on an undercoat layer including a metal oxide increases the background fouling. An electrophotographic photoreceptor having an undercoat layer including a metal oxide and no block isocyanate compound tended to worsen the background fouling. Further, the electrophotographic photoreceptor of the present invention having a crosslinked CTL on the photosensitive layer or CTL noticeably improved the abrasion resistance thereof without deterioration of the image quality. An electrophotographic photoreceptor having a CTL including an inorganic pigment on the surface thereof improved the abrasion resistance thereof, but tended to slightly increase the toner film. The electrophotographic photoreceptor of the present invention having an undercoat layer including a metal on an undercoat layer including no metal oxide, wherein the undercoat layer including a metal includes a metal oxide having a specific resistivity not less than $10^7$ Ω·cm and a block isocyanate, largely improved the background fouling without much affecting the residual potential and realized higher durability and stability thereof. Therefore, the exchange frequency thereof was largely reduced to save resources, and formaldehyde when an electrophotographic photoreceptor is prepared can be prevented to protect the environment. Further, the electrophotographic photoreceptor realizes an image forming apparatus stably producing high-quality images for long periods.

This application claims priority and contains subject matter related to Japanese Patent Application No. 2005-007664 filed on Jan. 14, 2005, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

an electroconductive substrate;

a first undercoat layer including no metal oxide, located overlying the electroconductive substrate;

a second undercoat layer comprising a metal oxide and a binder resin, located overlying the first undercoat layer, wherein the binder resin comprises a block isocyanate compound; and a photosensitive layer located overlying the second undercoat layer, wherein the metal oxide in the second undercoat layer has a specific resistivity not less than $10^7$ Ω·cm.

2. The electrophotographic photoreceptor of claim 1, wherein the photosensitive layer comprises:

a charge generation layer; and a charge transport layer located overlying the charge generation layer.

3. The electrophotographic photoreceptor of claim 1, wherein the metal oxide is titanium oxide.

4. The electrophotographic photoreceptor of claim 1, wherein the second undercoat layer comprises two or more metal oxides satisfying the following relationship:

$$0.2<D2/D1\leqq 0.5$$

wherein D1 is an average primary particle diameter of the metal oxide having the largest average primary particle diameter and D2 is an average primary particle diameter of the metal oxide having the smallest average primary particle diameter.

5. The electrophotographic photoreceptor of claim 4, wherein D2 is less than 0.2 μm.

6. The electrophotographic photoreceptor of claim 4, wherein the two or more metal oxides have a mixing ratio satisfying the following relationship:

$$0.2\leqq T2/(T1+T2)\leqq 0.8$$

wherein T1 is a content of the metal oxide having the largest average primary particle diameter and T2 is a content of the metal oxide having the smallest average primary particle diameter.

7. The electrophotographic photoreceptor of claim 1, wherein the binder resin in the second undercoat layer comprises an alkyd resin having a hydroxyl value not less than 60 and a block isocyanate compound.

8. The electrophotographic photoreceptor of claim 7, wherein a weight ratio of the alkyd resin to the block isocyanate compound is from 1/1 to 4/1.

9. The electrophotographic photoreceptor of claim 1, wherein a volume ratio of the metal oxide to the binder resin in the second undercoat layer is from 1/1 to 3/1.

10. The electrophotographic photoreceptor of claim 1, wherein the first undercoat layer comprises a polyamide resin.

11. The electrophotographic photoreceptor of claim 10, wherein the polyamide resin is N-methoxymethylated nylon.

12. The electrophotographic photoreceptor of claim 1, wherein the first undercoat layer has a thickness less than 2.0 μm.

13. The electrophotographic photoreceptor of claim 1, further comprising a crosslinked charge transport layer located overlying the photosensitive layer.

14. The electrophotographic photoreceptor of claim 13, wherein the crosslinked charge transport layer comprises:

a radical polymerizing monomer having no charge transport structure and three or more functional groups; and a monofunctional radical polymerizing compound having a charge transport structure.

15. The electrophotographic photoreceptor of claim 14, wherein each of the three or more functional groups of the radical polymerizing monomer having no charge transport structure is at least a member selected from the group consisting of acryloyloxy groups and methacryloyloxy groups.

16. The electrophotographic photoreceptor of claim 14, wherein a ratio of the molecular weight of the radical polymerizing monomer having no charge transport structure and three or more functional groups to the number of the functional groups thereof is not greater than 250 .

17. The electrophotographic photoreceptor of claim 14, wherein the functional group of the monofunctional radical polymerizing compound having a charge transport structure is a member selected from the group consisting of acryloyloxy groups and methacryloyloxy groups.

18. The electrophotographic photoreceptor of claim 14, wherein the charge transport structure of the monofunctional radical polymerizing compound is a triarylamine structure.

19. The electrophotographic photoreceptor of claim 14, wherein the monofunctional radical polymerizing compound having a charge transport structure is at least a member selected from the group consisting of compounds having the following formulae (1), (2) and (3):

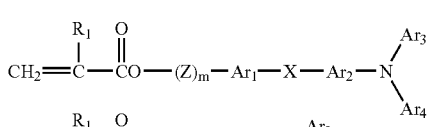

(1)

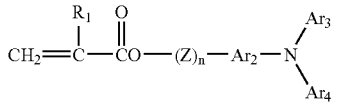

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ each, independently, represent a hydrogen atom, a halogen atom, a substituted or an unsubstituted alkyl group, a substituted or an unsubstituted aralkyl group and a substituted or an unsubstituted aryl group; $Ar_1$ and $Ar_2$ each, independently, represent a substituted or an unsubstituted arylene group; $Ar_3$ and $Ar_4$ each, independently, represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom or a vinylene group; Z represents a substituted or an unsubstituted alkylene group, a substituted or an unsubstituted alkyleneether group or an alkyleneoxycarbonyl group; and m and n each, independently, represent 0 or an integer of from 1 to 3;

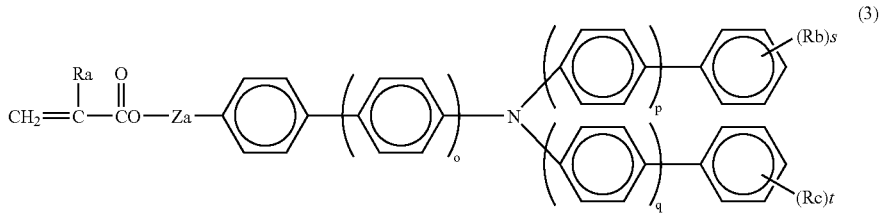

wherein o, p and q each, independently, represent 0 or 1; Ra represents a hydrogen atom or a methyl group; Rb and Rc each, independently, represents a substituent other than a hydrogen atom and an alkyl group having 1 to 6 carbon atoms, and may be different from each other; s and t each, independently, represent 0 or an integer of from 1 to 3; Za represents a single bond, a methylene group, ethylene group,

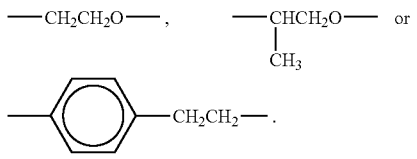

20. The electrophotographic photoreceptor of claim 14, wherein the crosslinked charge transport layer comprises the radical polymerizing monomer having no charge transport structure and three or more functional groups in an amount of from 30 to 70% by weight based on total weight thereof.

21. The electrophotographic photoreceptor of claim 14, wherein the crosslinked charge transport layer comprises the monofunctional radical polymerizing compound having a charge transport structure in an amount of from 30 to 70% by weight based on total weight thereof.

22. The electrophotographic photoreceptor of claim 13, wherein the crosslinked charge transport layer is insoluble in an organic solvent.

23. The electrophotographic photoreceptor of claim 13, wherein the crosslinked charge transport layer is hardened with heat or light.

24. An image forming apparatus, comprising a unit comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a toner to form a toner image thereon; and a transferer configured to transfer the toner image onto a receiving material.

25. The image forming apparatus of claim 24, further comprising a plurality of the units.

26. The image forming apparatus of claim 24, wherein the charger is applied with a DC voltage overlapped with an AC voltage.

27. A process cartridge detachable from an image forming apparatus, comprising:

the electrophotographic photoreceptor according to claim 1; and at least one of a charger, an irradiator, an image developer, and a cleaner.

* * * * *